US006357861B1

(12) United States Patent
Katsumi

(10) Patent No.: US 6,357,861 B1
(45) Date of Patent: Mar. 19, 2002

(54) IMAGE FORMING DEVICE

(75) Inventor: Adachi Katsumi, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 09/337,373

(22) Filed: Jun. 21, 1999

(30) Foreign Application Priority Data

Jun. 22, 1998 (JP) ..... 10-174210

(51) Int. Cl.[7] ..... B41J 2/06
(52) U.S. Cl. ..... 347/55
(58) Field of Search ..... 347/55, 151, 120, 347/141, 154, 103, 123, 111, 159, 127, 128, 131, 125, 158; 399/271, 290, 292, 293, 294, 295

(56) References Cited

U.S. PATENT DOCUMENTS 6,079,818 A * 6/2000 Wakahara et al. ..... 347/55

FOREIGN PATENT DOCUMENTS

| | | |
|---|---|---|
| JP | 1-503221 | 11/1989 |
| JP | 3-215874 | 9/1991 |
| JP | 4-168064 | 6/1992 |
| JP | 4-238050 | 8/1992 |
| JP | 5-131671 | 5/1993 |
| JP | 9-20029 | 1/1997 |

* cited by examiner

*Primary Examiner*—Raquel Yvette Gordon
(74) *Attorney, Agent, or Firm*—Dike, Bronstein, Robertes & Cushman IP Group; David G. Conlin; David A. Tucker

(57) ABSTRACT

To provide an image forming device for forming images by stably supplying a developing agent in a high density cloud form and by controlling the flight/non-flight at a low voltage and in which the influence of the position of the control electrodes upon the accuracy is less. A developing agent carrier carries a developing agent T which is charged to a given polarity. The developing agent is placed in a electric field for causing the developing agent to fly in a direction of an arrow, which is formed by an opposing electrode (not shown) so that it forms images upon a recording medium (not shown) which is moving on the opposing electrode. A first and second control electrode layers are provided between the opposing electrode and a developing agent carrier. Control electrodes which control the passage of the developing agent through the gates of respective layers are provided. By this structure, the amount, density and supply timing of the developing agent cloud which is formed between the control electrode layers can be controlled in an optimum manner, so that stable and uniform image forming can be achieved.

36 Claims, 54 Drawing Sheets

STATE 2

STATE 3

STATE 4

STATE 4~5

STATE 5

STATE 2

STATE 3

STATE 4

STATE 4~5

STATE 5

STATE 1

STATE 2

STATE 3

STATE 3~4

STATE 4

STATE 4~5

STATE 5

FIG.43

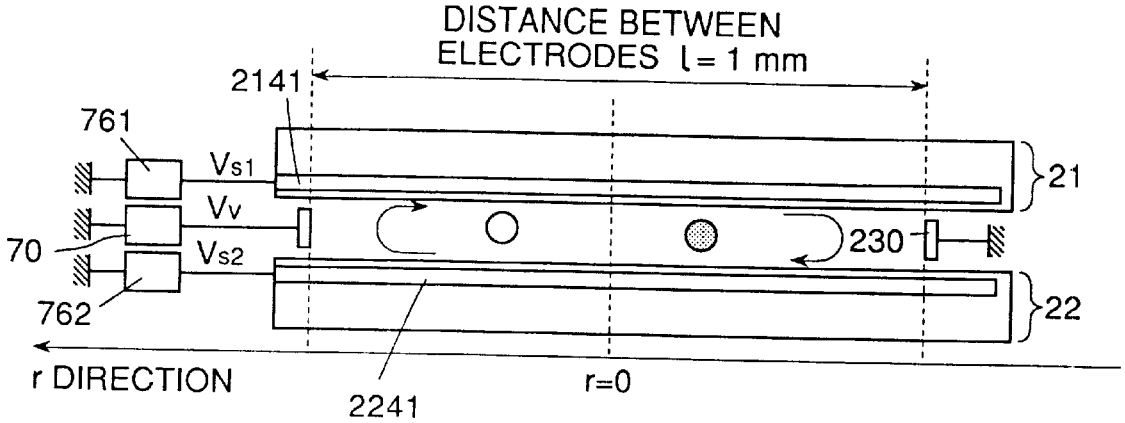

EQUATION OF MOTION OF DEVELOPING AGENT $$m \cdot \frac{d^2 r}{dt^2} = q \cdot E_{(t)} - 6 \cdot \pi \cdot d \cdot \eta \cdot \frac{dr}{dt}$$

WHEREIN $E_{(t)} = \frac{V_0}{l} \cdot \sin(2 \cdot \pi \cdot f \cdot t)$ $\eta$ : DENOTES VISCOUS RESISTANCE OF AIR $\eta = 1.82 \times 10^{-5} (N \cdot s/m^2)$ INITIAL CONDITION $i \cdot e \begin{cases} t=0 \\ \frac{dr}{dt} = v(t) = 0 \end{cases}$, $i \cdot e \begin{cases} t=0 \\ r=0 \end{cases}$

CONDITION OF DEVELOPING AGENT

AVERAGE PARTICLE RADIOUS $d = 5\,\mu m$

SPECIFIC GRAVITY = 1.1

○ SPECIFIC CHARGE Q/M : $5 \times 10^{-3}$ (C/Kg)

◎ SPECIFIC CHARGE Q/M : $10 \times 10^{-3}$ (C/Kg)

VOLTAGE APPLICATION CONDITION $V_v = V_0 \cdot \sin(2 \cdot \pi \cdot f \cdot t)$ $V_0 = 1000$ V、FREQUENCY f = 1000Hz DISTANCE BETWEEN ELECTRODES l = 1 mm

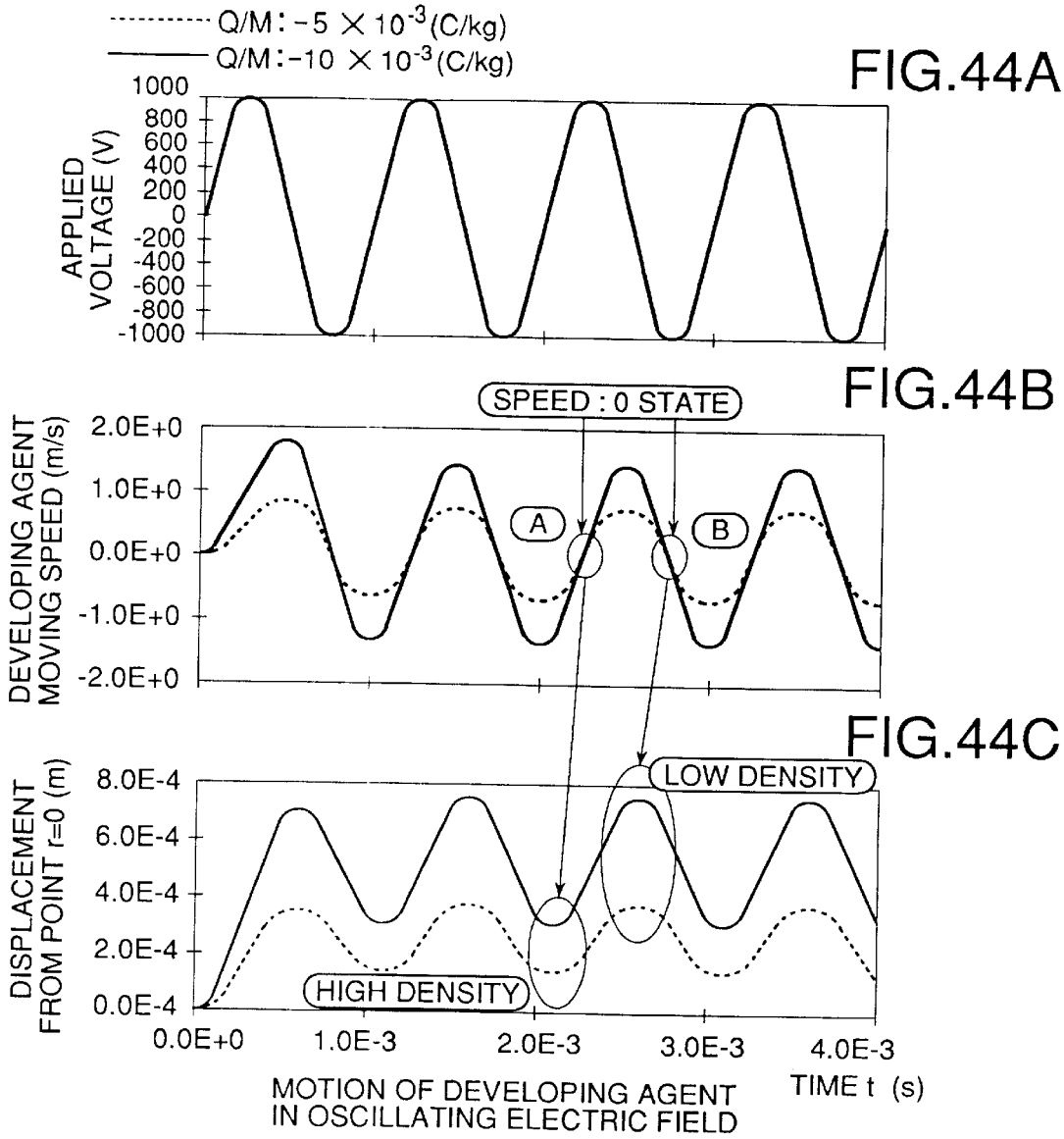
Q/M: -5 × 10^-3 (C/kg)
Q/M: -10 × 10^-3 (C/kg)
FIG.44A
APPLIED VOLTAGE (V)
1000
800
600
400
200
0
-200
-400
-600
-800
-1000
FIG.44B
SPEED : 0 STATE
DEVELOPING AGENT MOVING SPEED (m/s)
2.0E+0
1.0E+0
0.0E+0
-1.0E+0
-2.0E+0
A
B
FIG.44C
LOW DENSITY
HIGH DENSITY
DISPLACEMENT FROM POINT r=0 (m)
8.0E-4
6.0E-4
4.0E-4
2.0E-4
0.0E-4
0.0E+0
1.0E-3
2.0E-3
3.0E-3
4.0E-3
TIME t (s)
MOTION OF DEVELOPING AGENT IN OSCILLATING ELECTRIC FIELD
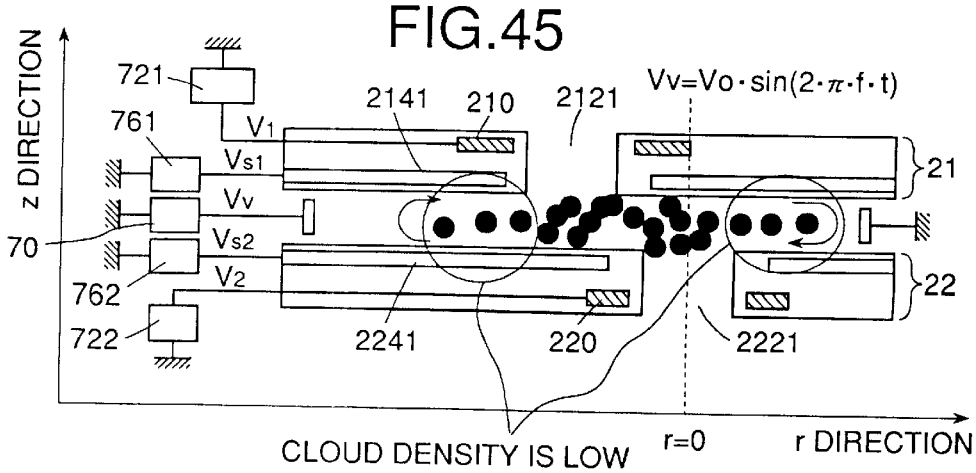
FIG.45
z DIRECTION
721
761
V1
Vs1
Vv
Vs2
V2
70
762
722
2141
210
2121
Vv=Vo·sin(2·π·f·t)
21
22
2241
220
2221
CLOUD DENSITY IS LOW
r=0
r DIRECTION

MOTION OF DEVELOPING AGENT IN OSCILLATING ELECTRIC FIELD

MOTION OF DEVELOPING AGENT IN OSCILLATING ELECTRIC FIELD

STATE 1

STATE 4~5

STATE 5

STATE 6

STATE 1

STATE 4~5

STATE 5

STATE 6

STATE 1

STATE 5

STATE 6

STATE 7

STATE 1

STATE 5

STATE 6

STATE 7

STATE 1

STATE 2

STATE 2
CLOUD DENSITY IS LOW AFTER ABOUT 1/2 T

STATE 2

CLOUD DENSITY IS HIGH AFTER ABOUT 2/2 T

STATE 3

STATE 4

STATE 5

STATE 6

STATE 7

STATE 8

MOTION OF DEVELOPING AGENT IN OSCILLATING ELECTRIC FIELD

MOTION OF DEVELOPING AGENT IN OSCILLATING ELECTRIC FIELD

IMAGE FORMING DEVICE

BACKGROUND OF THE INVENTION

The present invention relates to an image forming device which is applied to a printing unit of digital copying machines or facsimiles, or digital printers, plotters and the like for forming images upon a recording medium by flying a developing agent.

A number of prior art image forming devices have adopted, so-called "electrostatic photographic or xerographic process in which image information is converted into photo-information, which is incident upon a photosensitive material, on which electrostatic latent images are formed and then the images are developed by a developing agent. Recently, image forming device which directly flies an ink or developing agent for conducting a high definition image forming with a simpler arrangement has been proposed since rapid digitalization of the image forming device has been advanced due to wide spreading of computers and their advancement in performance. Since printing of visually excellent high definition, which is equivalent to that of electrostatic photography can be conducted by using a developing agent can be conducted in the image forming device in which a developing agent is directly flown and the necessity of any optical writing system or photosensitive material is obviated, a number of image forming systems have been proposed. A process in which images of a developing agent are formed by applying a voltage upon wires which are formed in a matrix to form electrostatic images in the vicinity of the wires and applying a developing agent upon the electrostatic images is disclosed in, for example Japanese Patent Publication No. 1(1989)-503221.

In such an image forming device, the developing agent is attracted to a developing agent carrier by various attracting forces such as electrostatic, intermolecular, liquid crosslinking forces. It is necessary to apply upon the developing agent a high electrostatic field of several MV/m or more enough to overcome these attracting forces in order to fly the developing agent. Several control electrodes and a high voltage switching device are required to control the flight of the developing agent. The breakdown voltage of the high voltage ICs is about 300 V. It is necessary to preset the distance between the developing agent carrier and the control electrodes to about 100 $\mu$m in order to provide a strength of electric field of several MV/m and it is necessary to strictly keep the distance between the developing agent carrier and the control electrodes at an accuracy in order of $\mu$m. If such accuracy is not kept, a local ununiformity of flight electric field strength may occur, resulting in variations in the amount of flown developing agent.

In order to solve the problems of the prior art, various concepts have been proposed for supplying a developing agent in the form of cloud to overcome the attracting force between the developing agent and the developing agent carrier.

A concept in which the developing agent is formed into cloud form by using a brush-like developing agent carrier and by tapping the brush unit with a blade is disclosed in Japanese Laid-Open Patent Publication No. 3(1991)-215874.

Concepts for forming the developing agent into a cloud form by using a belt-like developing agent carrier and in position opposite to the control electrodes, by contacting a cam-like member to the reverse surface of the belt, or by imparting ultrasonic vibration and electrical vibration thereto are disclosed in Japanese Laid-Open Patent Publication Nos. 4(1992)-168064, 4(1992)-238050 and 5(1993)-131671.

However, if the brush-like developing carrier is used, problems may occur in which control of the amount of conveyed developing agent is ununiform and in which the cloud form is changed by bending of brush fibers due to aging. If belt-like developing agent carrier is used, imparted vibration is conducted through the belt to give an adverse influence upon a developing agent layer forming unit, or to change the position of the belt per se, which faces the control electrodes, so that the flying electric field is changed to give an adverse influence upon the amount of flown developing agent. Furthermore, it is hard to keep a uniform and stable cloud condition only by imparting such mechanical vibration, so that an aggregate of the developing agent remains. This may cause a problem in that this aggregate will be deposited to the electrodes and clog openings.

In order to overcome such a problem in Japanese Laid-Open Patent Publication No. 5(1993)-330126, a process in which after cloud condition is established as is disclosed in Japanese Laid-Open Patent Publication No. 3(1991)-215874, the aggregate of the developing agent is crushed by forming an oscillating electric field between a pair of electrodes which sandwich the flight path of the developing agent therebetween to further continue the cloud condition.

However, even in such a process, a mechanism to cause the cloud condition to occur is unstable as mentioned above and it is hard to stably obtain a desired effect even if an oscillating electric field is formed. The electrostatic charges of the developing agent may be specifically distributed. It has been found that if formation of the oscillating electric field when an inappropriate condition will conversely lower the density of the cloud, resulting in partial lowering of the image density. It has been also found that if the voltage application condition is inappropriate in an arrangement to establish oscillating electric fields which sandwich the flight path of the developing agent therebetween, a velocity component which is normal to the flight direction would be imparted to the developing agent, so that spreading of the developing agent may occur in the course of the flight of the developing agent, giving an adverse influence upon the image forming process.

SUMMARY OF THE INVENTION

An object of the present invention is to provide an image forming device in which a developing agent is stably supplied in the cloud form at a high density and image forming is conducted by controlling flight/non-flight of the developing agent at a low voltage and the influence of the accuracy of the position of the control electrodes is reduced.

BRIEF DESCRIPTION OF THE DRAWINGS

FIG. 43 is a view for explaining a model used for calculation and analysis of the motion condition of the developing agent in the flight control unit of the image forming device using the present invention and an example of the analysis result.

FIGS. 44A, 44B and 44C are views for explaining a model used for calculation and analysis of the motion condition of the developing agent in the flight control unit of the image forming device using the present invention and an example of the analysis result.

FIG. 45 is a view for explaining a further example of the motion condition of the developing agent in the flight control unit of the image forming device using the present invention.

PREFERRED EMBODIMENT OF THE INVENTION

Figure 1:
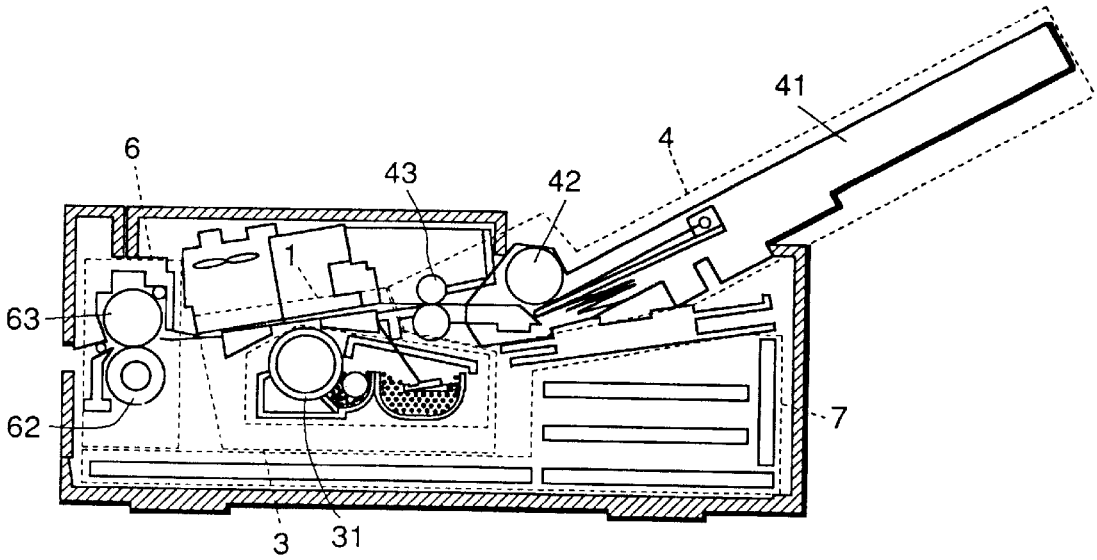
FIG. 1 is a sectional view showing one structure of an image forming device of the present invention.

A sectional view of an image forming device of the present embodiment is shown in FIG. 1. The summary of each component of the apparatus will be described with reference to FIGS. 2 to 102. As shown in FIG. 1, the image forming device of the present system is adapted to form images of a developing agent on an recording medium P by controlling the developing agent of a developing agent supply station 3 in a printing unit 1 in response to an image signal.

Figure 2:
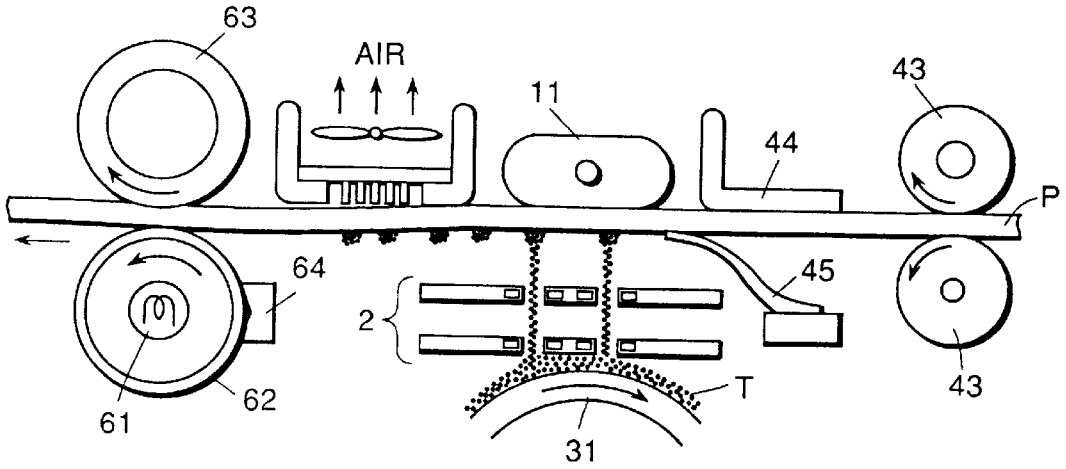
FIG. 2 is a view for explaining the image forming process in the image forming device of the present invention.

The summary of the present image forming device will be described with reference to FIGS. 1 and 2.

A paper sheet supply station 4 is provided upstream of the printing station 1 in a conveying direction of the recording medium P. The paper sheet supply station 4 comprises a paper sheet cassette 41 for accommodating the recording media P therein, a pickup roller 42 for feeding the recording medium P from the paper sheet cassette 41, and a pair of register rollers 43 for conveying the supplied recording medium P in synchronization with the timing of the printing. The recording medium P is guided to the printing station 1 by means of a paper sheet guide plate 44 and a paper pressing plate 45. The paper sheet supply station 4 includes a paper feed sensor (not shown) for detecting feeding of the recording medium P. The above-mentioned pickup roller 42 and register rollers 43 are driven to rotate by means of a drive device (not shown) in response to a drive signal from a controller station 7.

A fixing station which heats and presses the images which have been formed on the recording medium P at the printing station 1 for fixing the images thereon is provided downstream of the printing station 1 in a conveying direction of the recording medium P from the printing station 1. The fixing station 6 comprises a heat roller 62 having a heater incorporated therein, a pressure roller 63 and a thermal sensor 64. The heat roller 62 is formed of, for example, an aluminum tube having a thickness of 2 mm. The heater 61 includes, for example, a halogen lamp and is incorporated and disposed in the heat roller 62. The pressure roller is made of, for example, a silicone resin. The heat roller 62 and pressure roller 63 which are opposing to each other are biased with a load of, for example, 2 kg by means of springs (not shown) at opposite ends of their axes so that they are capable of sandwiching and pressing the recording medium P therebetween.

The thermal sensor 64 is adapted to measure the temperature on the surface of the heat roller 62. The temperature on the surface of the heat roller 62 is controlled by means of a temperature control unit (not shown) of a controller station 7 turning on or off the heater 61 based upon the measurements of the thermal sensor 64 so that the temperature on the surface of the heat roller 62 is kept to, for example, 150° C. The fixing station 6 includes a paper discharge sensor (not shown) for detecting the discharge of the recording medium P. The material of the heater 61, heat roller 62 and the pressure roller 63 is not particularly restricted. The temperature on the surface of the heat roller 62 is not particularly restricted. The fixing station may be arranged to heat and press the images of the developed agent on a transfer belt (not shown) for transferring and fixing them onto the recording medium P.

Although not shown, discharging rollers for discharging to the outside of the apparatus of the recording medium P which has been processed at the fixing station 6 and a tray for receiving the discharged recording medium P may be appropriately provided on the discharge side of the recording medium from the fixing station depending upon the configuration of the image forming device and the discharge direction of the recording medium P. The above-mentioned heat roller 62 and pressure roller 63 are driven to rotate by means of a drive device (not shown).

Figure 3:
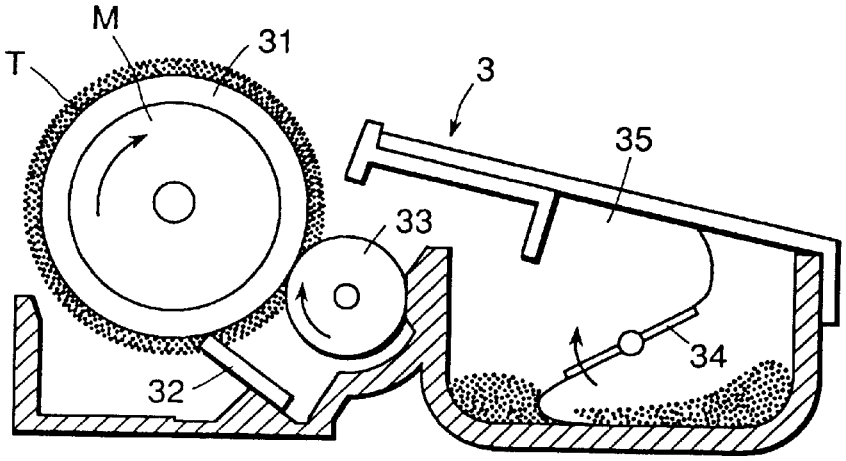
FIG. 3 is a schematic structural view showing an example of a developing agent supply station of the image forming device using the present invention.

An agitation roller 34 for agitating the developing agent T in a developing agent reservoir 35 for preventing the developing agent from being biased in the reservoir 35 and a supply roller 33 for supplying the developing agent T to the developing agent carrier 31 for carrying and conveying the developing agent T are disposed in the developing agent supply station 3 as shown in FIG. 3.

The developing agent T comprises finely divided particles having a diameter of about 10 $\mu$m mainly consisting of styrene-acrylic resin and is accommodated in the developing agent reservoir 35 and is scraped therefrom toward the developing agent carrier 31 by the rotation of the agitation roller 34.

The developing agent carrier 31 is linked with a drive means (not shown) to rotate in a direction of an arrow M so that the rotational speed thereon is 50 mm/s. The carrier 31 is formed with concaves and convexes having the depth of several $\mu$m. The supply roller 33 supplies additional developing agent while abrasively sliding along the surface of the carrier 31 so that a layer of the developing agent is formed to a given thickness by means of a developing agent layer restricting means.

Figure 4:
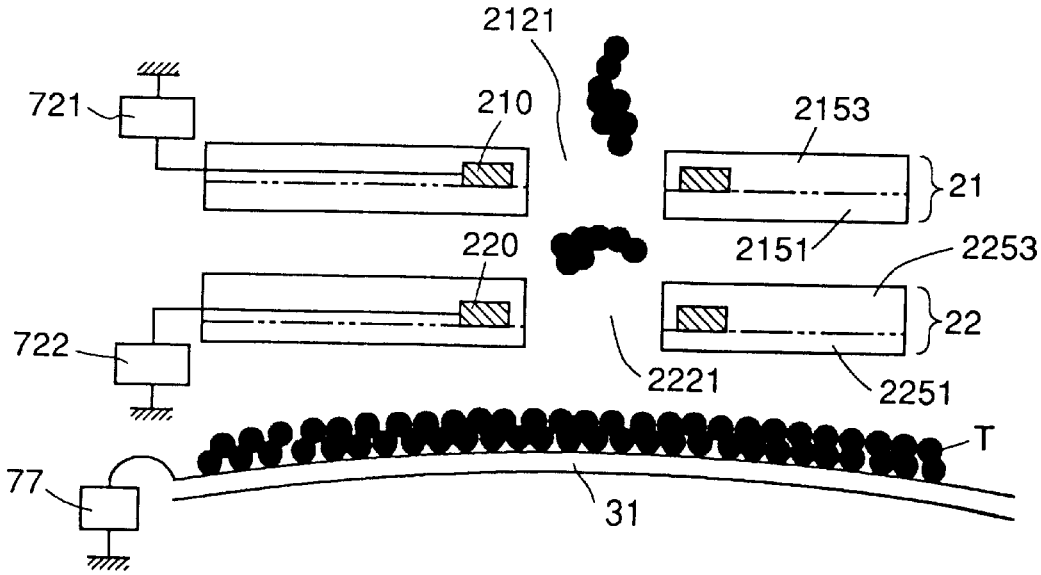
FIG. 4 is a view for explaining an image forming process in a flight control unit of the image forming device used for the present invention.

The printing station 1 comprises a flight control unit 2 which faces the outer periphery of a toner carrier 31 and an opposing electrodes 11. By applying a voltage from a second control electrode driver 722 to a ring-like second control electrode 220 in response to an image signal as shown in FIG. 4, the developing agent T is separated from the developing agent carrier 31 and its passage through a second gate 2221 is controlled. By applying a voltage from a first control electrode driver 721 to a ring-like first control electrode 210, passage of the developing agent to the opposing electrode 11 is selectively controlled. On the other hand, the recording media P which are accommodated in the paper sheet cassette 41 are fed out by means of the pickup roller 42 in response to a printing initiating signal from the controller station 7 and conveyed by register rollers 43. The recording medium P which has been conveyed by the register rollers 43 is conveyed by the paper sheet guide plate 44 and paper pressing plate 45 while it is in close contact with the opposing electrode 11.

The opposing electrode 11 is provided so that the distance between it and the developing agent carrier 31 is, for example, 1 mm. A high voltage of 2 kV is applied to the opposing electrode 11 by a power source for the opposing electrode (not shown) in a given timed relationship, for example, on printing operation. In other words, an electric field required for the developing agent T carried by the carrier 31 to be flown toward the opposing electrode 11 is formed between the opposing electrode 11 and the developing agent carrier 31 by the application of a voltage to the opposing electrode 11 by means of the power source for the opposing electrode (not shown).

The controller station 7 comprises the power source for the opposing electrode (not shown), the first control electrode driver 721, second control electrode driver 722, power source for the developing agent carrier 77, according to the control means, a first column control electrode driver (not shown), first row control electrode driver (not shown), first shield electrode power source 761, second shield electrode power source 762, third shield electrode power source 763, fourth shield electrode power source 764, first cleaning electrode power source 781, second cleaning electrode power source 782, oscillating electric field forming power source 70, a video image processing unit (not shown) for generating video images for controlling the flight of the developing agent based upon the clock, video images and control signals and a main control unit (not shown) for controlling the whole of image forming device.

In the embodiments which will be described hereafter, the potentials which are imparted to given electrodes by the above-mentioned power sources may be represented by the following symbols.

$V_1$: first control electrode potential $V_2$: second control electrode potential $V_d$: developing agent carrier potential $V_{s1}$: first shield electrode potential $V_{s2}$second shield electrode potential $V_{s3}$: third shield electrode potential $V_{s4}$: fourth shield electrode potential $V_V$: oscillating electric field forming electrode potential $V_{c1}$: first cleaning electrode potential $V_{c2}$: second cleaning electrode potential $V_H$opposing electrode potential The above-mentioned flight control unit 2 comprises first and second control electrode layers 21 and 22 which face the opposing electrodes 11 and are two-dimensional distributed. The flight control unit 2 enables the developing agent to move from the developing agent carrier 31 toward the opposing electrodes 11. The potential which is applied to the second control electrode 220 changes the electric field acting upon the developing agent layer on the developing agent carrier 31 so that the developing agent T is moved to a space between the first and second control electrode layers 21 and 22 from the developing agent carrier 31. The potential which is applied to the first control electrode 210 changes the electric field acting upon the developing agent T which is in the form of cloud in that space so that the flight of the developing agent T to the opposing electrode 11 is controlled.

Figure 5:
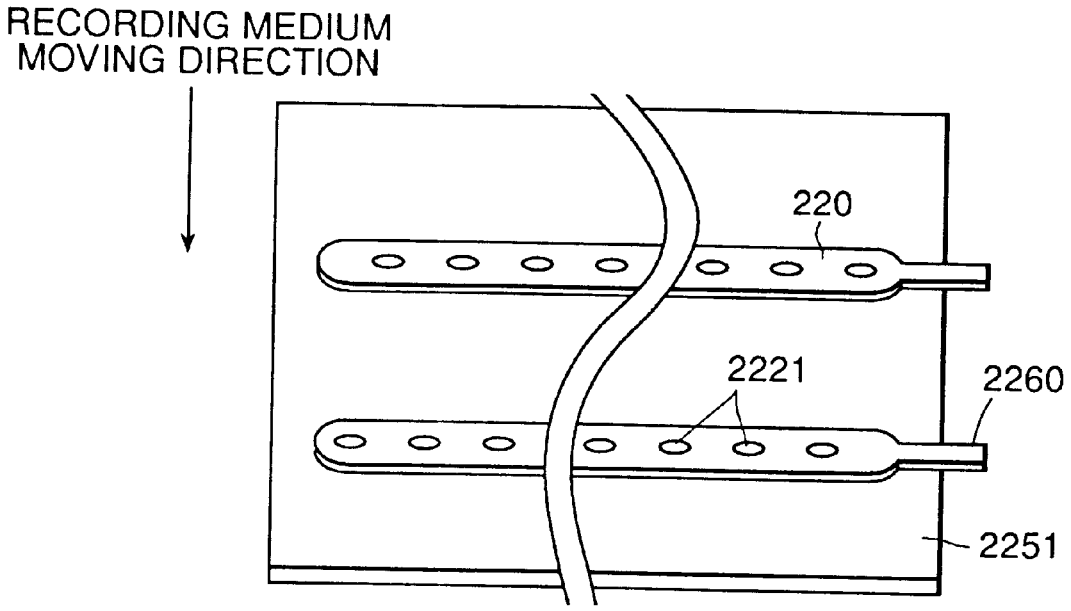
FIG. 5 is a view for explaining one example of the structure of a second control electrode used in the present invention.
Figure 6:
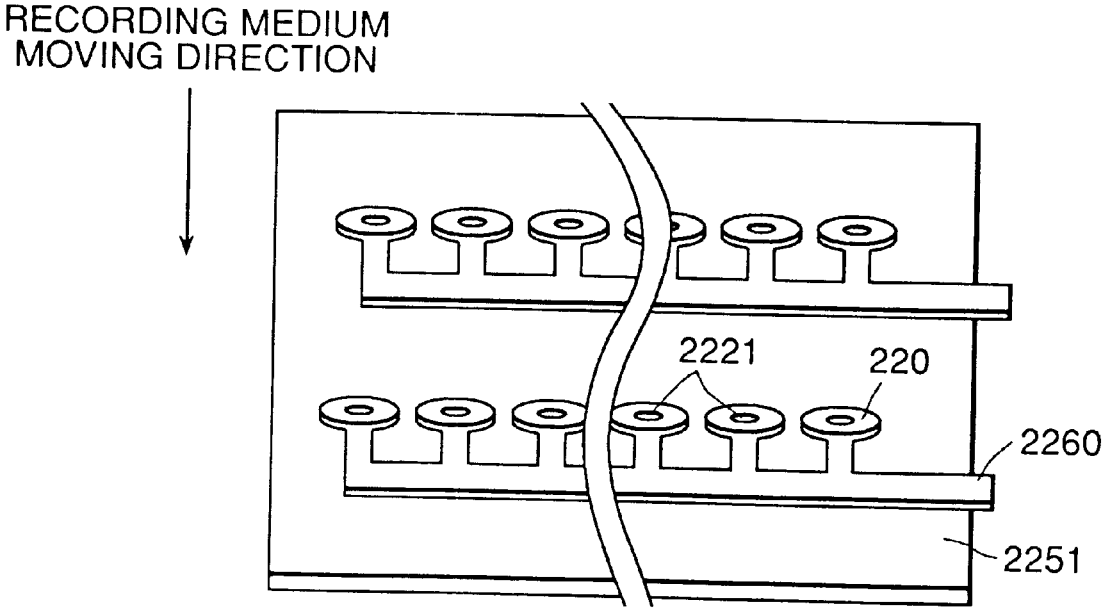
FIG. 6 is a view for explaining another example of the structure of a second control electrode used in the present invention.
Figure 7:
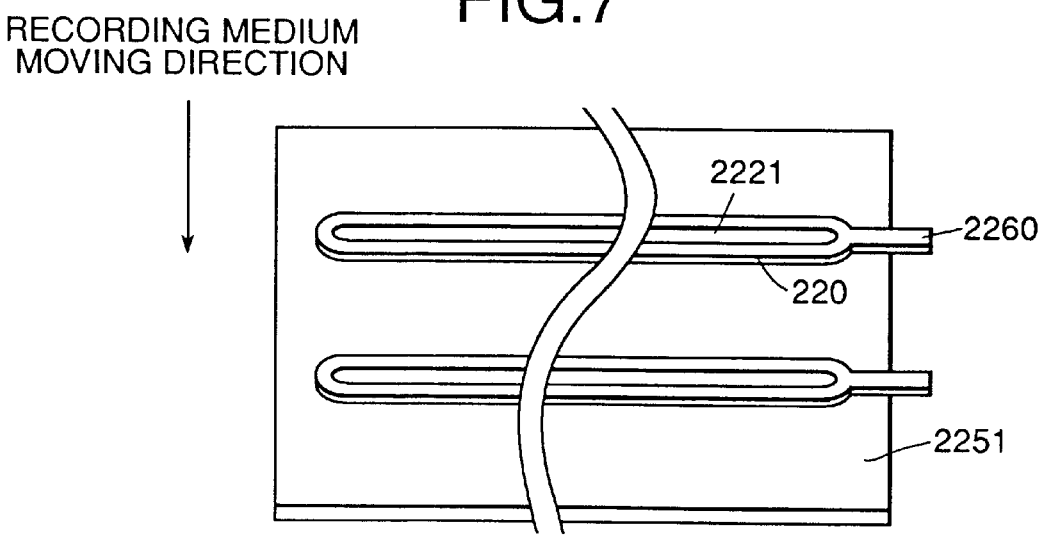
FIG. 7 is a view for explaining a further example of the structure of a second control electrode used in the present invention.

The above-mentioned second control electrode layer 22 is provided in such a manner that the distance between the layer 22 and the outer periphery of the developing agent carrier 31 is, for example, 200 to 500 μm and is firmly mounted by an electrode mount (not shown). As shown in FIGS. 5 to 7, the second control electrode layer 22 comprises second control electrodes 220 having apertures disposed on an insulating substrate layer 2251, and further an insulating substrate layer 2253 (refer to FIG. 4) which protects and insulates the electrodes.

The second control electrodes may have independent apertures as shown in FIGS. 5 and 6, or may have continuous apertures as shown in FIG. 7. The insulating substrate layer is formed of, for example, polyimide resin and is formed to provide a thickness of 25 μm. The insulating substrate layers 2251 and 2253 are formed with holes which should serve as the above-mentioned second gates 2221. The second control electrodes 220 are made of, for example, copper foil having a thickness of 18 μm, for example, and are provided around the holes in a given array. Each hole has a diameter of, for example, 160 μm. The developing agent T which flies from the developing agent carrier 31 to the space between the first and second control electrode layers 21 and 22 passes through these holes. These holes will be referred to as second gate 2221.

Figure 8:
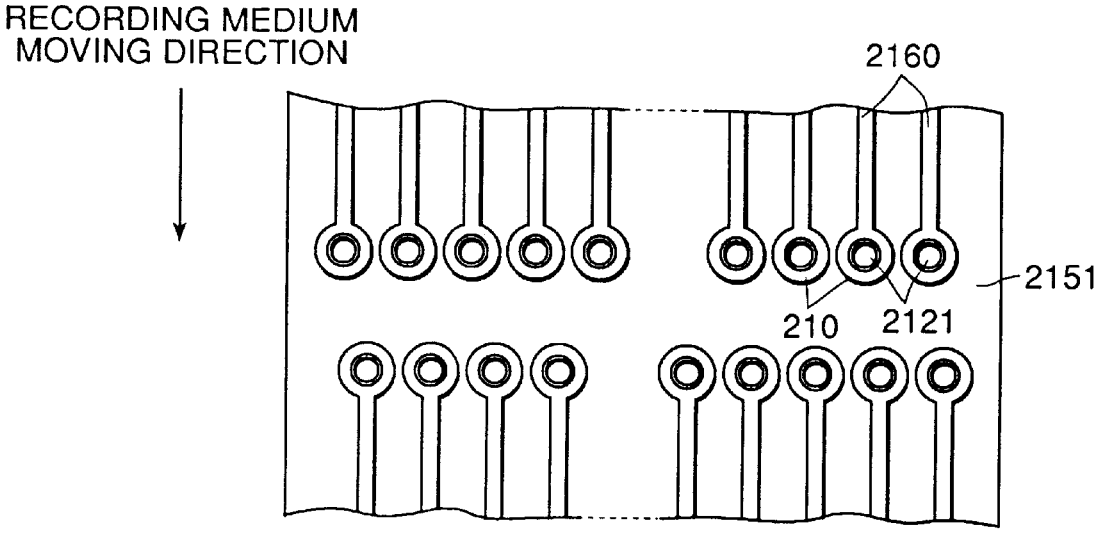
FIG. 8 is a view for explaining one example of the structure of a first control electrode used in the present invention.
Figure 9:
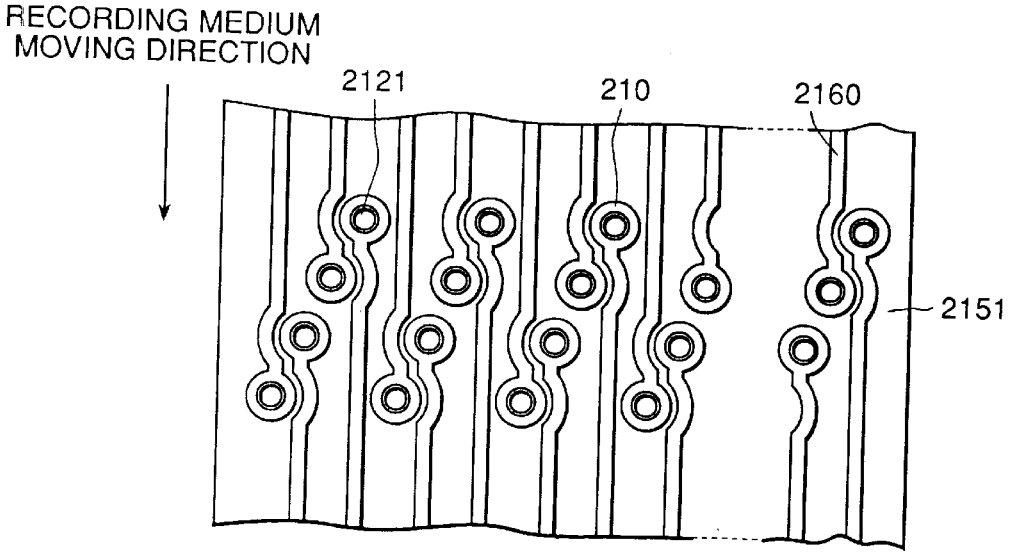
FIG. 9 is a view for explaining another example of the structure of a first control electrode used in the present invention.

The above-mentioned first control electrode layer 21 is provided in such a manner that the distance between the layer 21 and the second control electrode layer 22 is 200 to 500 μm. As shown in FIGS. 8 and 9, the first control electrode layer 21 comprises the first control electrodes 210 disposed on the insulating substrate layer 2151 and a second insulating substrate layer 2153 (refer to FIG. 4 and other FIGS.) which is disposed on the first control electrodes 210. The insulating substrate layers are made of, for example, polyimide resin and is formed to provide a thickness of 25 μm. The insulating substrate layers 2151 and 2153 are formed with holes which should serve as first gates 2121. The first control electrodes 210 are made of, for example, copper foil having a thickness of 18 μm. The electrodes 210 are provided around a holes in a given array. A given potential is applied to each electrode independently of each other. FIG. 8 shows an example in which the electrodes are disposed in two-row array in a conveying direction of recording medium. FIG. 9 shows an example in which the electrodes are disposed in four-row array. Each hole has a diameter of, for example, 120 μm. The developing agent T which flies from the space between the first and second control electrode layers 21 and 22 to the opposing electrodes 11 passes through the holes. The holes are referred to the first gate 2121.

The distance between the second control electrode layer 22 and the developing agent carrier 31 or between the second control electrode layer 22 and the first control electrode layer 21 is not particularly limited to the above-mentioned values. Although the first control electrode layer 21 is provided with the first gates 2121 having a aperture diameter of 120 μm and the second control electrode layer 22 is formed with second gates 2221 having an aperture diameter of 160 μm, the size of each gate, the material and thickness of the insulating layer and each control electrode is not particularly restricted.

The above-mentioned first control electrodes 210 are electrically connected to the first control electrode driver 721 via power supply lines 2160. The first control electrodes 210 are disposed on the base substrate 2151 which is an insulating substrate. This assures the insulation between the first control electrodes 210, the insulation between the power supply lines 2160, the insulation between the first control electrodes 210 and the power supply lines 2160 which are not connected with each other and the insulation between the first control electrodes 210 and the opposing electrodes 11.

The above-mentioned second control electrodes 220 are electrically connected to the second control electrode driver 722 via power supply lines 2260. The second control electrodes 220 which are arrayed in an adjacent manner in a longitudinal direction of the second control electrode layer, that is in a direction normal to the advancing direction of the recording medium are electrically connected to each other. Since the second control electrodes 220 are connected to each other in a longitudinal direction, only output signals for several channels are required even if all the second gate 2221 are supplied with power. Since the switching voltage for a high voltage driver IC having a number of switching channels is about 300 V at this time, the distance between the second control electrode layer 22 and the developing agent carrier 31 should be kept to about 100 μm in order to provide an enough amount of the flown developing agent. In such a condition, the strength of the electric field acting on the developing agent largely changes for the changes in the distance between the second control electrode layer 22 and the developing agent carrier 31, resulting in a change in the amount of flown developing agent. Therefore, it is preferable that the second control electrode driver 722 comprise FET and the like having a high switching voltage. The second control electrodes 220 are disposed on the base substrate 2251 which is an insulating substrate. This assures the insulation between the second control electrodes 220 which are arrayed in an advancing direction of the recording medium of the second control electrode layer 22, the insulation between the power supply lines 2260, the insulation between the second control electrodes 220 and the power supply lines 2260 which are not connected with each other and the insulation between the second control electrodes 220 and the opposing electrode 11.

A pulse, that is a voltage depending upon the video signal is applied to one of the second control electrodes 220 of the flight control unit 2 by the second control electrode driver 722. In other words, when the developing agent T which is carried on the developing agent carrier 31 is caused to path through the second gate 2221, the second control electrode driver 722 applies, for example, +1000 V (hereinafter referred to as "second ON potential") to the second control electrode 222. When the developing agent T is not caused to path through the gate, it applies 0 V (hereinafter referred to as "second OFF potential") to the second control electrode 220. At this time, a potential which is equal to that of the developing agent carrier 31 or a potential is applied to the first control electrodes 210 so that an electric field for preventing the movement of the developing agent which has passed through the second gate 2221 is formed between the first control electrode 210 and the developing agent carrier 31. In this case, 0 V is applied as the potential (hereinafter referred to as "first OFF potential"). If a high voltage driver IC having a number of switching channels is used for the first control electrode driver 721 for driving the first control electrode 210, it is preferable to provide a preset potential when the driver IC is in the OFF state in view of preventing the breakdown of the IC. In such a manner, the developing agent which has passed through the second gate 2221 when the OFF potential is applied to the first control electrode 210 decreases its speed to zero in the vicinity of the first control electrodes 210 and is unable to pass through the first gate 2121 of the first control electrode layer 21 so that it levitates between the first and the second control electrode layers 21 and 22 to form a cloud condition.

When the developing agent is caused to pass through the first gate 2121, a pulse of +300 V (hereinafter referred to as "first ON potential") is applied to the first control electrodes 210. At this time, the second OFF potential, 0 V in this case is applied to the second control electrode 220. In this condition, such an electric field for causing the developing agent in the form of cloud to fly to the opposing electrodes is formed between the first and second control electrode layers 21 and 22 so that the developing agent passes through the first gate 2121. When, for example, +1000 V potential is applied to the opposing electrode at this time, an electric field for causing the developing agent to fly toward the opposing electrode is also formed between the first control electrode 210 and the opposing electrode so that a pixel is formed on the recording medium which is disposed on the opposing electrode. After the application of the first ON potential, an electric field for causing the developing agent to move toward the developing agent carrier is formed between the first control electrode 210 and the developing agent carrier 31. In this case, for example, +1000 V and +500 V are applied to the developing agent carrier 31 and the second control electrode 220, respectively. This operation forms such an electric field causing the developing agent to move toward the developing agent carrier so that unused developing agent can be returned to the developing agent carrier again. Such an series of operation is repeated to achieve an image forming operation.

If the potentials applied to the first control electrodes 210, second control electrodes 220, developing agent carrier 31 and the opposing electrodes 11 are controlled in response to video signals and the recording medium P is placed on the side of the opposing electrode 11 which faces the developing agent carrier 31, developing agent images depending upon the video signals are formed on the surface of the recording medium P. Each power source and each driver is controlled by the control electrode controlling signals which a fed from an image forming control unit (not shown) of the controller station 7. The above-mentioned image forming device may be used units in the printer for the computer and word processor output as well as printing units for digital copiers. Embodiments in which the present invention is embodied for the printer will now be described.

(Embodiment 1)

When video signals are fed to the controller station 7 from a host computer (not shown), the controller station 7 separates the video signals into control signals such as a print initiation signal and a recording medium size detection signal, and video data. The pickup roller 42 is then rotated in response to the print initiation signal to feed the recording medium P which is accommodated in the paper sheet cassette 41 until it will abut to the register rollers 43. At this time, the operation of the pickup roller 42 is started after it has been confirmed that there is one recording medium P by the recording medium detection sensor (not shown) for determining whether or not there is the recording medium P in the paper sheet cassette 41. Then the register rollers 43 begin to rotate at an equal speed so that the recording medium P is conveyed to the opposing electrodes 11 at a constant speed while it is urged upon the paper sheet guide plate 44 by the paper pressing plate 45.

In such a manner, processing of the video image is started in the image forming control unit of the controller station 7 in synchronization with the start of the rotation of the register rollers 43. Since the recording medium P is conveyed from the condition in which it abuts to the register rollers 43, the image forming position from the loading edge of the recording medium P is calculated in the image forming control unit so that printing can be conducted on the recording medium in a given position.

In the developing agent supply station 3, the developing agent T which is triboelectrically charged to a given polarity (negative polarity in the present embodiment) by the abrasive scraping with the supply roller 33 and with the developing agent layer restriction means is conveyed to a position facing to the second gate 2221 of the flight control unit 2 by the rotation of the developing agent carrier 31.

Now, operation of the flight control unit will be described with reference to FIGS. 10 to 15.

Figure 10:
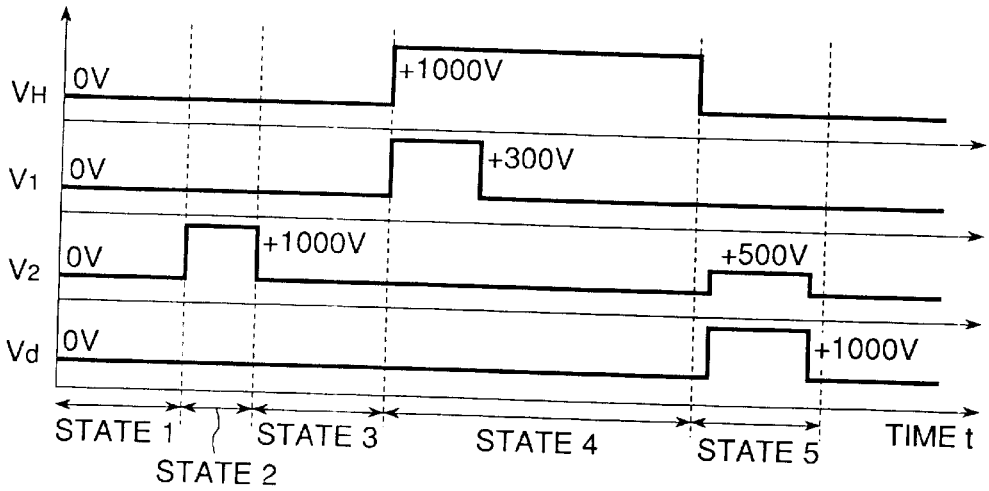
FIG. 10 is a view for explaining one embodiment of the flight control unit of the image forming device using the present invention and its operation.

Image forming is conducted in this embodiment in accordance with a voltage application timing as shown in FIG. 10.

While the developing agent carrier 31 is rotated in the condition as shown in FIG. 10, a given voltage, 0 V in the present embodiment is applied to the developing agent carrier 31 by the power source 77 for the developing agent carrier.

Figure 11:
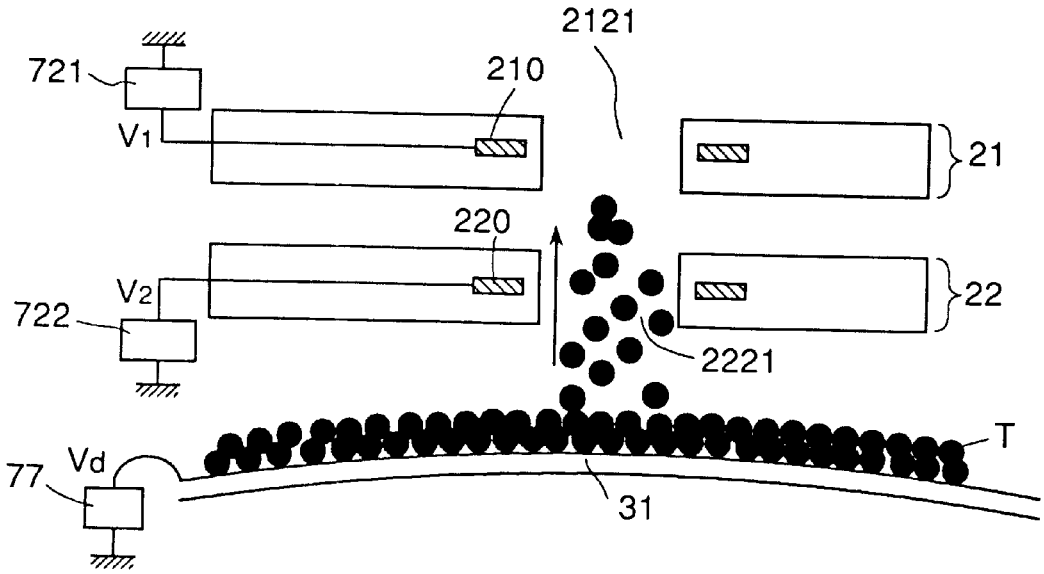
FIG. 11 is a view for explaining one embodiment of the flight control unit of the image forming device using the present invention and its operation.

Then, in the state 2 as shown in FIG. 11, a pulse that is a voltage depending upon the video signal is applied to the second control electrodes 220 by the second control electrode driver 722. In other words, when the developing agent T which is carried by the developing agent carrier 31 is caused to pass through the second gate 2221, the second control electrode driver 722 applies, for example, +1000 V as the second ON potential to the second control electrode 220. At this time, such an electric field for causing the developing agent to move toward the second control electrode 220 is formed between the second control electrode 220 and the developing agent carrier. When the developing agent T is not caused to pass through the second gate 2221, for example, 0 V is applied as the second OFF potential. At this time, the strength of the electric field between the second control electrode 220 and the developing agent carrier is substantially zero so that no developing agent flies. When the second ON potential is applied, the developing agent T is flown toward the second control electrode 220 including the apertures of the second gate 2221.

Figure 12:
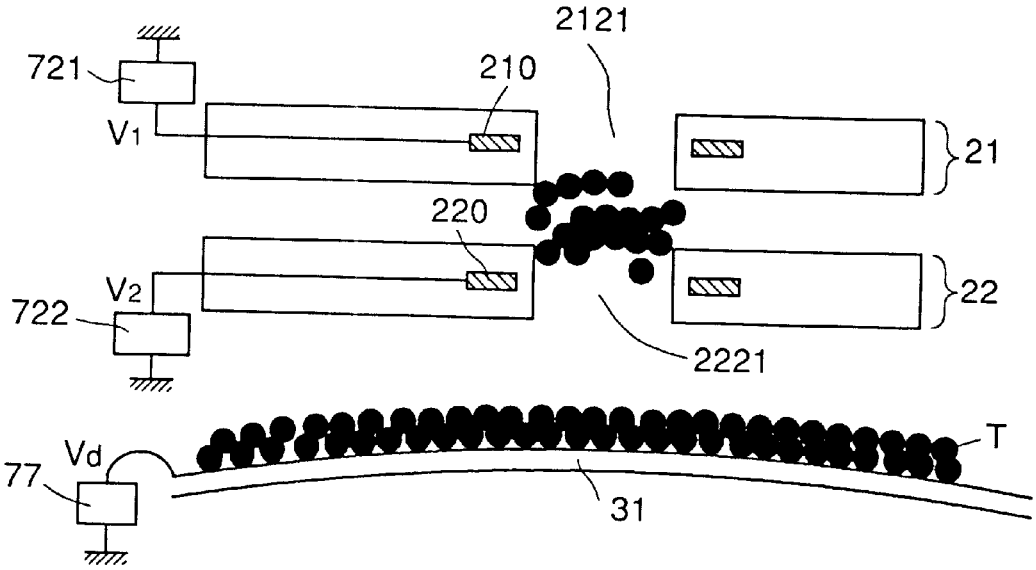
FIG. 12 is a view for explaining one embodiment of the flight control unit of the image forming device using the present invention and its operation.

Now, state 3 as shown in FIG. 12 will be described. A potential which is equal to that of the developing agent carrier 31 or a potential is applied to the first control electrodes 210 so that an electric field for preventing the movement of the developing agent which has passed through the second gate 2221 is formed between the first control electrode 210 and the developing agent carrier 31. In this case, 0 V is applied as the potential (hereinafter referred to as "first OFF potential"). If a high voltage driver IC having a number of switching channels is used for the first control electrode driver 721 for driving the first control electrode 210, it is preferable to provide a preset potential when the driver IC is in the OFF state in view of preventing the breakdown of the IC. In such a manner, the developing agent which has passed through the second gate 2221 when the OFF potential is applied to the first control electrode 210 decreases its speed to zero in the vicinity of the first control electrode 210 and is unable to pass through the first gate 2121 of the first control electrode layer 21 so that it levitates between the first and the second control electrode layers 21 and 22 to form a cloud condition.

Figure 13:
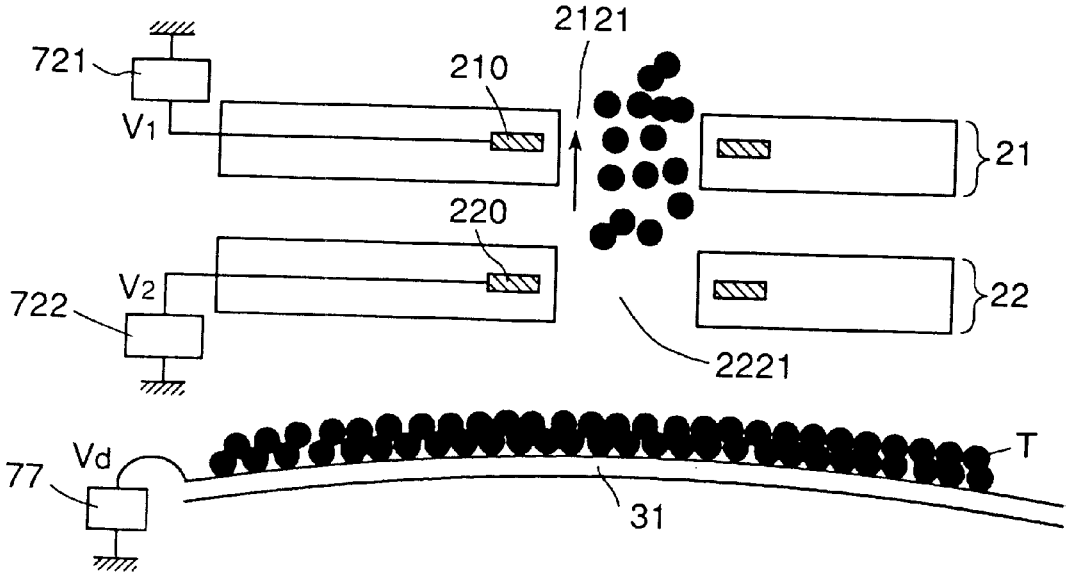
FIG. 13 is a view for explaining one embodiment of the flight control unit of the image forming device using the present invention and its operation.

State 4 as shown in FIG. 13 will now be described. When the developing agent is caused to pass through the first gate 2121, a pulse of +300 V (hereinafter referred to as "first ON potential") is applied to one of the first control electrode 210. At this time, the second OFF potential, 0 V in this case is applied to the second control electrode 220. In this state, such an electric field for causing the developing agent in the form of cloud to fly toward the opposing electrode is formed between the first and second control electrode layers 21 and 22. When, for example, positive 1000 V potential is applied to the opposing electrode at this time, an electric field for causing the developing agent to fly toward the opposing electrode is also formed between the first control electrode 210 and the opposing electrode so that a pixel is formed on the recording medium which is disposed on the opposing electrode.

Figure 14:
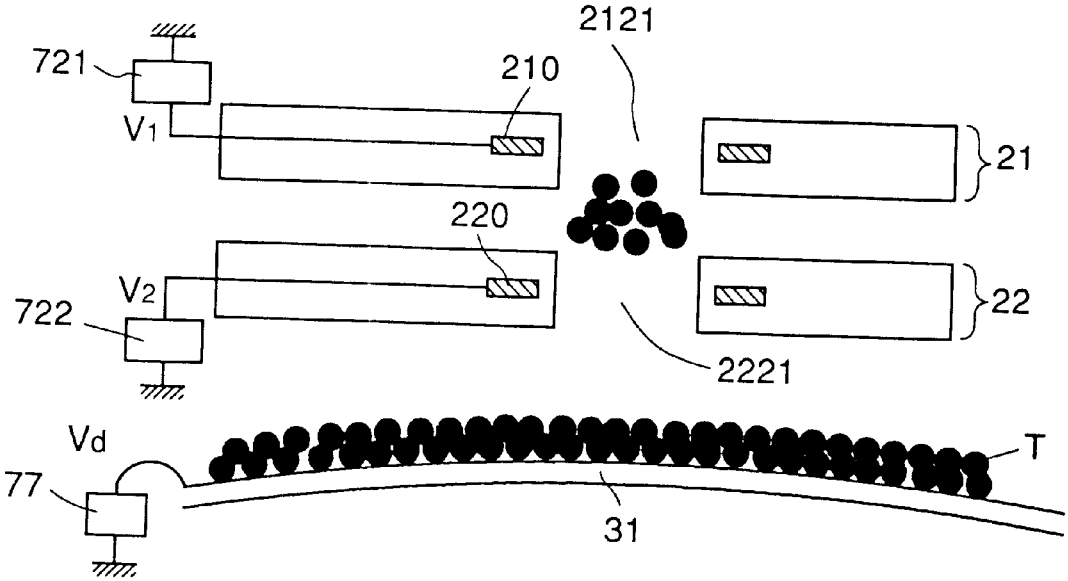
FIG. 14 is a view for explaining one embodiment of the flight control unit of the image forming device using the present invention and its operation.
Figure 15:
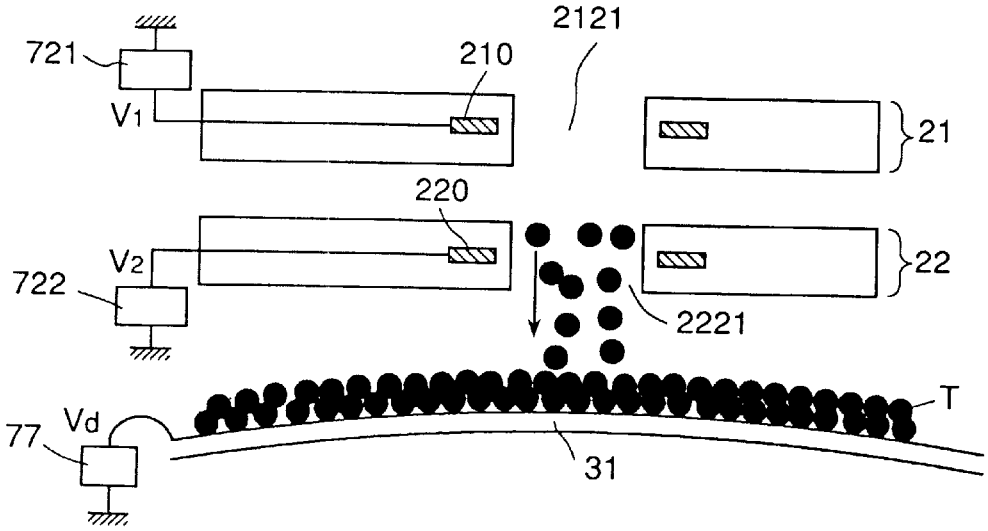
FIG. 15 is a view for explaining one embodiment of the flight control unit of the image forming device using the present invention and its operation.

Now, state 5 as shown in FIGS. 13 and 14 will be described. After the application of the first ON potential as shown in FIG. 13, the developing agent will not pass through the first the first gate 2121 so that it may remain between the first and second control electrode layers. Similar state occurs even at the area at which the first ON potential is not applied to the first control electrode. In order to remove the unused developing agent from the space between the first and second control electrode layers and to move it to the developing agent carrier or a developing agent recovering mechanism (not shown), an electric field for causing the developing agent to move toward the developing agent carrier is formed, for example, between the first control electrode 210 and the developing agent carrier 31 is formed in the present embodiment. In this case, +500 V and +1000 V is applied to the second control electrodes and the developing agent carrier, respectively. This operation forms such an electric field for causing the developing agent to move toward the developing agent carrier so that unused developing agent can be returned to the developing agent carrier again. Such an series of operation is repeated to achieve an image forming operation.

Since the developing agent is in the form of cloud when the developing agent is flown upon to the recording medium from the first control electrode layer 21 and the effect of the force in a direction to prevent the flight is very small in the present embodiment, the strength of the electric field which is required to cause the developing agent to fly becomes lower and the drive voltage of the first control electrodes 210 for controlling the flight/non flight of the developing agent can be made lower. The cloud of the developing agent which is formed between the first and second control electrode layers 21 and 22 is formed by being passed through the second control electrode layer 22. The amount and the density of the cloud of supplied developing agent and the timing of its supply can be desiredly controlled so that stable supply of cloud becomes possible.

(Embodiment 2)

As shown in FIGS. 16 through 21, a pair of oscillating electric field forming electrodes 230 for forming an oscillating electric field in a direction normal to the direction of the flight of the developing agent is provided between the first and second electrode layers 21 and 22 as the flight control unit 2. The oscillating electric field forming electrodes 230 are elongated in a longitudinal direction of the first and second control electrode layers 21 and 22. The height of the oscillating electric field electrodes (the length in a direction of the flight of the developing agent) is 200 $\mu$m in the present embodiment. The distance between the pair of electrodes is 1 mm. One of the oscillating electric field forming electrodes is electrically connected to the oscillating electric field forming power source 70 and the other is at a grounding potential, that is 0 V. A sinusoidal signal having an amplitude of 2000 V and a frequency of 1 kHz is applied thereto in the present embodiment. A voltage of a direct current component may be superposed thereto by the oscillating electric field forming power source 70. The voltage of the direct current component is 0 V in the present embodiment.

Now, operation in the present embodiment will be described with reference to FIGS. 16 through 21.

Figure 16:
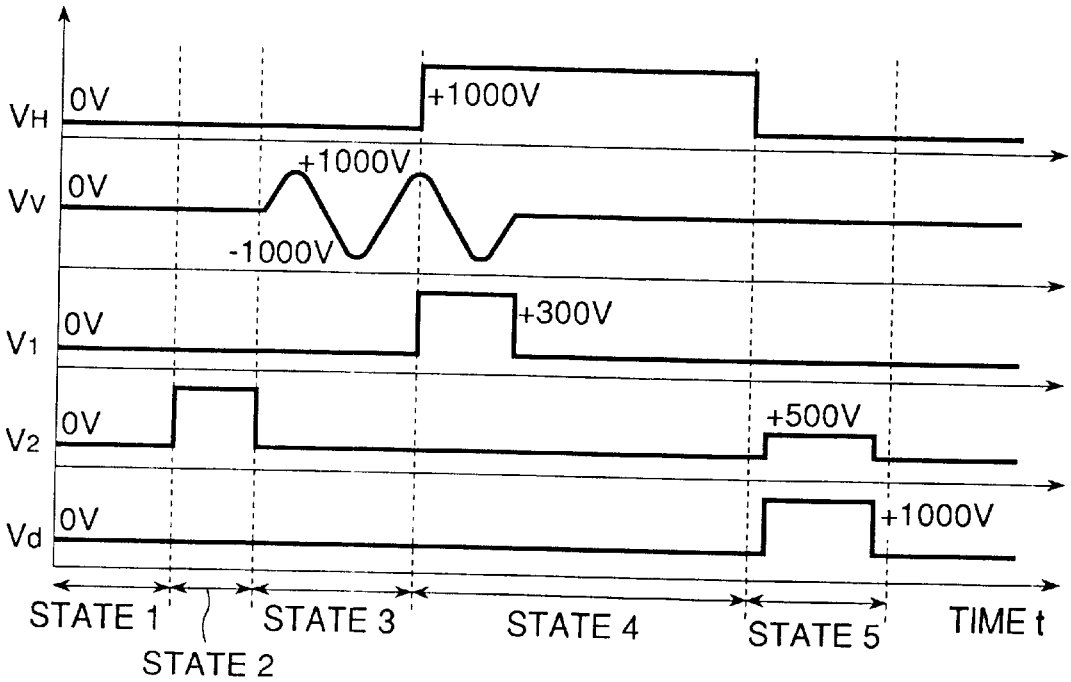
FIG. 16 is a view explaining the structure and operation of the flight control unit if the image forming device using the present invention is provided with oscillating electric field forming electrodes.

FIG. 16 shows a timing chart showing voltages applied to each electrodes in the present embodiment.

Figure 17:
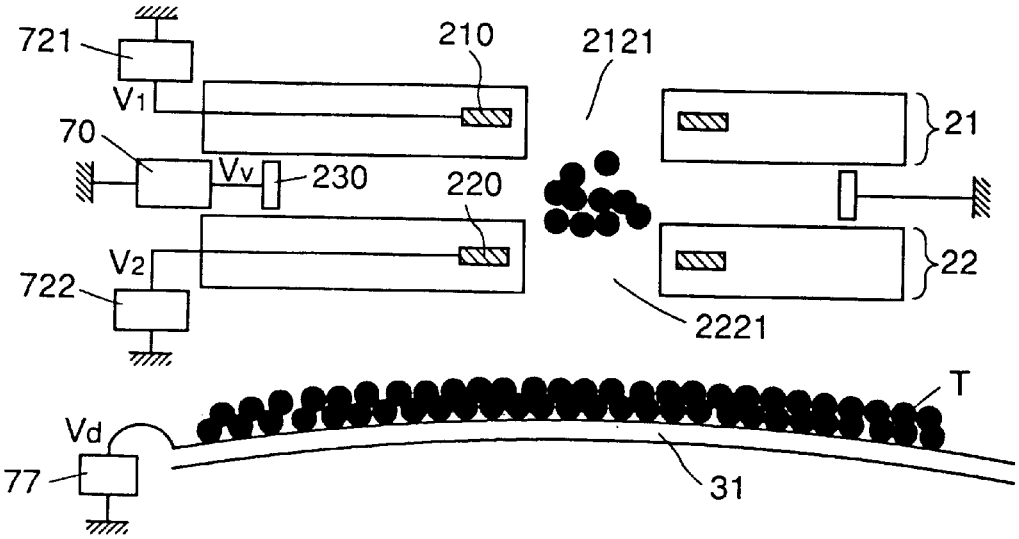
FIG. 17 is a view explaining the structure and operation of the flight control unit if the image forming device using the present invention is provided with oscillating electric field forming electrodes.

Firstly, as shown in FIG. 17, a cloud of developing agent is formed between the first and second control electrode layers 21 and 22 as is similarly to the above-mentioned embodiment 1.

Figure 18:
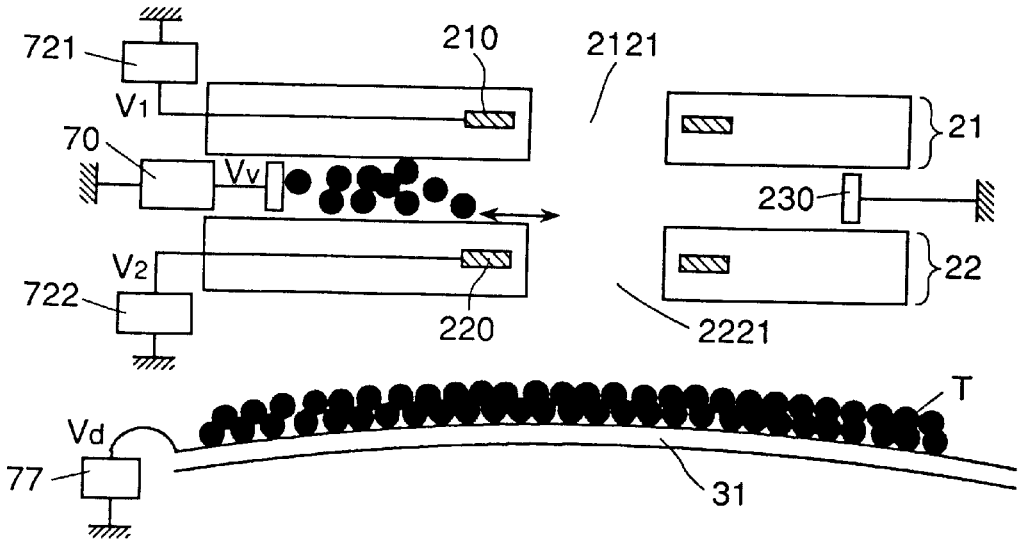
FIG. 18 is a view explaining the structure and operation of the flight control unit if the image forming device using the present invention is provided with oscillating electric field forming electrodes.

Subsequently, a voltage is applied to the oscillating electric field forming electrodes 230 so that an oscillating electric field is formed between the oscillating electric field forming electrodes. The developing agent which is in the form of cloud is subjected to the action of the oscillating electric field as shown in FIG. 18 so that the aggregate of the developing agent in the cloud is separated and the uniform dispersion of the developing agent is enhanced. Control of the developing agent can be more effectively carried out.

Figure 19:
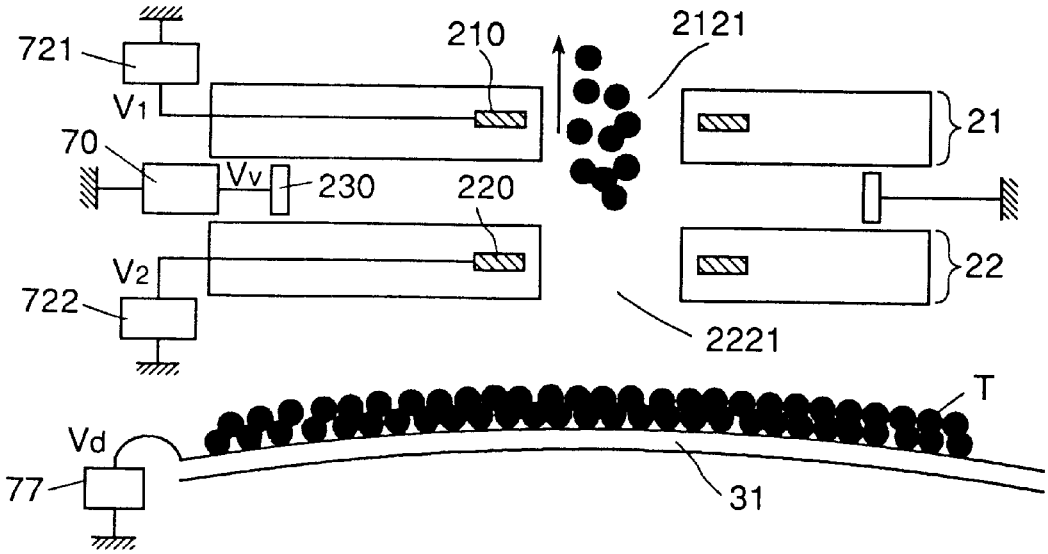
FIG. 19 is a view explaining the structure and operation of the flight control unit if the image forming device using the present invention is provided with oscillating electric field forming electrodes.

When the developing agent which is in the oscillating or reciprocal movement is in the vicinity of the first gate 2121 as shown in FIG. 19, the first ON potential is imparted to the first control electrodes 210 so that image forming is conducted on the recording medium as is similar to the foregoing embodiment 1. Although the oscillating electric field may continue to be applied, the application may be ceased in order to cause the developing agent to stay in the vicinity of the first gate 2121.

Figure 20:
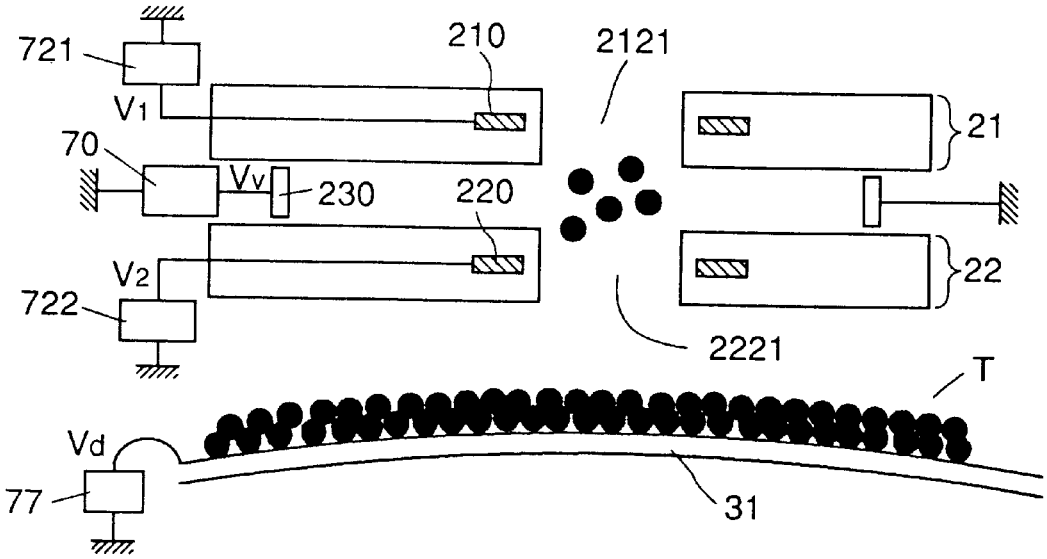
FIG. 20 is a view explaining the structure and operation of the flight control unit if the image forming device using the present invention is provided with oscillating electric field forming electrodes.
Figure 21:
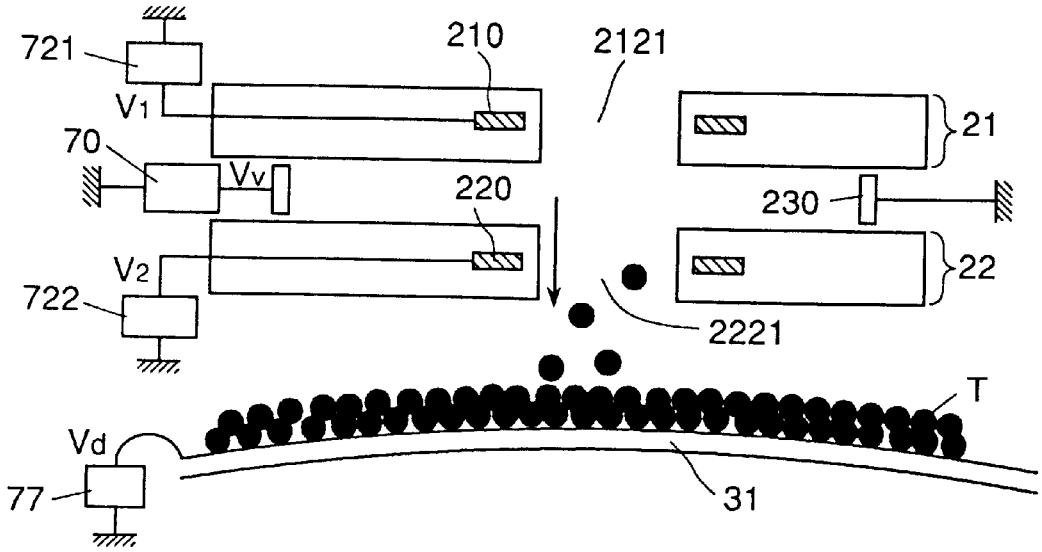
FIG. 21 is a view explaining the structure and operation of the flight control unit if the image forming device using the present invention is provided with oscillating electric field forming electrodes.

After the application of first ON potential as shown in FIG. 20, an electric field which causes the developing agent to fly toward the developing agent carrier is formed between the first control electrode 210 and the developing agent carrier 31. In this case, for example, +500 V and +1000 V is applied to the second control electrodes 220 and the developing agent carrier 31, respectively. This operation forms an electric field which moves the developing agent toward the developing agent carrier 31. The developing agent which has not been used and remains due to the fact the first ON potential is not applied to the first control electrodes 210 or the developing agent which have not passed through the first gate 2121 and remains while the first ON potential is applied to the first control electrodes 210 can be recovered to the developing agent carrier again. At this time, the above-mentioned developing agent processing is required to conduct if the application of the oscillating electric field is ceased during the application of the first ON potential whereas the above-mentioned developing agent recovery is required to conduct when the developing agent is located in the vicinity of the second gate 2221 if the oscillating electric field remains during the application of the first ON potential. A series of such operation is repeated to achieve image forming.

Since the developing agent moving direction can be changed by changing the direction of the oscillating electric field in the present embodiment, the aggregated developing agent can be effectively dispersed.

The direction of the oscillating electric field is the same as the direction of travelling of the recording medium. Since the distance between the electrodes is short in this case, the voltage to provide a necessary strength of the oscillating electric field can be suppressed to lower. However, the oscillating electric field may be formed in a direction normal to the direction of travelling of the recording medium, that is, a longitudinal direction of the control electrode layer when the voltage necessary to provide a desired strength of the oscillating electric field is practically in significant for embodying the present invention.

The voltage is preset in such a manner that the direction of the oscillating electric field is changed and its strength is equal in both positive and negative directions in the present embodiment, since such a voltage presetting is most convenient and is effective for reduction in cost.

Since the first and second gates 2121 and 2221 are provided so that they have substantially the same central axes, the location in which the developing agent conducts oscillating movement can be preset to the vicinity of the second gate 2221. If the first gate 2121 is separated from the second gate 2221, an operation to superimpose a D.C. electric field upon the oscillating electric field for moving the position of the developing agent may be conducted.

(Embodiment 3)

Flight of the developing agent is controlled by the first control electrodes 210 which is closer to the travelling recording medium when the developing agent is oscillated between the first and second electrode layers 21 and 22 by applying the oscillating voltage to the oscillating electric field forming electrodes 230 in the above-mentioned embodiment 2, the opposing electrodes may be at a potential which forms an electric field for causing the developing agent to be moved toward the opposing electrodes depending upon the spacing between the first control electrodes 210 closer to the travelling recording medium and the travelling speed of the recording medium. In this case, the developing agent may be in contact with the first control electrode layer 21 during its oscillating movement, to prevent smooth oscillating movement.

The present embodiment contemplates to enable the developing agent to conduct smooth oscillating movement in such a condition.

Figure 22:
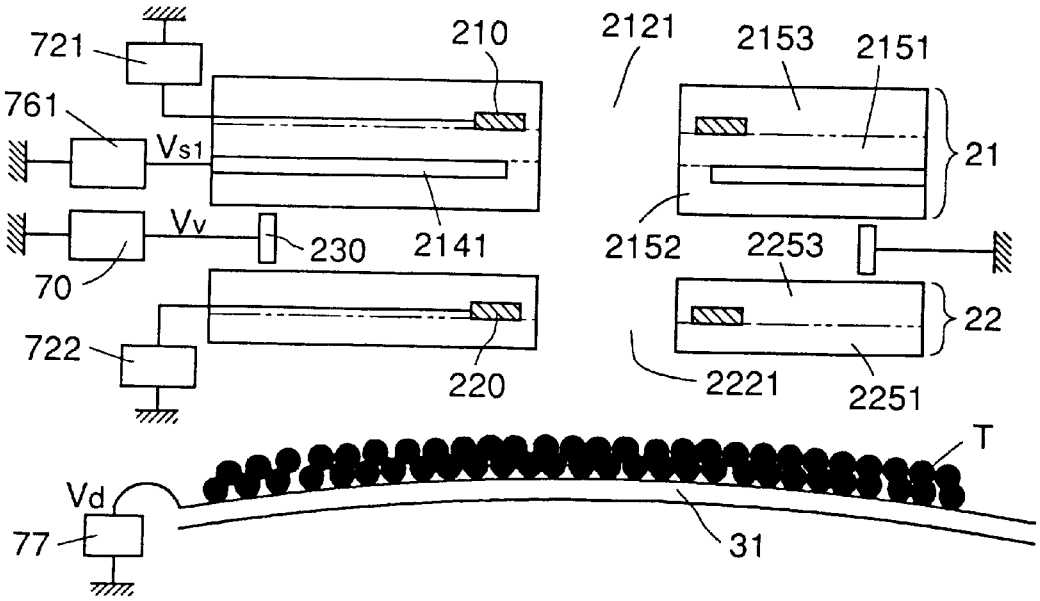
FIG. 22 is a view for explaining an example of the structure of the flight control unit if the image forming device using the present invention includes a first shield electrode.
Figure 23:
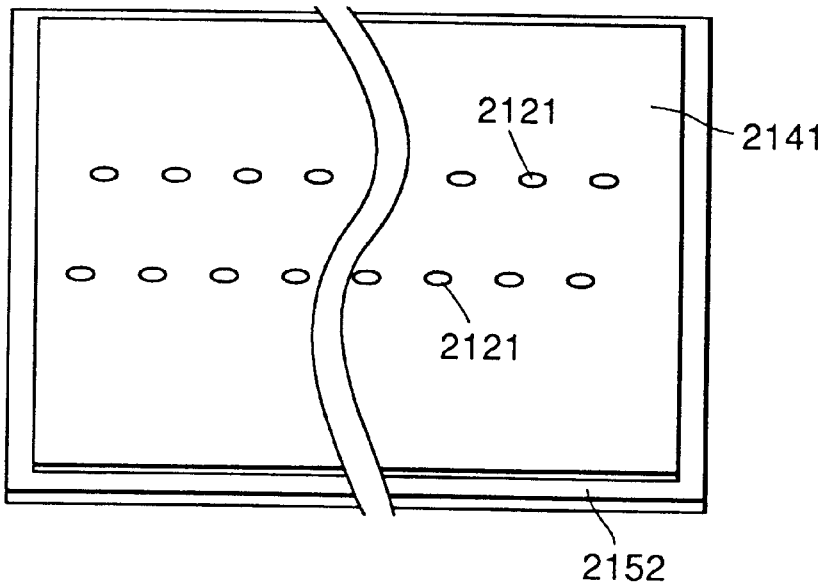
FIG. 23 is a view for explaining an example of the structure of the first or third shield electrode used for the present invention.
Figure 24:
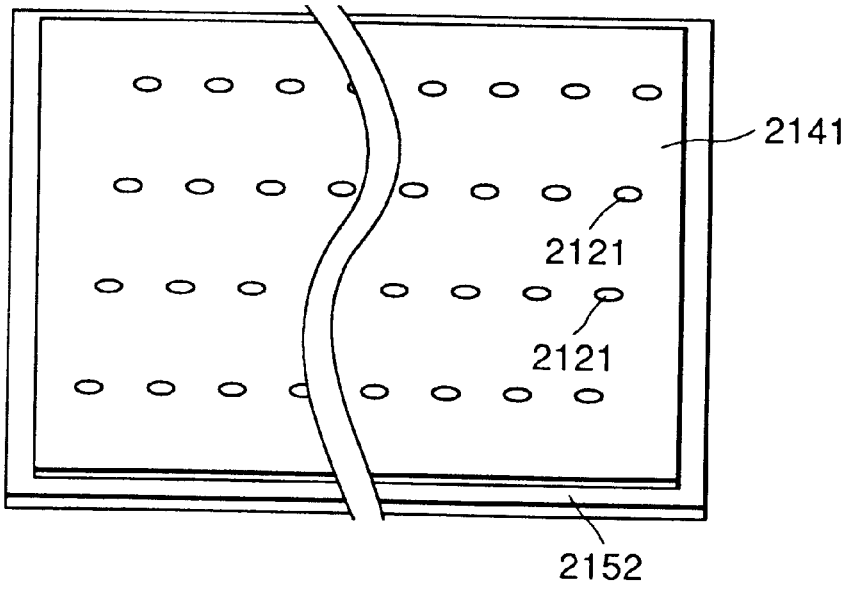
FIG. 24 is a view for explaining another example of the structure of the first or third shield electrode used for the present invention.

In the present embodiment as shown in FIG. 22, an electrode (first shield electrode) 2141 is provided on the side of the first control electrode 210 facing to the second control electrode layer 22 so that an insulating substrate layer 2151 is sandwiched therebetween and the electrode 2141 has a width in a travelling direction of the recording medium which is larger than the distance between a pair of oscillating electric field forming electrodes and it extends in a longitudinal direction of the first control electrode layer 21 and an insulating substrate layer 2152 is provided on the side of the electrode 2141 facing to the second control electrode layer 22. As shown in FIG. 23, this electrode 2141 and insulating substrate layer 2152 have apertures in position corresponding to a plurality of first gates 2121 of the first control electrode layer 21. If the first gates 2121 are disposed in four rows in a travelling direction of the recording medium, a configuration which is shown in FIG. 24 may be adopted. This electrode 2141 is referred to as "the first shield electrode 2141". The first shield electrode 2141 is electrically connected to the first shield electrode power source 761 so that it is at a desired potential.

Now, operation of the present embodiment will be described. Similarly to the above-mentioned embodiment 2, a cloud of the developing agent is formed between the first and second control electric layers 21 and 22. At this time, 0 V is applied to the first shield electrode 2141. Even if a voltage for causing the developing agent to be flown is applied to the opposing electrode 11, the influence of the opposing electrode is not given to the space between the first and second control electrode layers 21 and 22 since the influence of the opposing electrode is electrically blocked by the first shield electrode 2141.

Subsequently, a voltage is applied to the oscillating electric field forming electrodes 230 to form the oscillating electric field between the oscillating electric field forming electrodes. At this time, 0 V is applied to the first shield electrode 2141, first control electrode 210, second control electrode 220 and the developing agent carrier 31 so that the strength of the electric field in a developing agent flying direction between the first and second control electrode layers 21 and 22 is substantially zero. Accordingly, the cloud like developing agent which is subjected to the action of the oscillating electric field smoothly conducts the oscillating movement, to separate aggregate of the developing agent in the cloud and to further enhance the uniform distribution of the developing agent.

Image forming is conducted on the recording medium similarly to the foregoing embodiment 2 and then recovery of the unused developing agent is conducted. A series of operation is repeated to conduct image forming. In such a manner, whatever potential is applied to the opposing electrode, smooth movement of the developing agent is stably conducted in the oscillation electric field.

(Embodiment 4)

Figure 25:
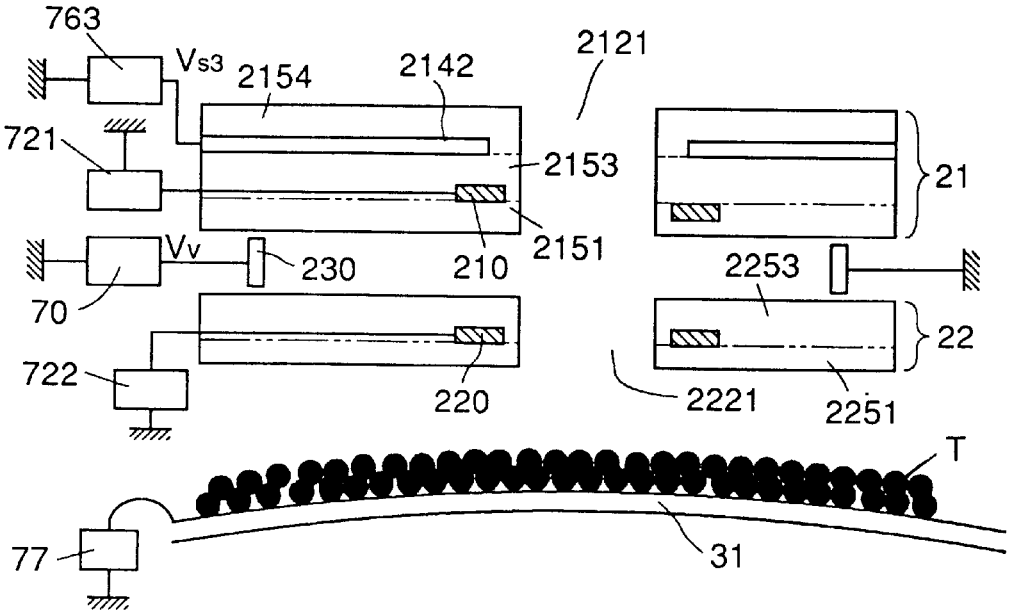
FIG. 25 is a view for explaining an example of the structure of the flight control unit if the image forming device using the present invention includes a third shield electrode.

Although the first shield electrode 2141 is provided on the side of first control electrode 210 facing to the second control electrode layer 22, it may be provided on the side of the electrode 210 facing to the opposing electrode as shown in FIG. 25. In this case, the shield electrode will be referred to as "third shield electrode 2142". Reference numerals 2154 and 763 denote the insulating substrate layer and third shield electrode power source, respectively. Also in this case, operation is similar to that of embodiment 3. Whatever potential is applied to the opposing electrode, smooth movement of the developing agent is stably conducted in the oscillating electric field.

Since cleaning of the developing agent which is adhered on the side of the first control electrode layer 21 facing to the opposing electrode can be conducted by the construction of the present embodiment, the present embodiment is of great value. In other words, the developing agent may be adhered on the first control electrode layer 21 for the reasons such as falling down from the recording medium. In this case, cleaning of the first control electrode layer 21 is conducted by applying an oscillating voltage or a D.C. voltage from the third shield electrode power source 763 which is electrically connected to the third shield electrode 2142 for forming between the opposing electrodes and the control electrode layer an electric field which causes the adhered developing agent to be moved toward the opposing electrode.

It is apparent that no problem will occur even if the first shied electrode 2141 is also provided in the present embodiment.

(Embodiment 5)

Flight of the unused developing agent is controlled by the first control electrodes 210 which is closer to the travelling recording medium when the developing agent is reciprocated between the first and second electrode layers 21 and 22 by applying the oscillating voltage to the oscillating electric field forming electrode 230 in the above-mentioned embodiment, the opposing electrodes may be at a potential which forms an electric field for causing the developing agent to be moved toward the opposing electrodes depending upon the spacing between the first control electrodes 210 closer to the travelling recording medium and the travelling speed of the recording medium. In this case, the developing agent may be in contact with the second control electrode layer 22 during its oscillating movement, to prevent smooth oscillating movement.

The present embodiment contemplates to enable the developing agent to conduct smooth oscillating movement in such a condition.

Figure 26:
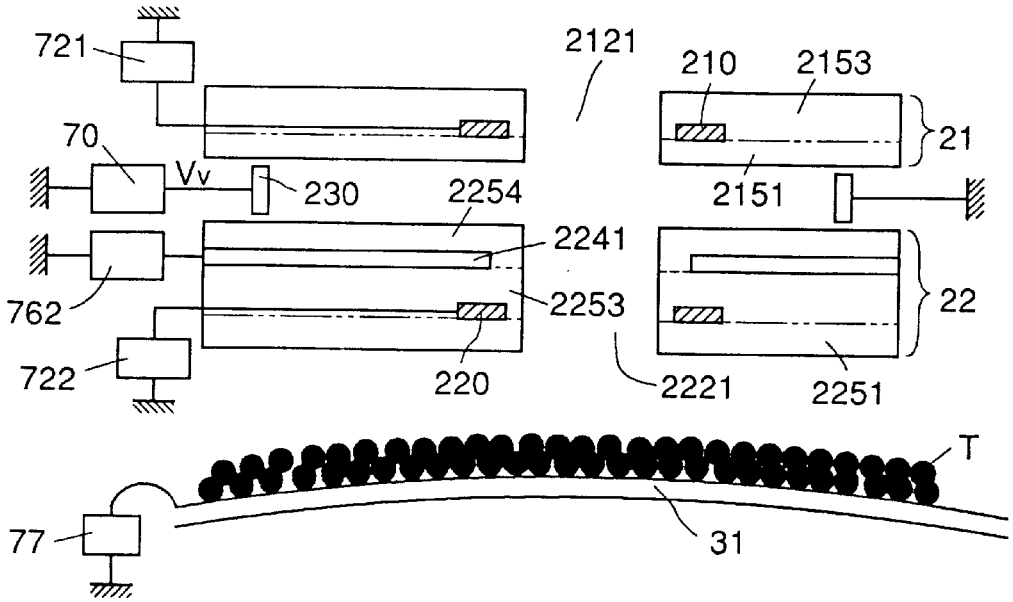
FIG. 26 is a view for explaining an example of the structure of the flight control unit if the image forming device using the present invention includes a second shield electrode.
Figure 27:
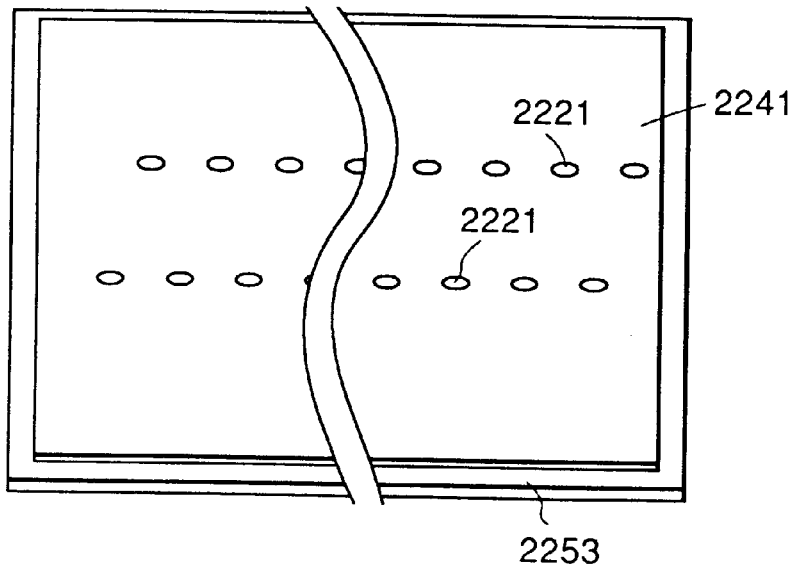
FIG. 27 is a view for explaining an example of the structure of the second or fourth shield electrode used for the present invention.
Figure 28:
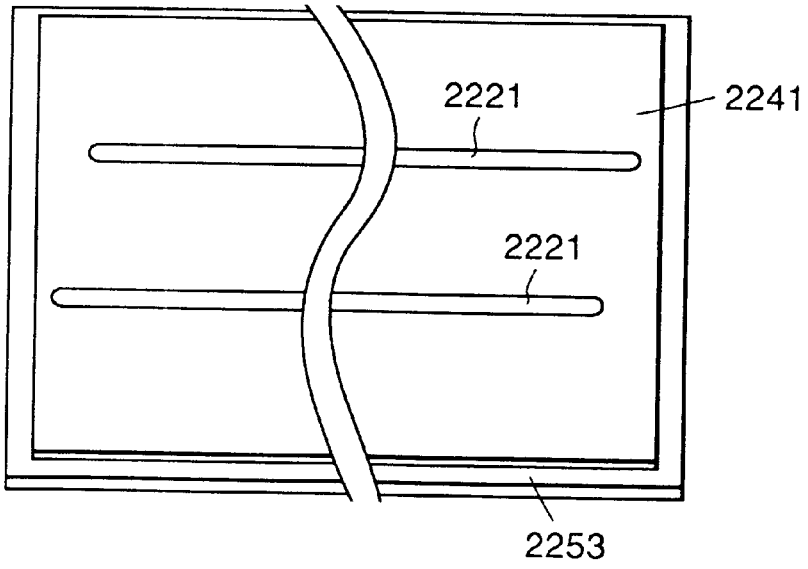
FIG. 28 is a view for explaining another example of the structure of the first or third shield electrode used for the present invention.

In the present embodiment as shown in FIG. 26, an electrode (second shield electrode) 2241 is provided on the side of the second control electrode 220 facing to the first control electrode layer 21 so that an insulating substrate layer 2253 is sandwiched therebetween and the electrode 2241 has a width in a travelling direction of the recording medium which is larger than the distance between a pair of oscillating electric field forming electrodes and it extends in a longitudinal direction of the second control electrode layer 22 and an insulating substrate layer 2254 is provided on the side of the electrode 2241 facing to the first control layer 21. As shown in FIGS. 27 and 28, this electrode 2241 and insulating substrate layer 2254 have apertures in positions corresponding to a plurality of second gates 2221 of the second control electrode layer 22. If the second control electrode 220 is in the form as shown in FIGS. 5 and 6, the shield electrode may be in the form as shown in FIG. 27. If the second control electrode 220 is in the form as shown in FIG. 7, the shield electrode may be in the form as shown in FIG. 28. This electrode 2241 is referred to as "the second shield electrode 2241". The second shield electrode 2241 is electrically connected to the second shield electrode power source 762 so that it is at a desired potential.

Now, operation of the present embodiment will be described. Similarly to the above-mentioned embodiment 1, a cloud of the developing agent is formed between the first and second control electric layers 21 and 22. At this time, 0 V is applied to the second shield electrode 2241. Even if a voltage which causes the developing agent to be recovered is applied to the developing agent carrier 31, the influence of the developing agent carrier is not given to the space between the first and second control electrode layers 21 and 22 since the influence of the developing agent carrier is electrically blocked by the second shield electrode 2241.

Subsequently, a voltage is applied to the oscillating electric field forming electrode 230 to form the oscillating electric field between the oscillating electric field forming electrodes. At this time, 0 V is applied to the second shield electrode 2241, first control electrode 210, second control electrode 220 and the opposing electrode. Recovery operation of the unused developing agent on the second control electrodes closer to the recording medium is conducted (recovering means not shown) and +1000 V is applied to the developing agent carrier 31.

However, the strength of the electric field in a direction of the flight of the developing agent between the first and second control electrode layers 21 and 22 is substantially zero. Accordingly, the cloud form developing agent which is subjected to the action of the oscillating electric field smoothly conducts the oscillating movement, to separate aggregate of the developing agent in the cloud and to further enhance the uniform distribution of the developing agent.

Similarly to the above-mentioned embodiment 2, an image forming operation is conducted on the recording medium, and then recovery of the unused developing agent is conducted. In this embodiment, formation of the electric field by the developing agent carrier 31 may be insufficient due to the shielding effect of the electric field of the second shield electrode 2241, so that recovery of the unused developing agent may not be conducted. In this case, such an electric field which will return the developing agent in a direction forward to the developing agent carrier may be increased by applying the potential of a positive several hundred voltage also to, for example, the second shield electrode 2241.

In such a manner, smooth movement of the developing agent in the oscillating electric field is stably conducted even in such a condition that any potential is applied to the developing agent carrier.

(Embodiment 6)

Figure 29:
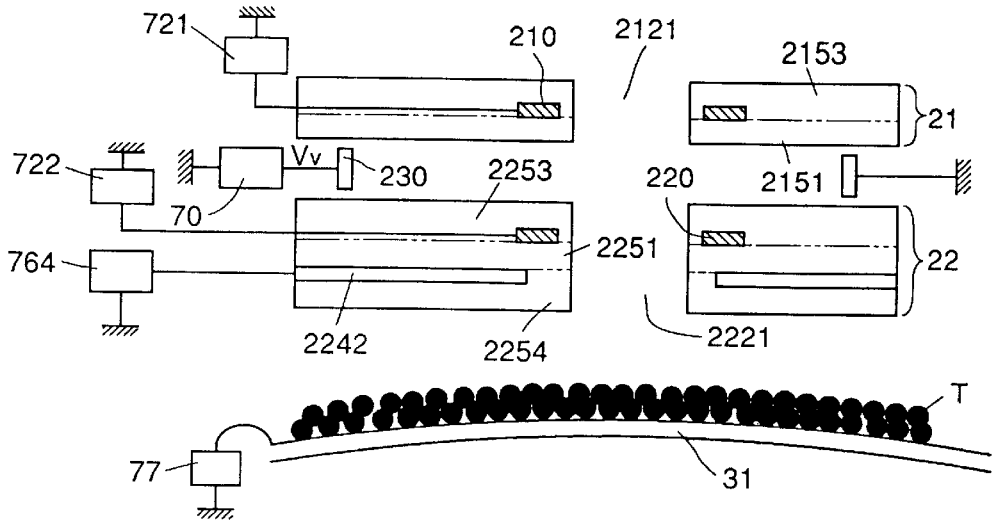
FIG. 29 is a view for explaining an example of the structure of the flight control unit if the image forming device using the present invention includes a fourth shield electrode.

Although the second shield electrode 2241 is disposed on the side of the second control electrode 220 facing to the first control electrode layer 21 in the above-mentioned embodiment 5, it may be disposed on the side facing to the developing agent carrier 31 as shown in FIG. 29. In this case, this electrode is referred to as "the fourth shield electrode 2242". Also in this case, operation and effect is identical to that of the embodiment 5. Smooth movement of the developing agent is stably conducted in the oscillating electric field even in such a condition that any potential is applied to the developing agent carrier.

Figure 30:
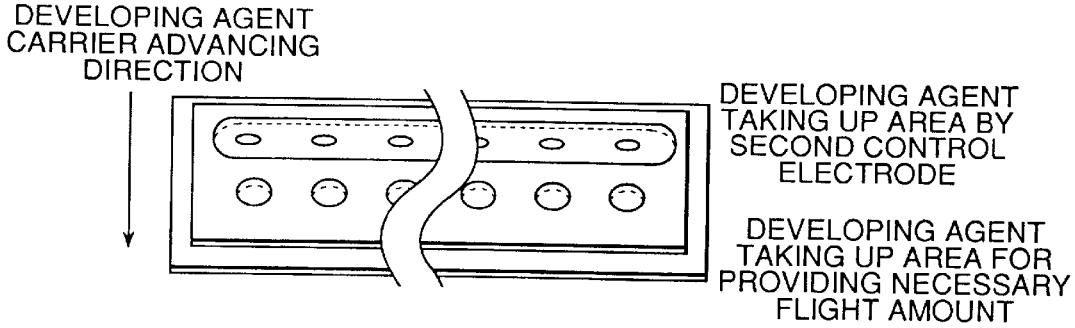
FIG. 30 is a view for explaining one example of the condition of the area in which the developing agent is taken up in the image forming device using the present invention.
Figure 31:
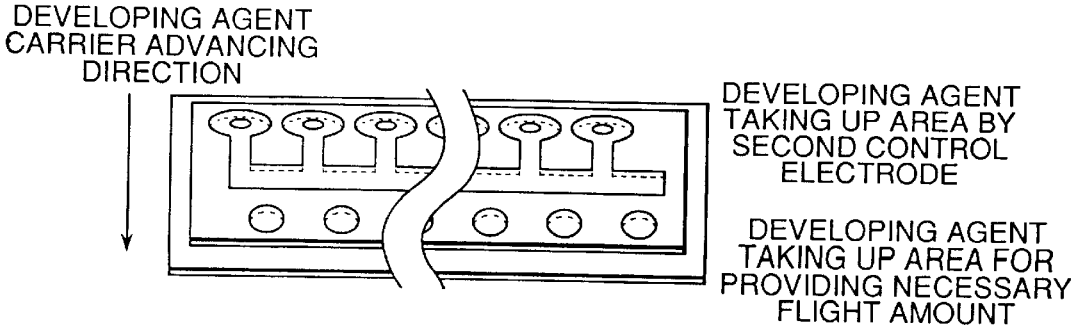
FIG. 31 is a view for explaining another example of the condition of the area in which the developing agent is taken up in the image forming device using the present invention.

Furthermore, configuration of the present embodiment enables the second control electrode 220 to control the amount of the developing agent which is taken up from the developing agent carrier. In this case, the developing agent carrier which is more than the amount of the developing agent used for the image forming may be taken up from the developing agent carrier due to the fact that the developing agent may be actually pass through the second gate 2221 depending upon the shape of the second control electrode 220 as shown in FIGS. 30 and 31. If a mass of the excessively taken up developing agent reaches at separate second control electrode 220 which is located downstream in a developing agent conveying direction, sufficient developing agent could not be taken up by this electrode. Accordingly, a pixel having an enough contrast could not be formed at the area of the control electrode in interest, resulting in defects on the image. In order to overcome this problem, the fourth shield electrode 2242 having an aperture diameter which is substantially equal to that of the second gate 2221 is disposed. This makes the range of the electric field effecting upon the developing agent carrier, which is formed by the second control electrode 220 substantially equal to that of the second gate 2221. Wasteful consumption of the developing agent is prevented and desired image forming is possible downstream in a developing agent conveying direction.

It is apparent that no problem will occur even if the second shield electrode 2241 is provided in the present embodiment.

(Embodiment 7)

Image forming can be conducted in an embodiment in which a function is performed by each of the shield electrodes which are provided in the above-mentioned embodiments 3 through 6. Even in a condition in which the same potential is applied to the first and second shield electrodes 2141 and 2241, and formation of a stable cloud of the developing agent is conducted by making substantially zero the strength of the electric field between the first and second control electrode layers 21 and 22 in a direction of the flight of the developing agent and any potential is applied to the developing agent carrier and the opposing electrode, smooth movement is stably conducted in a oscillating electric field of the developing agent.

The third shield electrode 2142 plays a roll for cleaning the first control electrode layer 21 facing to the opposing electrode and control of the amount of the taken up developing agent is enabled on the fourth shield electrode 2242. Details of their function and operation is identical to that which has been described in the foregoing embodiments 3 to 6.

(Embodiment 8)

In the above-mentioned embodiments 1 through 7, the developing agent which has passed through the second gate 2221 may often pass through the first gate 2121 when the cloud of the developing agent is formed between the first and second control electrode layers 21 and 22. If the developing agent is wanted to be flown in this gate or the developing agent is not at the flying timing at which the developing agent passes through, the developing agent which has unwantedly passed through the gates will be deposited to the recording medium in a undesired position on the opposing electrode, resulting in a defect on the image.

Figure 33:
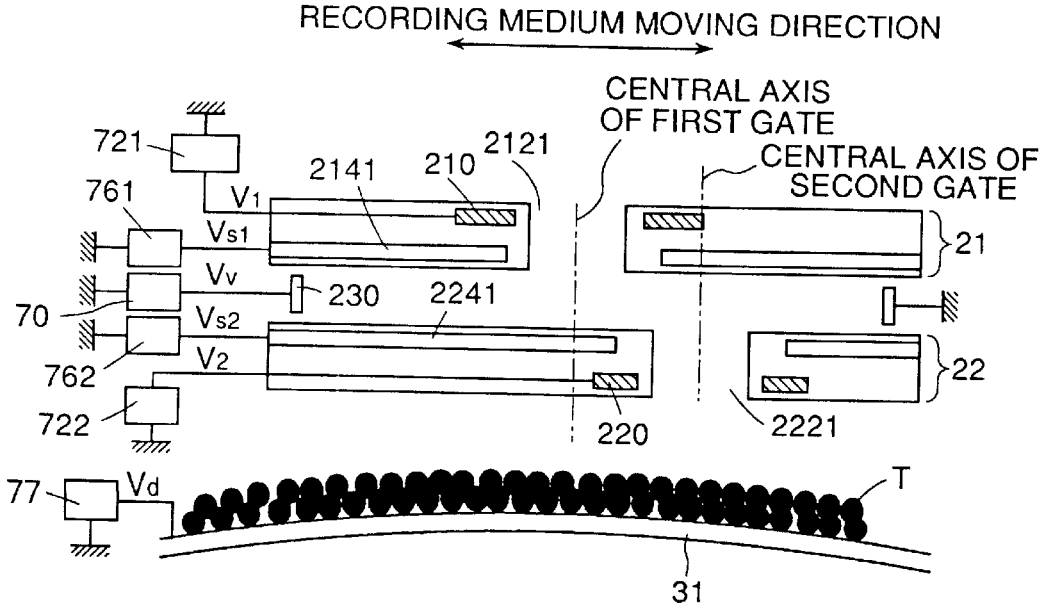
FIG. 33 is a view for explaining the structure and operation of the flight control unit in which the first gate is offset from the second gate in the image forming device using the present invention.

In order to prevent such a phenomenon from occurring, the gates are disposed in such a manner that the central axes of gates of the first and second control electrode layers 21 and 22 are not aligned with each other a shown in FIG. 33. In this case, the gates are disposed so that they are offset in a recording medium conveying direction and the distance between the central axes of the gates is 300 $\mu$m and the apertures are never aligned with each other. The oscillating electric field is formed in a recording medium conveying direction similarly to the above-mentioned embodiment.

Now, operation of the present embodiment will be described with reference to FIGS. 32 through 39 and based upon the embodiments 4 and 6 in which the first and second shield electrodes are provided.

Figure 32:
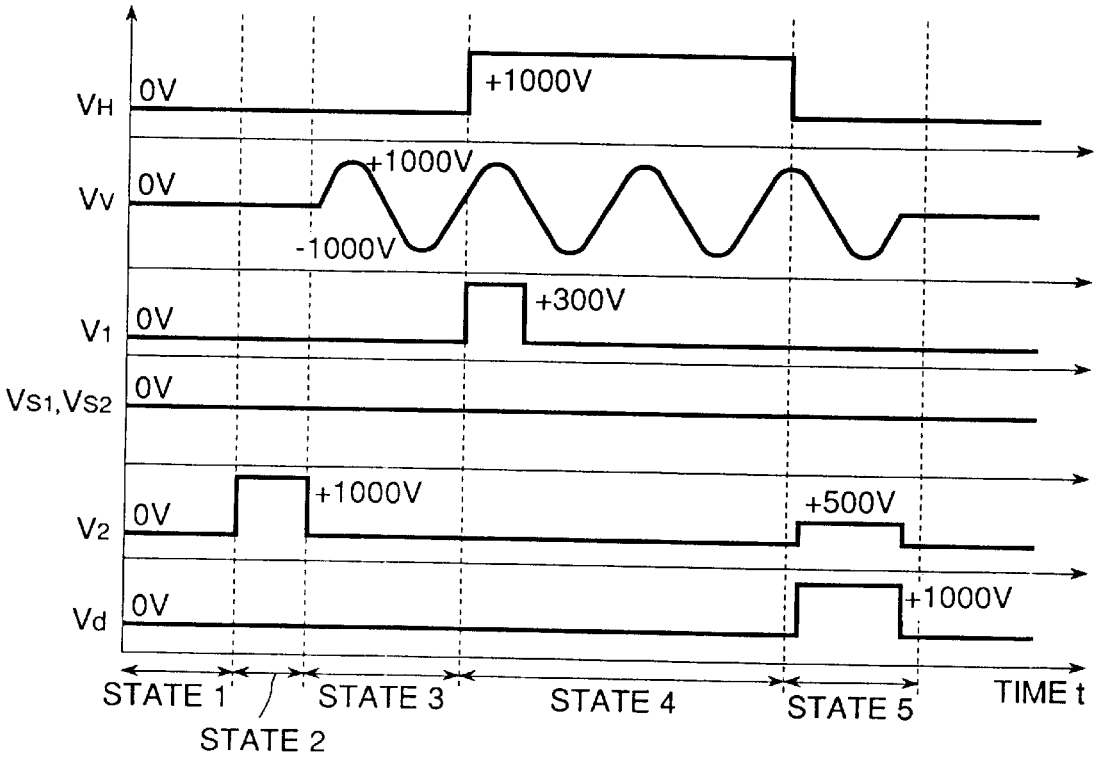
FIG. 32 is a view for explaining the structure and operation of the flight control unit in which the first gate is offset from the second gate in the image forming device using the present invention.

FIG. 32 shows an example of the timing relation between the applications of voltages applied to electrodes in the present invention. The embodiment using the timing relation will be described.

In a state 1 as shown in FIG. 33, a predetermined voltage (0 V in the present embodiment) is applied to the rotating developing agent carrier 31 by the developing agent carrier power source 77.

Then, a first ON potential depending upon an image signal is applied to the second control electrode 220 by the second control electrode driver 722. In the present invention, +1000 V is applied as the second ON potential. At this time, 0 V is applied to the first and second shield electrode 2141 and 2241, so that an electric field which is substantially 0 in a developing agent flying direction is formed in a space between the first and second control electrode layers 21 and 22.

Figure 34:
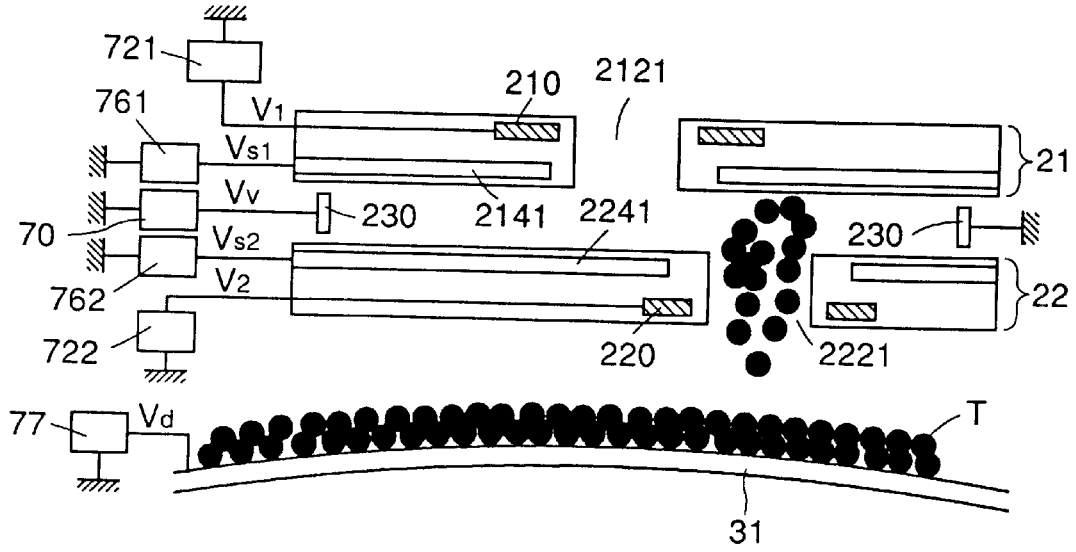
FIG. 34 is a view for explaining the structure and operation of the flight control unit in which the first gate is offset from the second gate in the image forming device using the present invention.

If the second ON potential is applied at this time as shown in FIG. 34, the developing agent T will fly toward the second control electrode 220 including apertures of the second gate 2221, the developing agent will pass through the second gate 2221. At this time, no aperture exists in the first control electrode layer 21 to which the second gate 2221 faces, but the side of the first shield electrode 2141 exists. 0 V is applied to the side of the first shield electrode 2141 as mentioned above so that the speed of the developing agent is decreased by the electric filed between the first and second shield electrode 2141 and 220 and ultimately stops before reaching at the first control electrode layer 21.

However, the above-mentioned decelerating electric field does not exist when the potential which is applied to the second control electrode 220 becomes a second OFF potential. Part of the developing agent may reach at the first control electrode layer 21. Since there is no aperture on the side of the first control electrode layer 21 at which the developing agent has reached, the movement of the developing agent is stopped there. Thereafter, the developing agent exists in the form of cloud in the space in which the strength of the electric field which is formed by the first and second shield electrodes 2141 and 2241 is substantially 0. If there is no mechanism for suppressing the movement of the developing agent which is caused by the effect of the electric field in such a manner, the above-mentioned problem is solved by adopting a structure in which the openings of the first and second gates are not completely aligned with each other.

Figure 35:
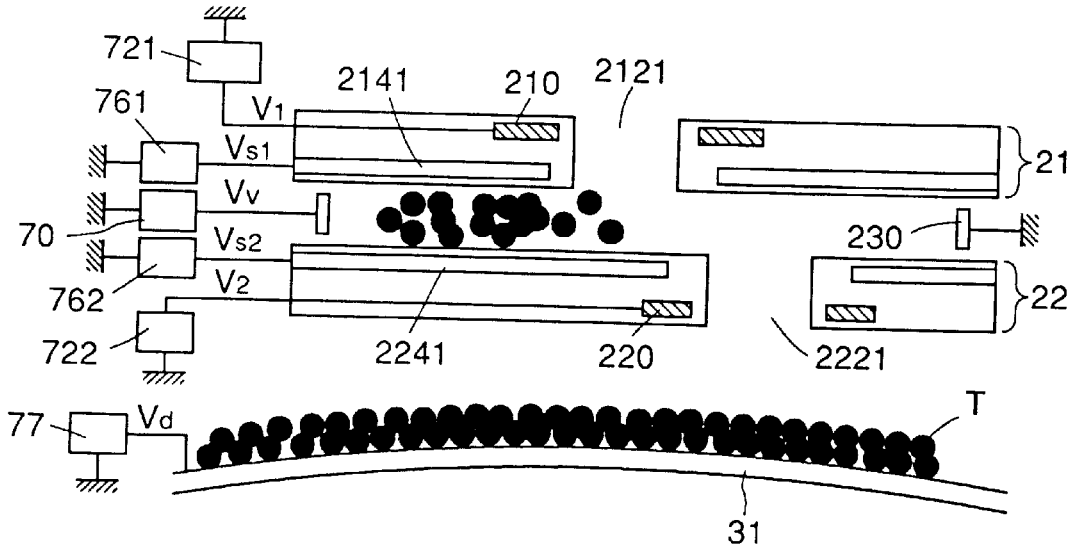
FIG. 35 is a view for explaining the structure and operation of the flight control unit in which the first gate is offset from the second gate in the image forming device using the present invention.
Figure 36:
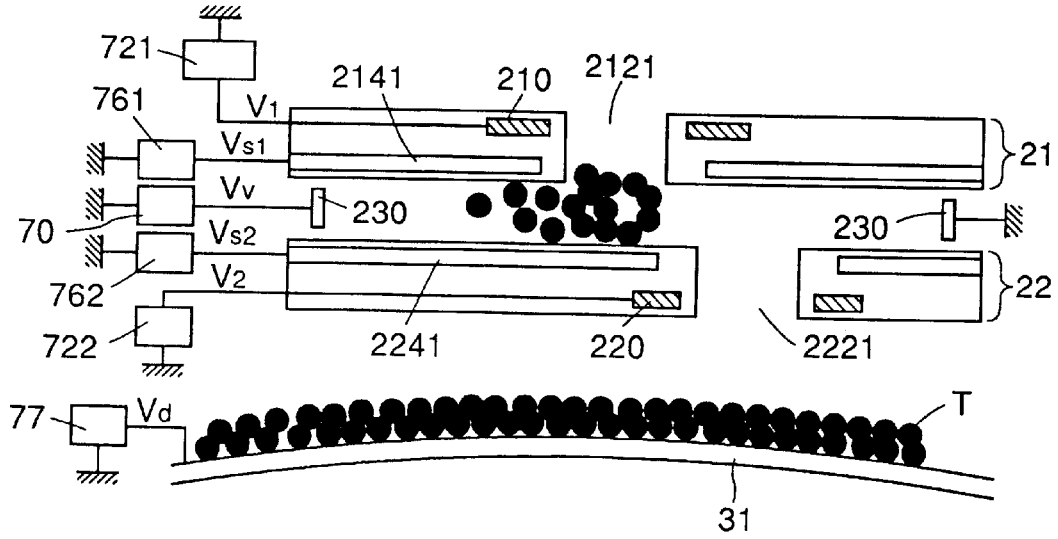
FIG. 36 is a view for explaining the structure and operation of the flight control unit in which the first gate is offset from the second gate in the image forming device using the present invention.

If a sinusoidal oscillating voltage having an amplitude of 1000 V and a frequency of 1 kHz is applied between oscillating electric field forming electrodes at this time, the developing agent performs an oscillating movement as shown in FIG. 35 or 36.

Figure 37:
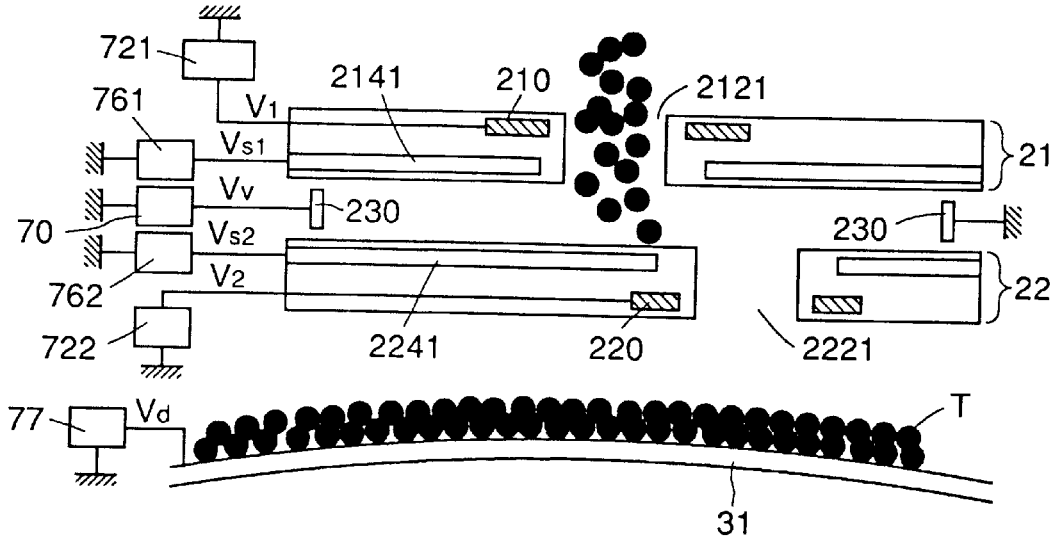
FIG. 37 is a view for explaining the structure and operation of the flight control unit in which the first gate is offset from the second gate in the image forming device using the present invention.

When the cloud of the developing agent reaches at the vicinity of the first gate 2121 as shown in FIG. 36, the developing agent is passed through the first gate 2121 as shown in FIG. 37 by applying 300 V to the first control electrode 210 as the first ON potential. Offsetting of the positions of the first and second gates with each other in an oscillating electric field forming direction obviates the necessity of providing means for moving the position of the cloud of the developing agent toward to the first gate, resulting in the simplification of the configuration.

When, for example, +1000 V potential is applied to the opposing electrode (not shown) at this time, an electric field to cause the developing agent T to fly toward the opposing electrode is also formed between the first control electrode 210 and the opposing electrode so that an pixel is formed on the recording medium on the opposing electrode.

Figure 38:
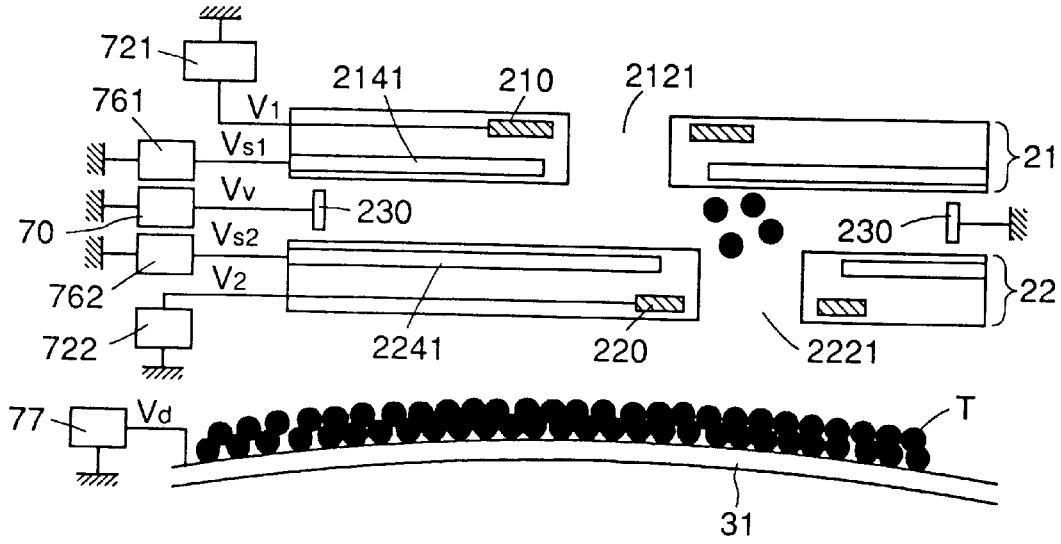
FIG. 38 is a view for explaining the structure and operation of the flight control unit in which the first gate is offset from the second gate in the image forming device using the present invention.
Figure 39:
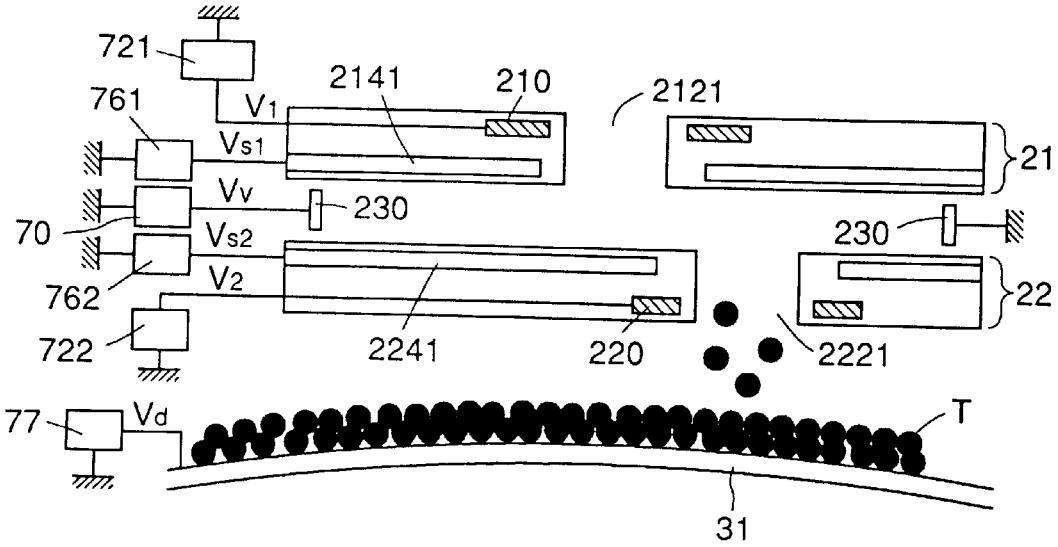
FIG. 39 is a view for explaining the structure and operation of the flight control unit in which the first gate is offset from the second gate in the image forming device using the present invention.

After application of the first ON potential, an electric field to cause the developing agent to be moved toward the developing agent carrier is formed between the first control electrode 210 and the developing agent carrier 31. When the unused developing agent in the form of cloud reaches at the vicinity of the second gate 2221 as shown in FIG. 38, +500 V and +1000 V is applied to the first control electrode 220 and the developing agent carrier 31, respectively. Such an operation forms an electric field which causes the developing agent to be moved toward the developing agent carrier, so that the unused developing agent can be recovered to the developing agent carrier 31 again. A series of such operation is repeated to conduct the image forming.

In the present embodiment, the positions of the first and second gates are offset to each other in a recording medium travelling direction in order to decrease the oscillating voltage. If the oscillating voltage is not restricted to a given value, the positions of the gates may be offset in a longitudinal direction of the control electrode layer and the direction of the oscillating electric field may be in such a direction and the present invention is not limited to the above-mentioned configuration.

If the amount of the linked developing agent is less, the openings of the gates may not be completely offset to each other like the present embodiment. In this case, the size of the control electrode may be made smaller.

(Embodiment 9)

Figure 40:
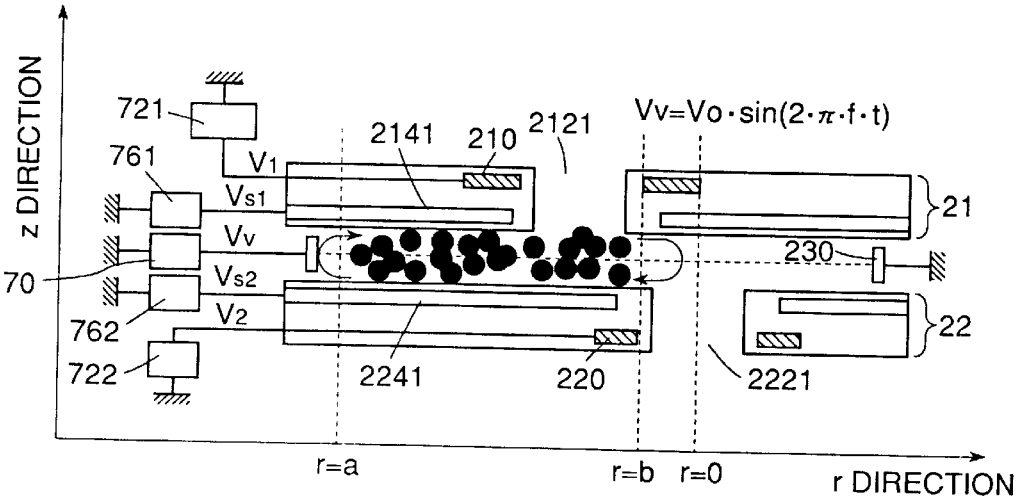
FIG. 40 is a view for explaining one example of the motion 7 condition of the developing agent in the flight control unit of the image forming device using the present invention.

In the foregoing embodiment, the time interval at which the oscillating electric field is formed on the side of the oscillating electric field forming electrode, the developing agent is oscillated and the ON potential is applied to the first control electrode 210 may include the time interval at which the speed of the oscillating developing agent is zero. The inventors of present invention have found from the investigation of the moving condition of the developing agent in the oscillating electric field using a high speed and high resolution camera that the developing agent repeats an oscillating movement between positions r=a and r=b when the developing agent is placed on a position r=0 at time t=0 when an oscillating electric field is formed in an r direction by applying a sinusoidal oscillating voltage to the power source 70 in FIG. 40. The movement of the developing agent in the oscillating electric field is conceptually shown in FIG. 40. The developing agent which reciprocates in the oscillating electric field has a speed component in a direction (r direction in FIG. 40) normal to the flight direction (z direction in FIG. 40) of the developing agent. If the speed in the r direction is so high that it cannot be neglected relative to that in a z direction, the first ON potential is applied and the developing agent will pass through the first gate 2121 to fly toward the recording medium. In this case, the developing agent may be spread in an r direction in the course of flight, so that it may often give an adverse influence upon image forming.

The above-mentioned influence can be prevented by applying the first ON potential in an interval while the moving speed of the developing agent is zero, that is the developing agent changes the direction of its oscillating movement. The speed of the developing agent in an r direction is very low just before and after the time when the developing agent changes the direction of the oscillating movement. In such a condition, the spreading of the developing agent in an r direction in the course of flight can be largely improved.

It is preferable that the positions of the first control electrode 210 and the first gate 2121 be preset at an area in which the direction of the oscillating movement of the developing agent is changed, or that the turning position of the oscillating movement be preset in the position of the first control electrode 210 or the first gate 2121 by appropriately selecting the oscillating electric field conditions. Such an embodiment enables most of the developing agent in the form of cloud when the oscillating moving speed is substantially zero to pass through the first gate 2121 so that the developing agent can be effectively used.

The voltage which is applied between the oscillating electric field forming electrodes may be adjusted in such a manner that the area at which the direction of the oscillating movement of the developing agent is changed is located in the vicinity of the first gate. Adopting such a configuration enables most of the developing agent in the form of cloud can pass through the first gate without changing the shape of the electrodes when the position in which the oscillating movement of the developing agent is substantially zero is different from the first gate under a condition in which the amount of electrostatic charges of the developing agent is changed, so that the developing agent having an oscillating movement speed of substantially zero can be effectively used.

(Embodiment 10)

Figure 41:
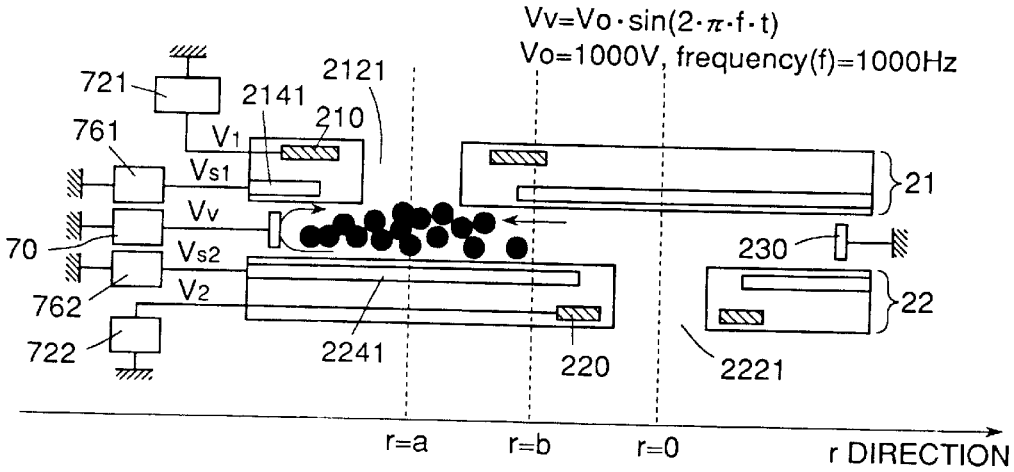
FIG. 41 is a view for explaining another example of the motion condition of the developing agent in the flight control unit of the image forming device using the present invention.
Figure 42:
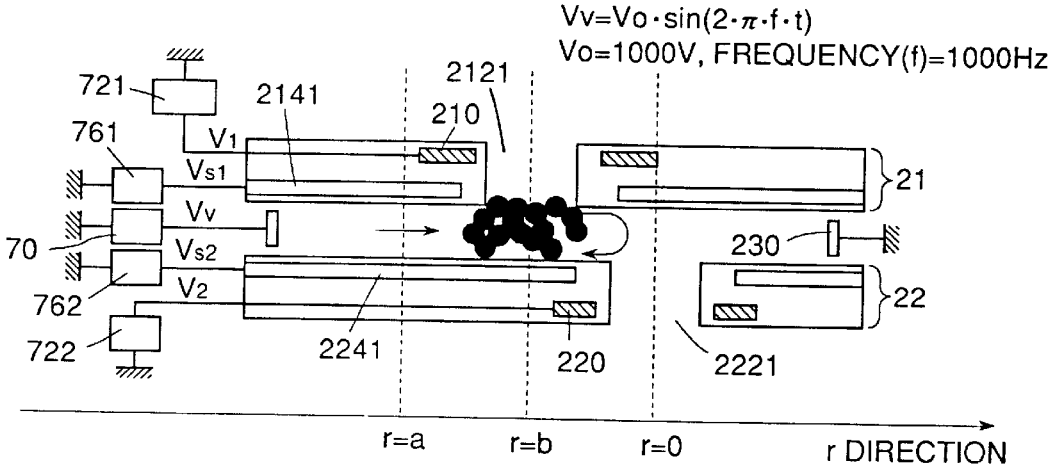
FIG. 42 is a view for explaining a further example of the motion condition of the developing agent in the flight control unit of the image forming device using the present invention.

In the above-mentioned embodiment, the first ON potential may be applied to the first control electrode 210 when the developing agent is in the vicinity of the second gate 2221 which is provided on the second control electrode layer 22. The movement of the developing agent when a sinusoidal oscillating voltage is applied to the oscillating electric field forming electrodes is shown in FIGS. 41 and 42. The inventors of present invention have studied the movement of the developing agent in an oscillating electric field in detail by using a high speed and high resolution camera. It has been found that low and high cloud density which is shown in FIGS. 41 and 42, respectively, appears when the developing agent which performs an oscillating movement in an r direction as shown in FIGS. 41 and 42 changes its oscillating movement direction, that is when the speed is zero. At this time, a sinusoidal wave ($V_0 \sin(2\pi ft)$) having a maximum amplitude $V_0$ of 1000 V and a frequency f=1000 Hz is applied as the oscillating voltage $V_v$ and the spacing between the oscillating electric field forming electrode 230 is 2 mm. The oscillating voltage is applied at time when the developing agent have completely passed through the second gate 2221 and a cloud of the developing agent has been formed between the first and second control electrode layers. It has been confirmed that the developing agent performs an oscillating movement between the position which is far from the gate by about 200 to 300 $\mu$m (r=b point in FIGS. 41 and 42) and the position which is far from the second gate by about 800 to 900 $\mu$m (r=a point in FIGS. 41 and 42). It has been observed that the above-mentioned high and low density cloud exists in the vicinity of the position which is far from the second gate 2221 by about 200 to 300 $\mu$m and about 800 to 900 $\mu$m, respectively.

Image forming is conducted on the recording medium by applying the first ON potential to the first control electrode 210 in arrangements in which the position of the first control electrode 210 is preset in a position in which the above-mentioned cloud density is low and high (FIGS. 41 and 42), respectively. The oscillating electric field condition and timing relationship in this case is identical to that of the above-mentioned condition. The distance between the centers of the second and first gates 2221 and 2121 is preset to about 850 and 250 $\mu$m in FIGS. 41 and 42, respectively. The other conditions are equivalent to those in the foregoing embodiments. As a result, although the concentration of the image is low at the low cloud density while a desired necessary concentration if obtained at a high cloud density.

This reason has been considered. It has been found that the concentration is related with the distribution of specific electrostatic charge of the developing agent (a value which is obtained by dividing the amount of the electrostatic charge of the developing agent by its mass. This ratio will be hereinafter referred to as Q/M. It has been confirmed from the measurement of the Q/M distribution of the developing agent which has been flown upon the recording medium in FIGS. 41 and 42 that the former distribution has a higher absolute value of central value in comparison with that of the latter and that the latter Q/M distribution resembles very much to the Q/M distribution of the developing agent on the developing agent carrier.

The Q/M distribution of the developing agent which is used in the present embodiment on the developing agent carrier is such that the developing agent of about −5 to $-10\times10^{-3}$ (C/kg) is contained at about 80% and the average particle diameter of the developing agent is about 10 $\mu$m. The Q/M distribution of the developing agent which is flown in a low cloud density area is such that the average particle diameter is substantially same as the above-mentioned value while the developing agent of about −8 to $-12\times10^{-3}$ (C/kg) is contained at about 80%.

Accordingly, it has been verified how such charged particles behave in the oscillating electric field in case in which the Q/M of the developing agent is $-10^{-2}$ (C/kg) and $-5\times10^{-3}$ (C/kg), respectively, by establishing the equation of the motion of respective particles with a model which is shown in FIG. 43. The viscous resistance is set to $1.82\times10^{-5}$ ($N\cdot s/m^2$) by considering the influence of air resistance.

A result of calculation of the changes in oscillating voltage, speed of the developing agent particles (toners) and the amount of displacement with lapse of time is shown in FIG. 44. A solid line in FIG. 44 denotes the movement of the developing agent particles having a high specific charge of $Q/M=-10^{-2}$ (C/kg) and a dotted line shows the movement of the developing agent particles having a low specific charge of $Q/M=-5\times10^{-3}$ (C/kg).

The speed of the developing agent particles become zero twice in one period of the oscillating voltage. One time is represented by A and the other is represented by B. It has been confirmed that the amplitude of the oscillating movement differs depending upon the difference in specific charge. At time B when the speed is zero, the positions of the particles are largely different depending upon the specific charge while at time A, the difference in position due to the difference of the specific charge is low. That is, it is considered that at time A, the developing agent is concentrated at a narrow area to form a high density cloud while at time B, the developing agent is spread in a wide range area to form a low density cloud.

In the above-mentioned embodiment, a developing agent forms a high density cloud in a position which is far from the second gate (position r=0) by 160 to 310 $\mu$m. When the particles having a high specific charge (herein $-10^{-2}$ C/kg) perform the reciprocal movement, they are in the position which is far from the second gate by 780 $\mu$m. This position is substantially coincident to the area in which the developing agent conducts the reciprocal operation when the above-mentioned cloud condition is observed. The oscillating position on the side far from the second gate is slightly different from the observing position. It is considered that this phenomenon is caused by particles having higher specific charge which are contained in the actual developing agent.

For the above-mentioned reason, the present embodiment can stably provide the necessary amount of the developing agent by passing the developing agent through the first gate when the cloud density of the developing agent is high irrespective of the variations in the specific charge of the developing agent.

If a sinusoidal oscillating electric field which can be conveniently used has an equal negative and positive amplitude, the cloud density becomes high in position r=0, that is, when the developing agent approaches to the second gate. Accordingly, it has been found that it is preferable to control the developing agent to pass through the first gate when the speed of the developing agent is zero and it approaches to the second gate.

It has been found from the above-mentioned observation, experiment and analysis by the calculation that a sufficient amount of flying developing agent can be obtained since the density of the cloud is high by applying the first ON potential to the first control electrode 210 when the developing agent is close to the second gate 2221 which is provided on the second control electrode layer 22.

(Embodiment 11)

In the present invention, the time interval when the cloud of developing agent is formed between the first and second control electrode layers 21 and 22 by applying the second ON potential to the second control electrode 220 as is done in the foregoing embodiments 9 and 10 does not include the time interval when the absolute value of the strength of oscillating electric field becomes maximum.

The inventors of present invention have studied the movement of the developing agent in the oscillating electric field by using high speed and high resolution camera and have found that the condition of cloud of the developing agent changes when the speed of the developing agent which performs the oscillating movement due to the phase of the oscillating electric field after the developing agent has passed through the second gate to enter into the oscillating electric field. That is, when the phase of the oscillating electric field is out of phase by about ¼ or ¾ period if a cloud of the developing agent is formed in the oscillating electric field by applying a sinusoidal oscillating voltage, that is when the absolute value of the oscillating voltage becomes maximum if the developing agent which has passed through the second gate 2221 exists between the first and second control electrode layers 21 and 22, the developing agent initiates its oscillating movement on subject to the action of the oscillating electric field. It has been confirmed that there is a phenomenon in which the cloud density becomes lower at the opposite extremities of the oscillating movement range, that is when the moving speed of the developing agent is zero as shown in FIG. 45.

Figure 46:
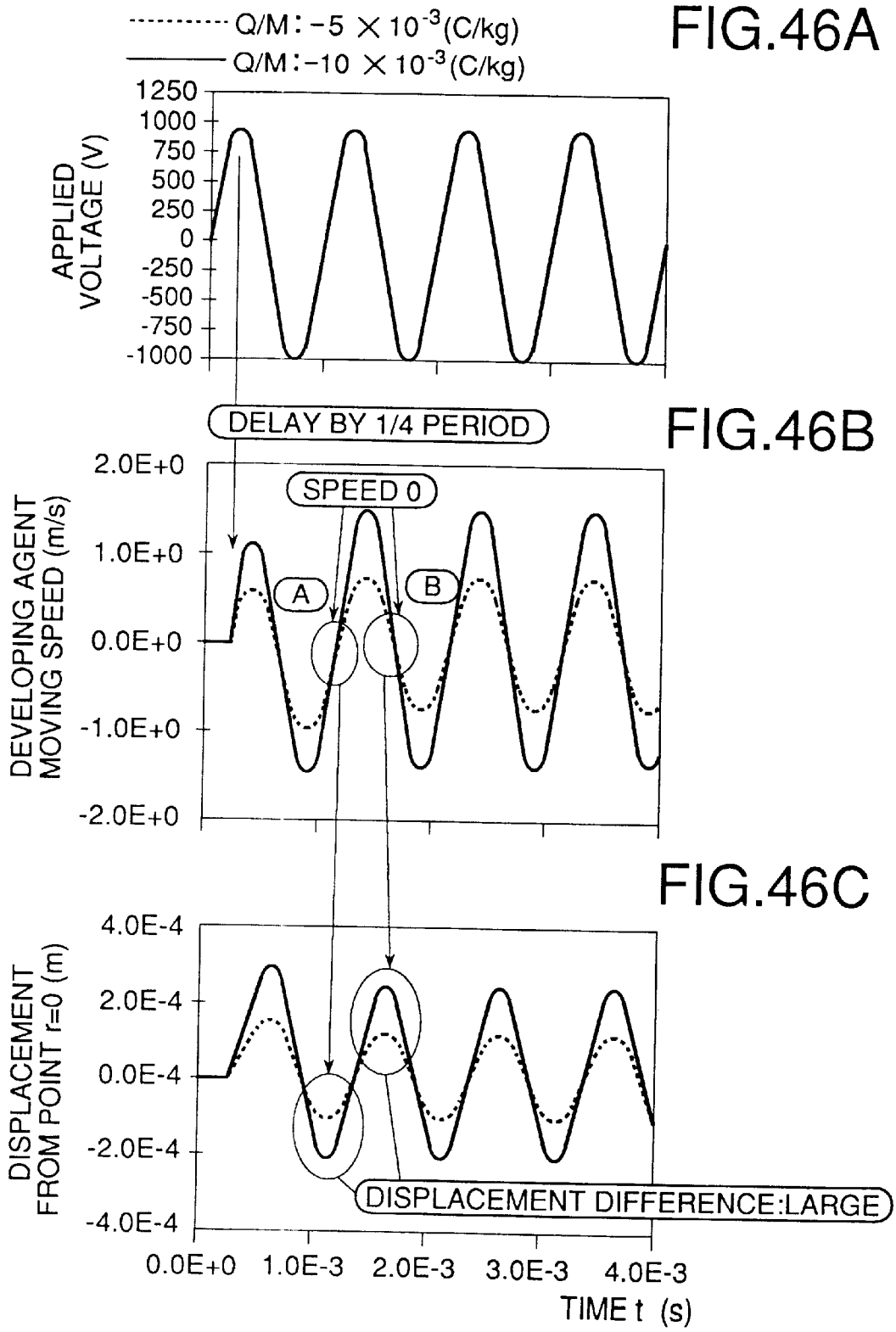
FIGS. 46A, 46B and 46C are views for explaining a further example of the motion condition of the developing agent in the flight control unit of the image forming device using the present invention.
Figure 47:
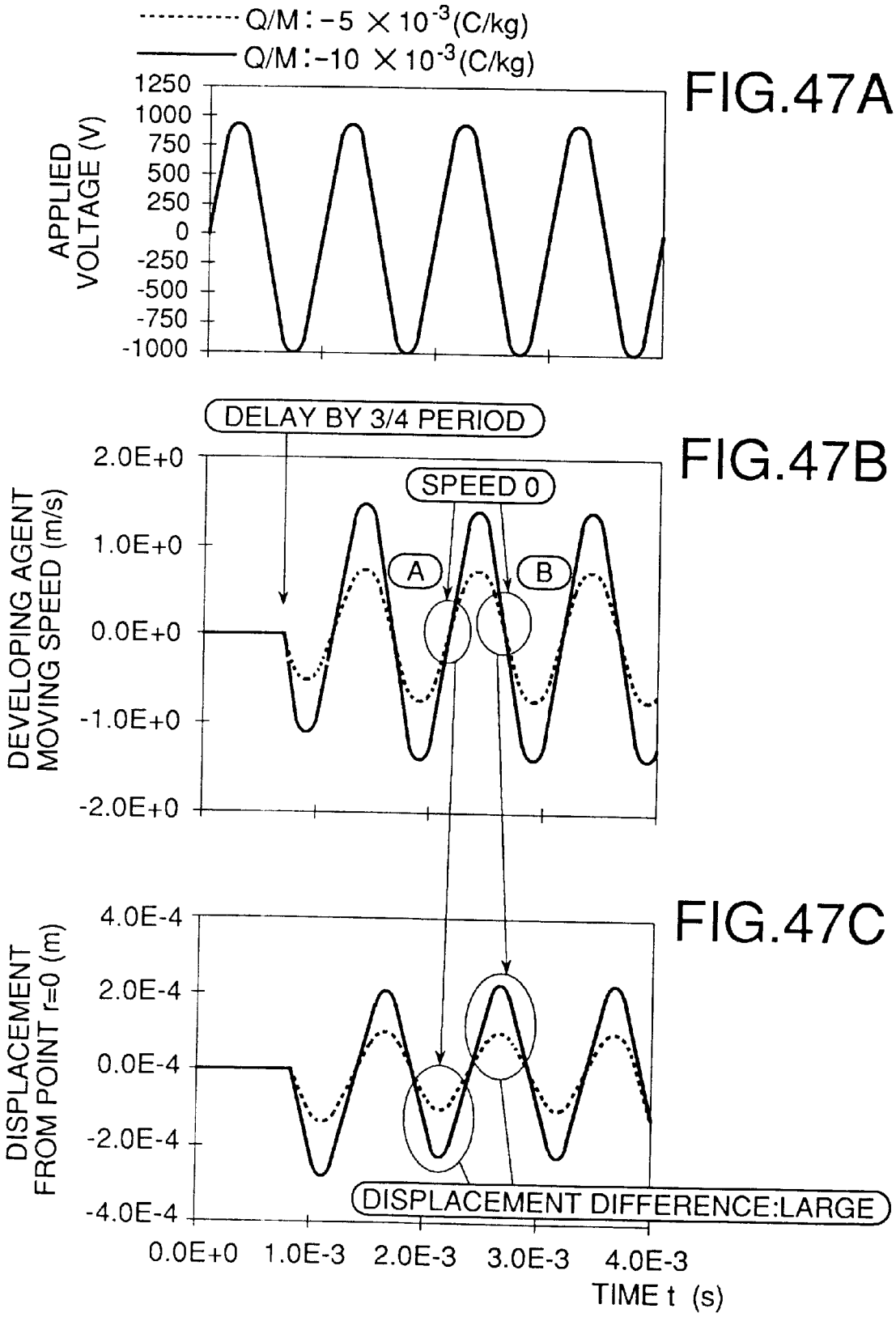
FIGS. 47A, 47B and 47C are views for explaining a further example of the motion condition of the developing agent in the flight control unit of the image forming device using the present invention.

It has been found from the calculation of the movement of the developing agent which has been described in the foregoing embodiment 10 in connection with this phenomenon that the development performs a behavior as shown in FIGS. 46 and 47 if the developing agent is disposed in the oscillating electric field when the sinusoidal oscillating voltage is at time of the ¼ and ¾ of the period, that is when the absolute value of the oscillating electric field is at maximum. FIG. 46 shows a case that the developing agent is placed in the oscillating electric field, which is delayed by ¼ period with respect to the oscillating electric field. It shows that difference in displacement due to the difference in Q/M of the developing agent is largest at turning points of the oscillating movement, so that the cloud density becomes lower. This phenomenon occurs in two positions in phase of one period of the oscillating electric field in which the speed of the developing agent becomes zero. FIG. 42 shows a case in which the developing agent is placed in the oscillating electric field at time which is delayed in phase by ¾ period of the oscillating electric field. It has been confirmed that the phenomenon similar to the case of FIG. 46 also occurs. It has been confirmed that such a phenomenon occurs before and after the ¼ or ¾ period although there are some differences.

It has been found from the above-mentioned experiments and analysis of calculation that in order to form a high density cloud condition and to perform image forming in which the spread of the developing agent in the course of flight is less, the time interval in which the second ON potential is applied to form the cloud of the developing agent between the first and second control electrode layers 21 and 22 does not preferably include the time at which the absolute value of the oscillating electric field becomes maximum.

By adopting such an embodiment, image forming can be conducted at low speed of the developing agent and high density of the cloud.

(Embodiment 12)

An embodiment having an arrangement for enhancing the recovery ratio of the developing agent in the course of the recovery of the unused developing agent to the developing agent carrier again after the flight of the developing agent to the recording medium in the above-mentioned embodiments 2 through 11 is shown in FIGS. 48 through 52.

Problems in that the unused developing agent will stay to accumulate between the first and second control electrode layers for causing clogging in the gate, or for preventing the movement of the developing agent during the formation of the oscillating electric field. The present embodiment contemplates to solve such a problem.

As shown in FIG. 49, 53 through 55, a first cleaning gate 2223 is provided in a direction of the movement of the recording medium of the second control electrode layer 22 as an additional gate which is arrayed in the same direction as the second gate 2221. The second shield electrode 2241 corresponding to the first leaning gates 2223 is formed with an aperture. These gates 2223 are of the structure that it is close to the oscillating electric field forming electrode.

Now, operation of the present embodiment will be described with reference to FIGS. 48 through 52.

Figure 50:
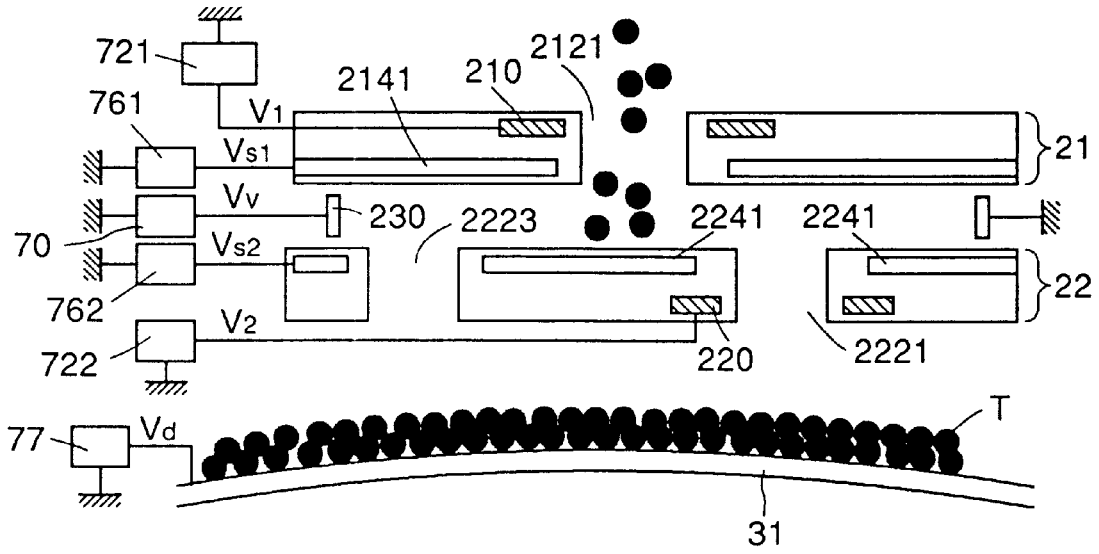
FIG. 50 is a view explaining the structure and operation of the flight control unit if the image forming device using the present invention is provided with a first cleaning gate.

After image forming is conducted on the recording medium by an operation similar to the foregoing embodiment, the first ON potential on the first electrode is turned off and the first OFF potential is applied. The unused developing agent may remain between the first and second control electrode layers under some occasions as shown in FIG. 50.

Figure 48:
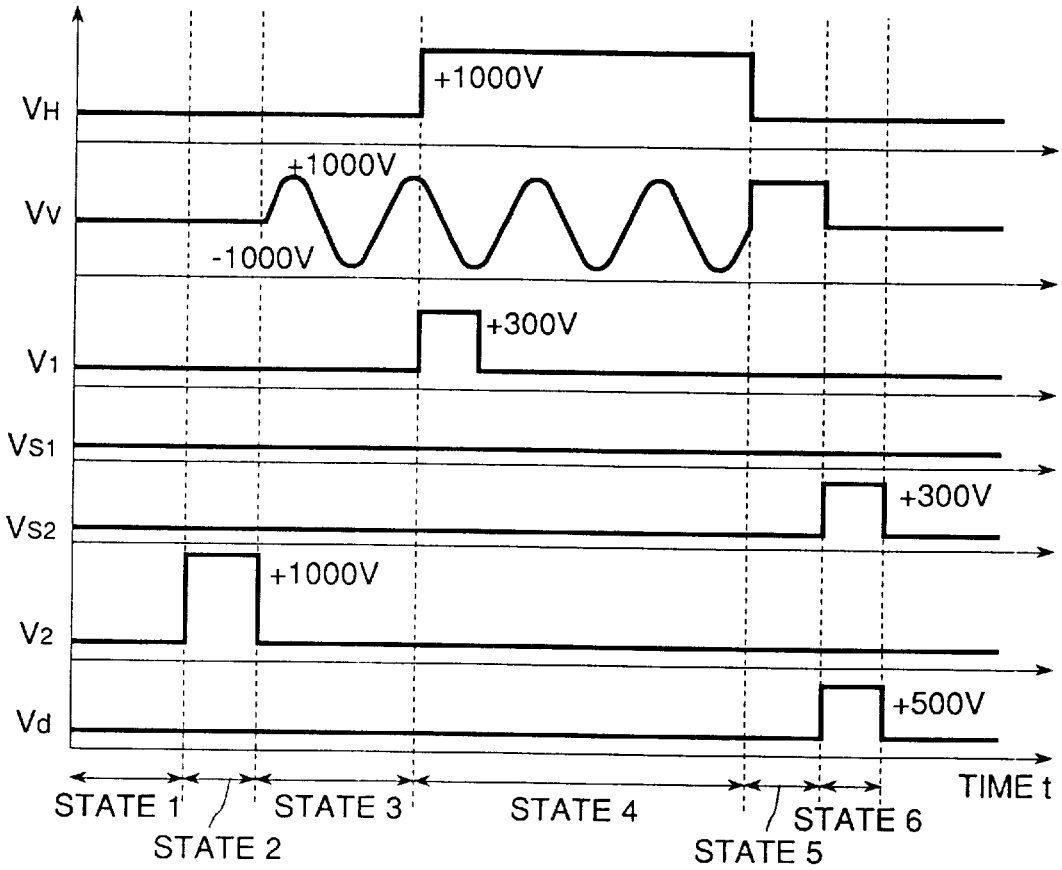
FIG. 48 is a view explaining the structure and operation of the flight control unit if the image forming device using the present invention is provided with a first cleaning gate.
Figure 49:
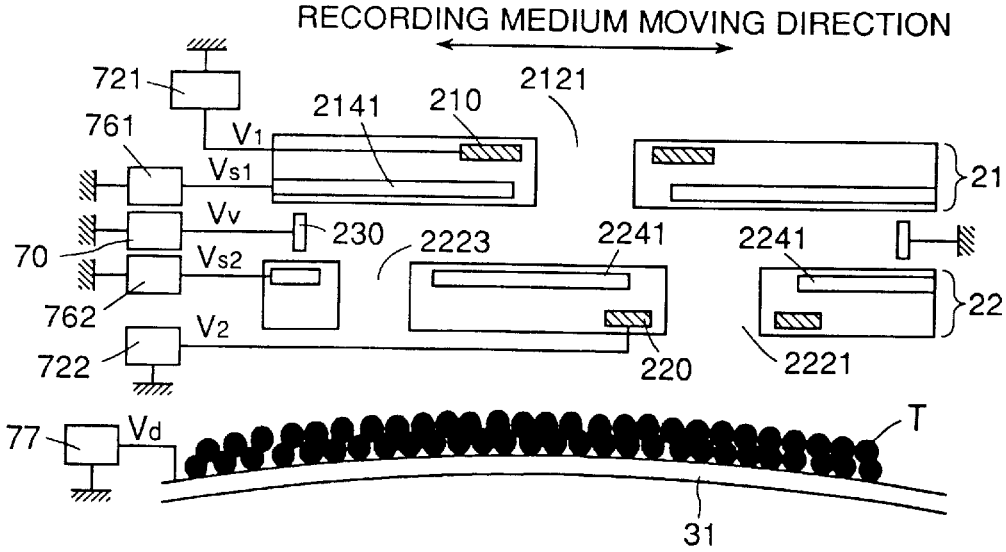
FIG. 49 is a view explaining the structure and operation of the flight control unit if the image forming device using the present invention is provided with a first cleaning gate.
Figure 51:
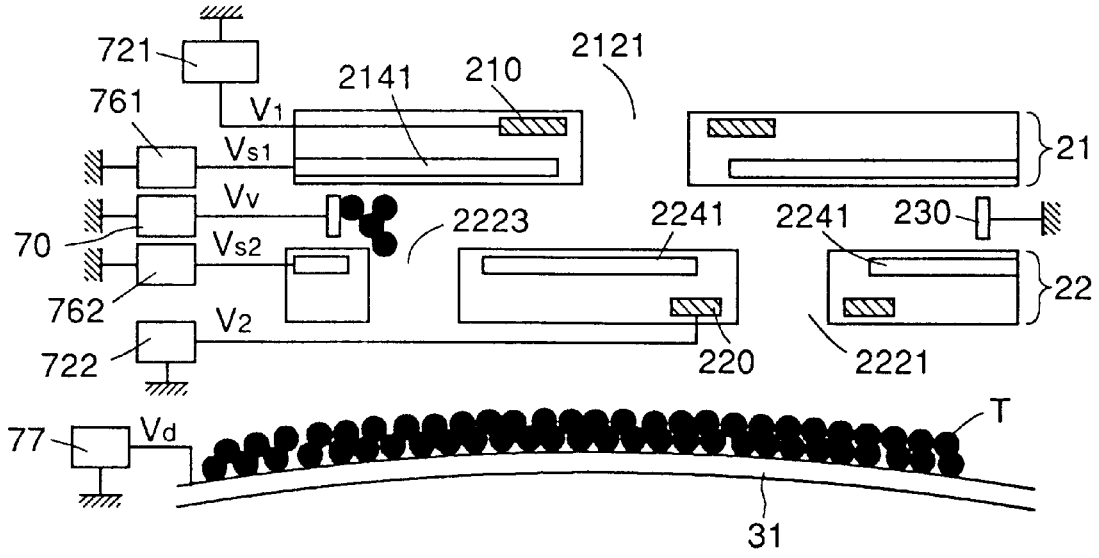
FIG. 51 is a view explaining the structure and operation of the flight control unit if the image forming device using the present invention is provided with a first cleaning gate.

A voltage which is shown as a state 5 in FIG. 48 is applied at this time to form an electric field which causes the developing agent between the oscillating electric field forming electrodes to move toward the first cleaning gates 2223. As shown in FIG. 51, the unused developing agent is moved to the vicinity of the first cleaning gates 2223 by the effect of the electric field. Since most of the unused developing agent is collected around the first cleaning gate 2223 by adopting such an embodiment, the recovery efficiency of the developing agent can be enhanced.

Figure 52:
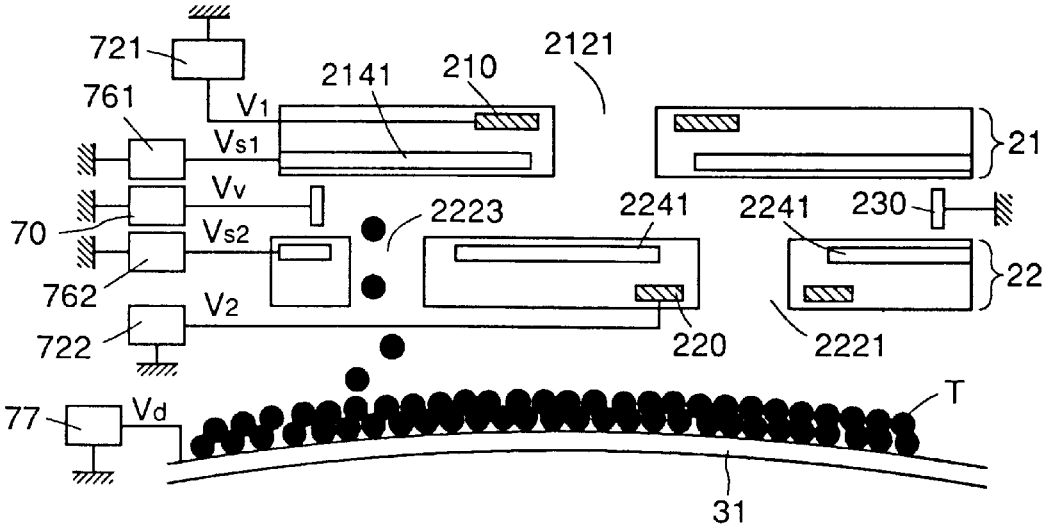
FIG. 52 is a view explaining the structure and operation of the flight control unit if the image forming device using the present invention is provided with a first cleaning gate.
Figure 53:
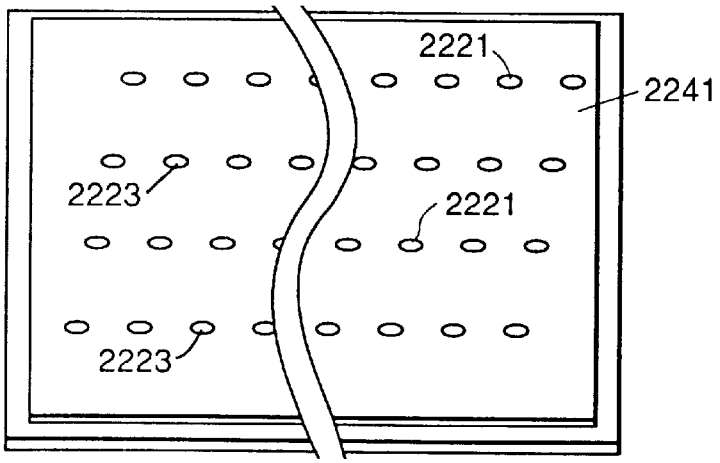
FIG. 53 is a view explaining the structure and operation of the second or fourth shield electrode if the image forming device using the present invention is provided with a first cleaning gate.

Subsequently, the potentials of +300 V and +500 V are applied to the first shield electrode 2241 and the developing agent carrier as represented as a state 6 in FIG. 48. Such an operation forms an electric field for returning the developing agent to the developing agent carrier so that recovery step of the developing agent can be conducted as shown in FIG. 52.

The present embodiment prevents the occurrence of problems in that the unused developing agent will remain to accumulate between the first and second control electrode layers for causing clogging in the gate, or for preventing the movement of the developing agent during the formation of the oscillating electric field, so that stable image forming can be enabled.

Figure 54:
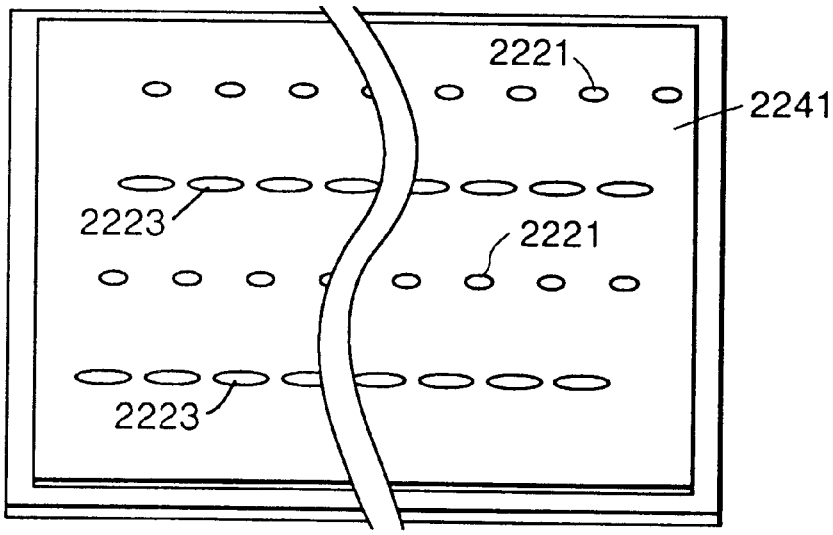
FIG. 54 is a view explaining the structure and operation of the second or fourth shield electrode if the image forming device using the present invention is provided with a first cleaning gate.

Alternatively, the first cleaning gates 2223 may be in the form of hole which is elongated as shown in FIG. 54 in a longitudinal direction of the control electrode layer to increase the passing ability of the gate for the unused developing agent for enhancing the cleaning efficiency.

Figure 55:
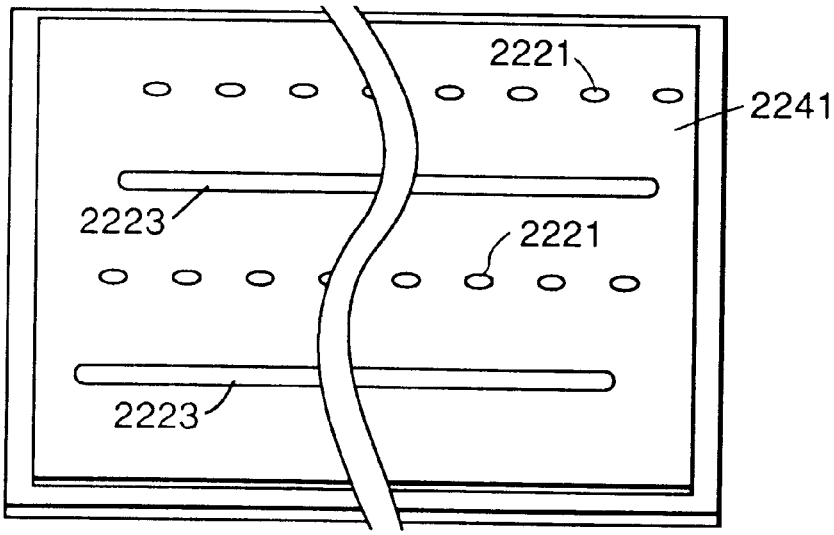
FIG. 55 is a view explaining the structure and operation of the second or fourth shield electrode if the image forming device using the present invention is provided with a first cleaning gate.
Figure 56:
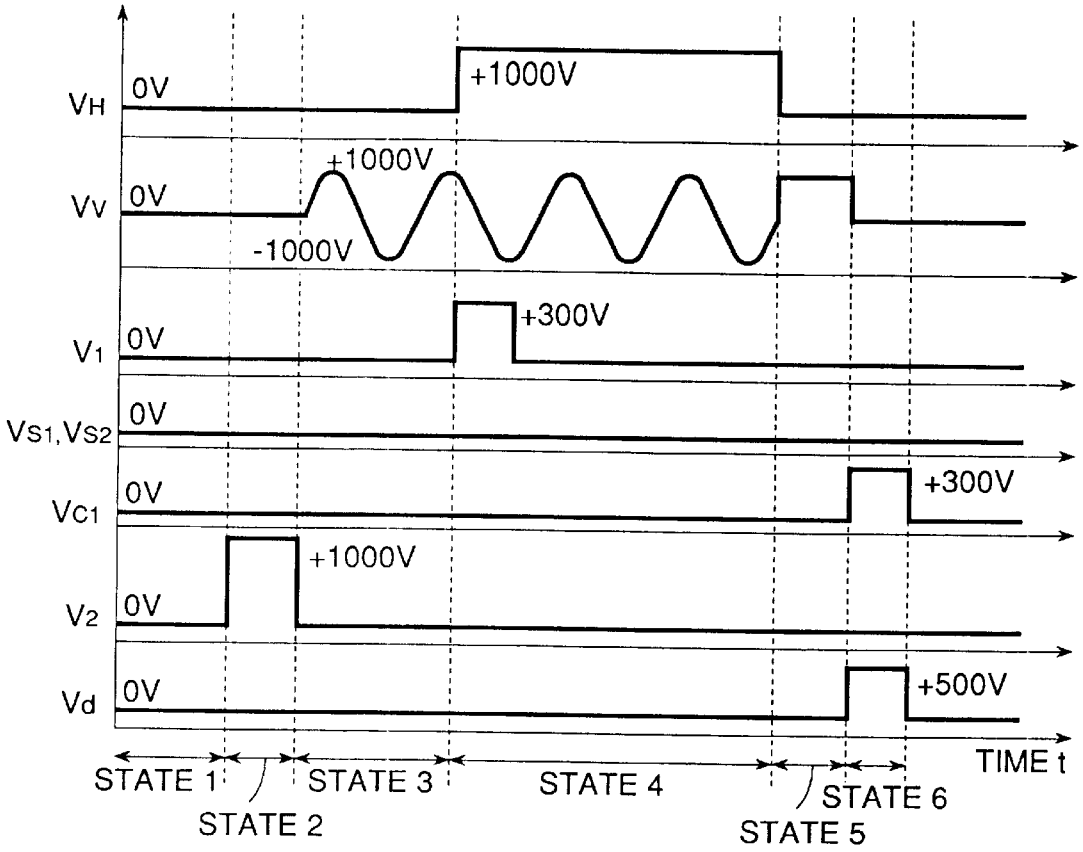
FIG. 56 is a view explaining the structure and operation of the flight control unit if the image forming device using the present invention is provided with a first cleaning gate and electrode.
Figure 57:
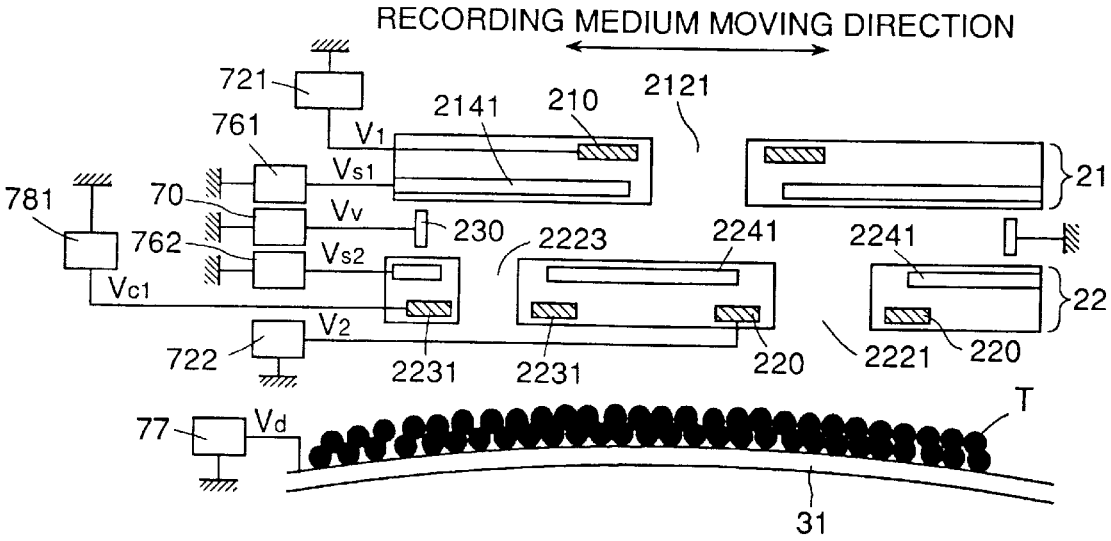
FIG. 57 is a view explaining the structure and operation of the flight control unit if the image forming device using the present invention is provided with a first cleaning gate and electrode.

Alternatively, the first cleaning gates 2223 may be in the form of slit aperture which is continuous as shown in FIG. 55 in a longitudinal direction of the control electrode to increase the passing ability of the gate for the unused developing agent for enhancing the cleaning efficiency.

Alternatively, it is apparent that the fourth shield electrode 2242 may be disposed in lieu of the second shield electrode 2241 and an opening may be provided in position corresponding to the first cleaning gates 2223 and the second and fourth shield electrodes 2241 and 2242 may be provided together.

(Embodiment 13)

First cleaning electrodes 2231 may be provided as an electrode for controlling the passage or non-passage of the unused developing agent on the side of the second control electrodes 220 facing to the second or fourth shield electrode 2241 or 2242 in the foregoing embodiments as shown in FIG. 56 through 63.

The present embodiment in which the second shield electrode 2241 is also provided will be described.

Figure 61:
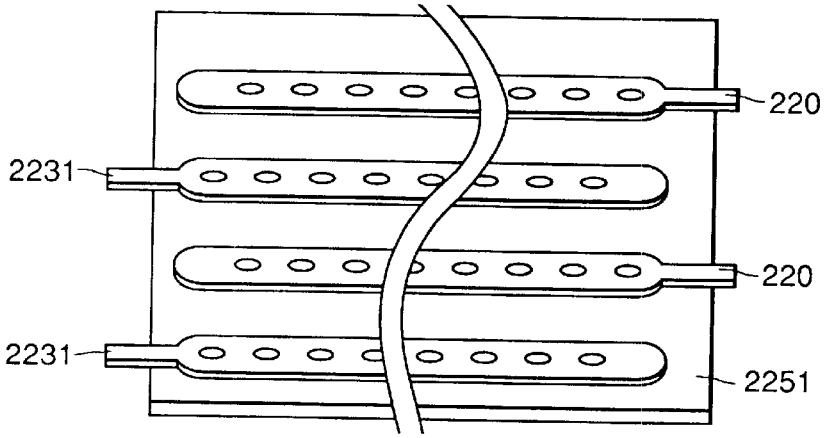
FIG. 61 is a view for explaining the structure of the first cleaning electrode used for the present invention.
Figure 62:
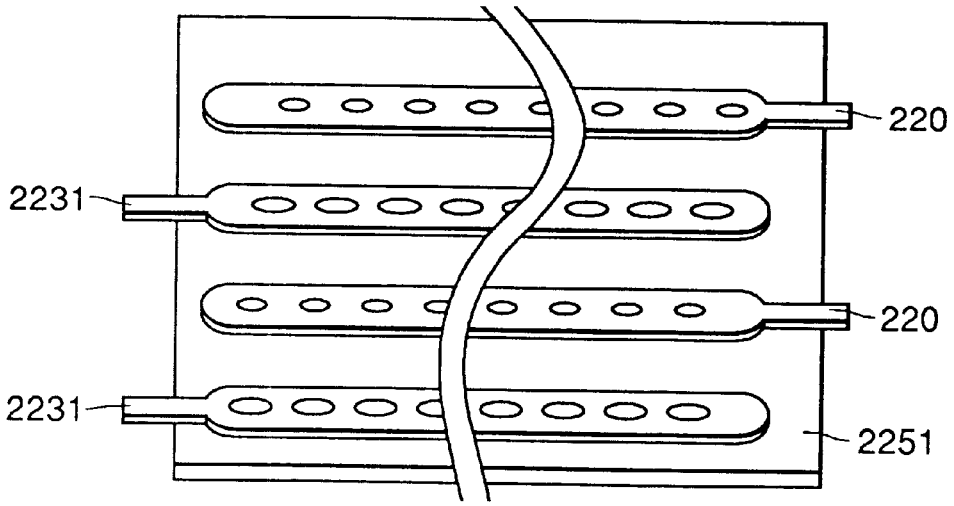
FIG. 62 is a view for explaining the structure of the first cleaning electrode used for the present invention.

The first cleaning electrodes 2231 are provided on the side of an insulating substrate layer 2251 on which the second control electrodes 220 are provided as shown in FIG. 61 and are electrically insulated from the second control electrodes 220. The first cleaning electrodes 2231 are electrically connected to the first cleaning electrode power source 781 so that +300 V is applied to the first cleaning electrodes 2231 to establish a potential for passing the unused developing agent (the potential will be hereinafter referred to as the first cleaning ON potential) and 0 V is applied thereto to establish a potential to prevent the passage (the potential will be hereinafter referred to as the first cleaning OFF potential). The first cleaning electrodes 2231 are provided with apertures in positions corresponding to the gates (the first cleaning gates) 2223.

Now, operation in the present embodiment will be described with reference to FIGS. 56 through 60.

Figure 58:
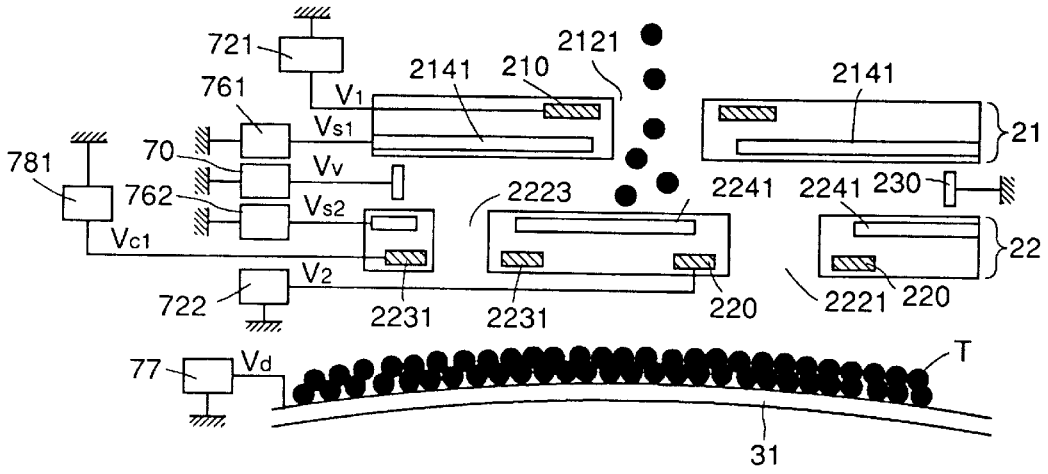
FIG. 58 is a view explaining the structure and operation of the flight control unit if the image forming device using the present invention is provided with a first cleaning gate and electrode.
Figure 59:
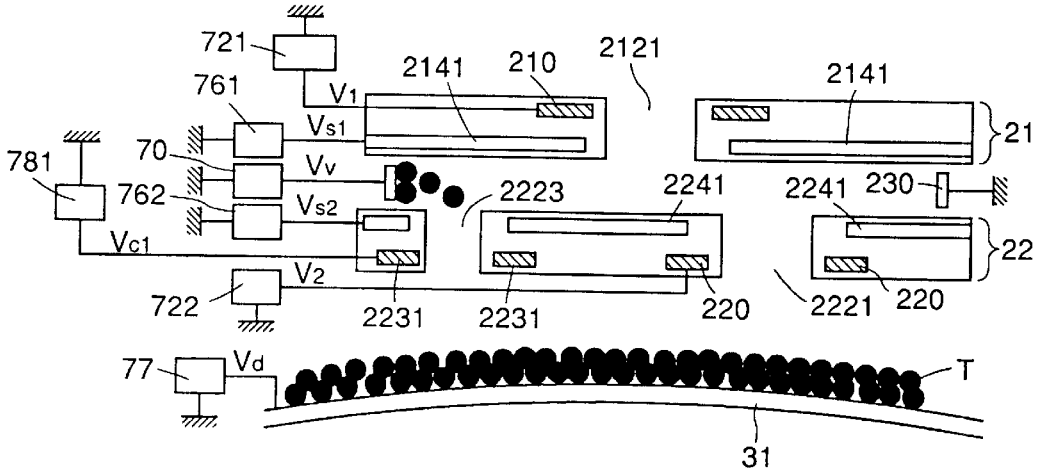
FIG. 59 is a view explaining the structure and operation of the flight control unit if the image forming device using the present invention is provided with a first cleaning gate and electrode.

As shown in FIGS. 58 and 59, the developing agent which has been used after completion of the image forming will be moved to the vicinity of the first cleaning gates 2223 similarly to the foregoing embodiment 12.

Figure 60:
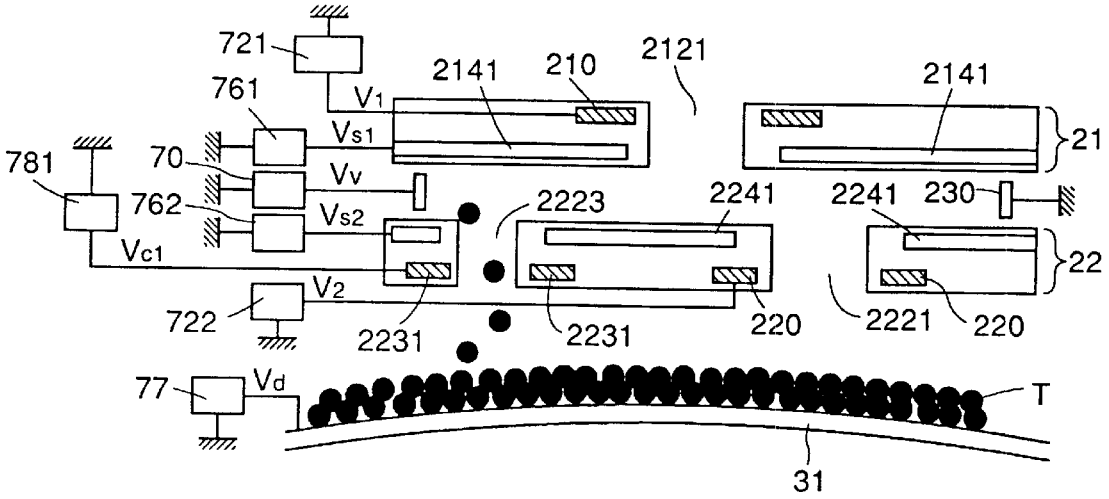
FIG. 60 is a view explaining the structure and operation of the flight control unit if the image forming device using the present invention is provided with a first cleaning gate and electrode.

Then, the first cleaning potential is applied to the first cleaning electrodes 2231 and +400 V potential is applied to the developing agent carrier 31. At this time, application of 0 V to the second shield electrode 2241 may be kept. This forms such electric field for passing the developing agent through the first cleaning electrodes 2231 and for moving it toward the developing agent carrier. The unused developing agent is recovered to the developing agent carrier by the action of this electric field as shown in FIG. 60.

Figure 65:
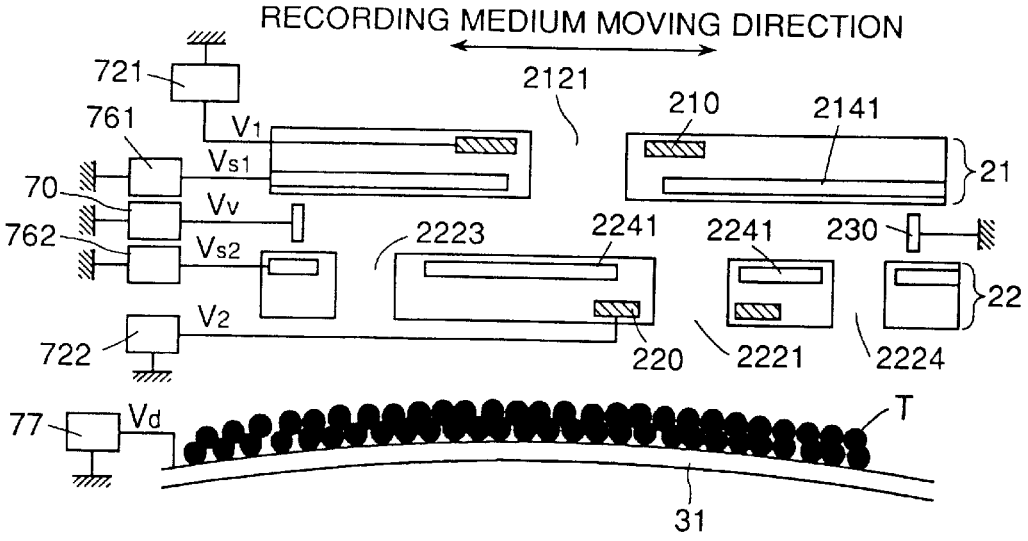
FIG. 65 is a view explaining the structure and operation of the flight control unit if the image forming device using the present invention is provided with a first and second cleaning gates.

The present embodiment prevents the occurrence of problems in that the unused developing agent will remain to accumulate between the first and second control electrode layers for causing clogging in the gate, or for preventing the movement of the developing agent during the formation of the oscillating electric field, so that stable image forming can be enabled. Furthermore, even if a cloud of the developing agent is formed between paired oscillating electric field forming electrodes (not shown) which are arrayed in a recording medium moving direction and the second shield electrodes 2241 are used together, recovery operation of the unused developing agent can be conducted without preventing the above-mentioned formation of cloud. Accordingly, the process of image forming between a plurality of pairs of the oscillating electric field forming electrodes can be achieved independently of the process for recovering the developing agent therebetween, so that the present embodiment is effective for the enhancement of the stability and the speed of image forming. The apertures of the first cleaning electrodes 2231 may be in the form of hole which is elongated as shown in FIG. 65 in a longitudinal direction of the control electrode layer.

Figure 63:
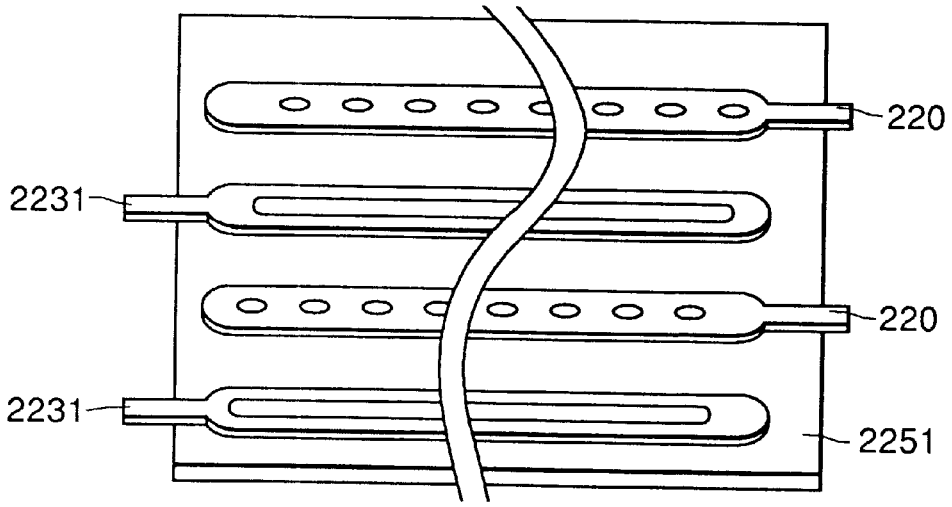
FIG. 63 is a view for explaining the structure of the first cleaning electrode used for the present invention.

Alternatively, the apertures of the first cleaning electrodes 2231 may be in the form of slit opening which is continuous as shown in FIG. 63.

Alternatively, it is apparent that the fourth shield electrodes 2242 may be disposed in lieu of the second shield electrodes 2241 and apertures may be provided in positions corresponding to the first cleaning gates 2223 and the second and fourth shield electrodes 2241 and 2242 may be provided together.

(Embodiment 14)

An embodiment in which the recovery ability of the developing agent can be enhanced in the process for recovering the unused developing agent to the developing agent carrier again after the flight of the developing agent onto the recording medium in the above-mentioned embodiment 12 will be described with reference to FIGS. 64 through 68.

Figure 69:
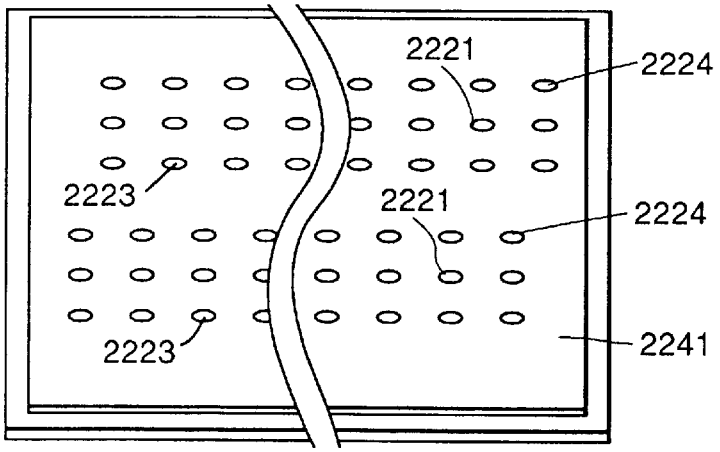
FIG. 69 is a view explaining the structure of the second or fourth shield electrode if the first and second cleaning gates used for the present invention are provided.

As shown in FIGS. 65 and 69, the first cleaning gates 2223 which are arrayed in substantially same direction as the second gates 2221 are provided on the second control electrode layer 22 in a recording medium moving direction and openings are provided on the second shield electrodes 2241 in positions corresponding to the first cleaning gates 2223. Second cleaning gates 2224 are provided in the opposite side of the aforementioned apertures in a recording medium moving direction as additional gates which are arrayed in a substantially same direction as the first cleaning gates 2223 and apertures are provided in the first shield electrodes 2241 in positions corresponding to the second cleaning gates 2224. The gates 2224 are close to the oscillating electric field forming electrode.

Now, operation of the present embodiment will be described with reference to FIGS. 64 through 68.

Figure 66:
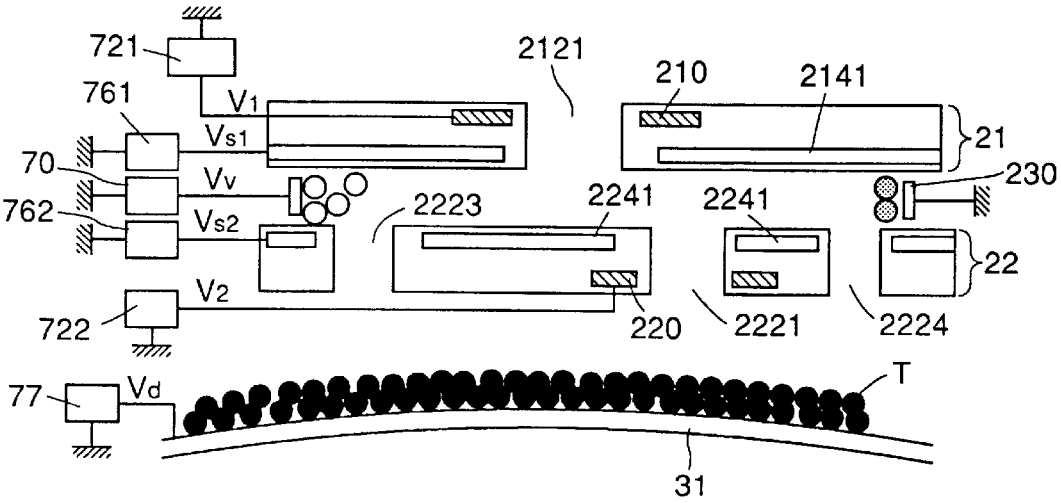
FIG. 66 is a view explaining the structure and operation of the flight control unit if the image forming device using the present invention is provided with a first and second cleaning gates.

Recovery of the unused developing agent is conducted after completion of image forming on the recording medium by operation similar to that of the above-mentioned embodiment 12. On rare occasions, the developing agent having an polarity opposite to the desired charging polarity (hereinafter referred to as opposite polarity developing agent) may be mixed in the unused developing agent. When such an electric field which causes the developing agent having a desired polarity to be moved toward the first cleaning gates 2223 is formed between the oscillating electric field forming electrodes by applying a voltage as represented as a state 5 in FIG. 64, the unused developing agent having a desired polarity is collected in the vicinity of the first cleaning gates 2223 while the opposite polarity developing agent is collected in the vicinity of the second cleaning gates 2224 as shown in FIG. 66. White circles represent the developing agent having a desired polarity and the halftone circles represent opposite polarity developing agent in FIG. 66.

Figure 64:
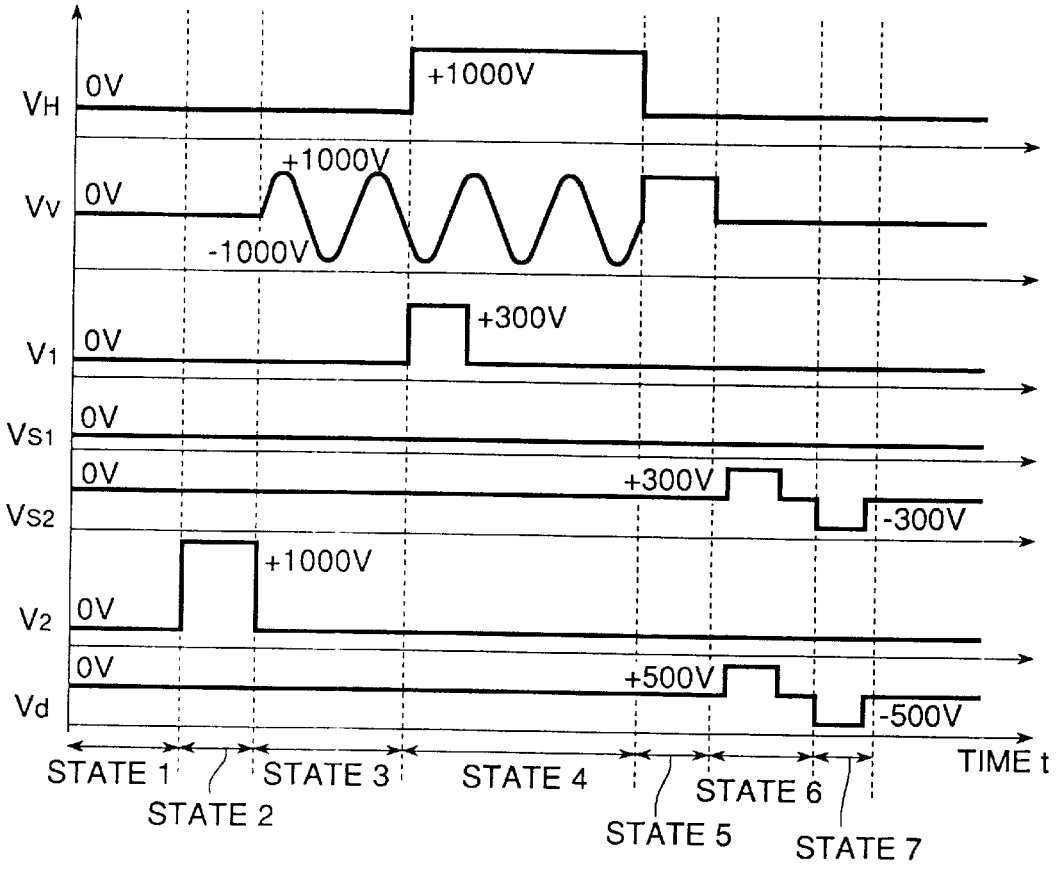
FIG. 64 is a view explaining the structure and operation of the flight control unit if the image forming device using the present invention is provided with a first and second cleaning gates.
Figure 67:
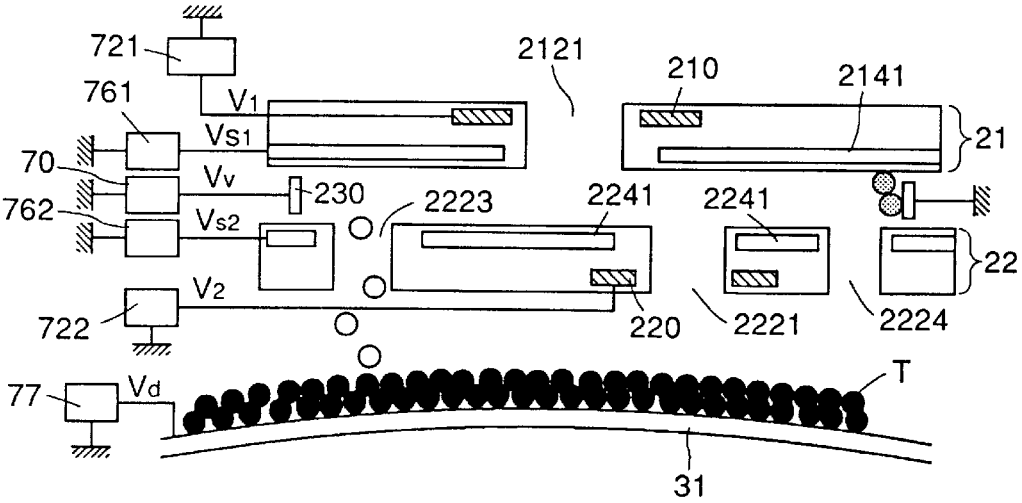
FIG. 67 is a view explaining the structure and operation of the flight control unit if the image forming device using the present invention is provided with a first and second cleaning gates.

Subsequently, the potentials of +300 V and +500 V are applied to the first shield electrodes 2241 and the developing agent carrier 31, respectively as represented as a state 6 in FIG. 64. Such an operation forms an electric field for returning the developing agent having a desired polarity to the developing agent carrier so that recovery process of the developing agent can be conducted as shown in FIG. 67.

Figure 68:
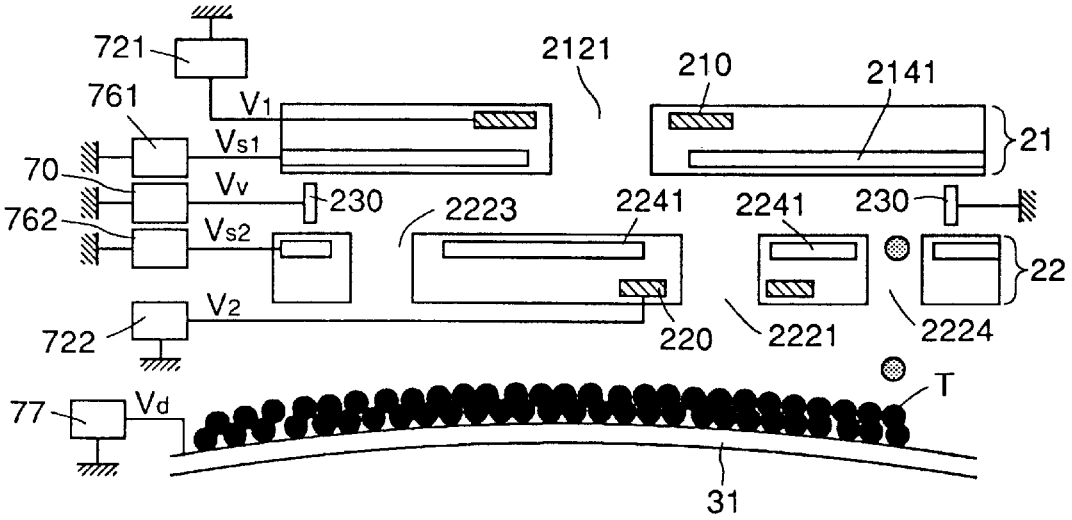
FIG. 68 is a view explaining the structure and operation of the flight control unit if the image forming device using the present invention is provided with a first and second cleaning gates.

Subsequently, the potentials of −300 V and −500 V are applied to the first shield electrodes 2241 and the developing agent carrier 31, respectively as represented as a state 7 in FIG. 64. Such an operation forms an electric field for returning the developing agent having an opposite polarity to the developing agent carrier so that recovery process of the opposite polarity developing agent can be conducted as shown in FIG. 68.

When there is the risk of the flight of the developing agent to the second gates 2221 due to the changes in the potential on the developing agent carrier 31 during the process of recovering the developing agent, the potential on the second control electrodes 220 may be approximate to that on the developing agent carrier.

By adopting such an embodiment, the opposite polarity developing agent can be recovered from the developing agent in the form of cloud if it exists therein.

Figure 70:
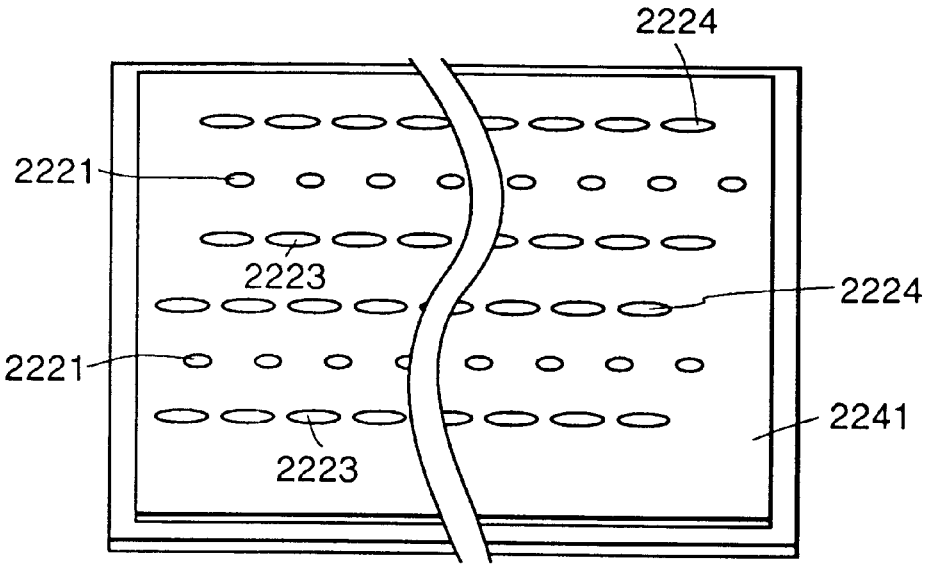
FIG. 70 is a view explaining the structure of the second or fourth shield electrode if the first and second cleaning gates used for the present invention are provided.

Alternatively, the second cleaning gates 2224 may be in the form of hole which is elongated as shown in FIG. 70 in a longitudinal direction of the control electrode layer.

Figure 71:
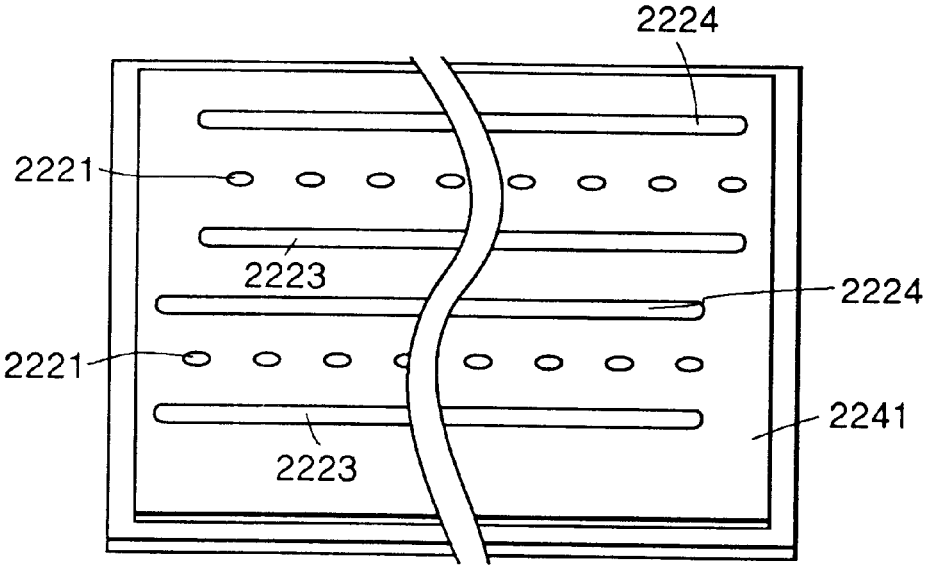
FIG. 71 is a view explaining the structure of the second or fourth shield electrode if the first and second cleaning gates used for the present invention are provided.

Furthermore, the second cleaning gates 2224 may be in the form of slit aperture which is continuous as shown in FIG. 71 in a longitudinal direction of the control electrode layer.

Alternatively, it is apparent that the fourth shield electrodes 2242 may be disposed in lieu of the second shield electrodes 2241 and an opening may be provided in positions corresponding to the second cleaning gate 2224 and the second and fourth shield electrodes 2241 and 2242 may be provided together.

Alternatively, the first cleaning electrodes which are mentioned in the foregoing embodiment 13 may be provided.

(Embodiment 15)

Second cleaning electrodes 2232 may be provided as electrodes for controlling the passage or non-passage of the unused developing agent on the side of the second control electrodes 220 facing to the second or fourth shield electrodes 2241 or 2242 in the foregoing embodiment 14 as shown in FIG. 72 through 79. The present embodiment in which the second shield electrodes are also provided together with the first cleaning electrodes will be described.

Figure 77:
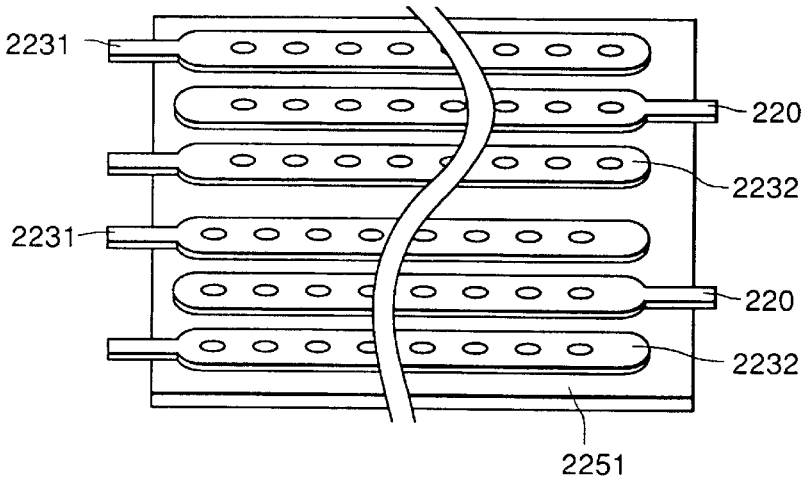
FIG. 77 is a view for explaining the structure of the first and second cleaning electrodes used for the present invention.

The second cleaning electrodes 2232 are provided on the side of an insulating substrate layer 2251 on which the second control electrodes 220 are provided as shown in FIG. 77 and are electrically insulated from the second control electrodes 220. The second cleaning electrodes 2232 are electrically connected to the second cleaning electrode power source 782 so that −300 V is applied to the electrodes to establish a potential for passing the unused developing agent (the potential will be hereinafter referred to as the second cleaning ON potential) and 0 V is applied thereto to establish a potential to prevent the passage (the potential will be hereinafter referred to as second cleaning OFF potential). The second cleaning electrodes 2232 are provided with apertures in positions corresponding to the second cleaning gates 2224.

Now, operation of the present embodiment will be described with reference to FIGS. 72 through 76.

Figure 74:
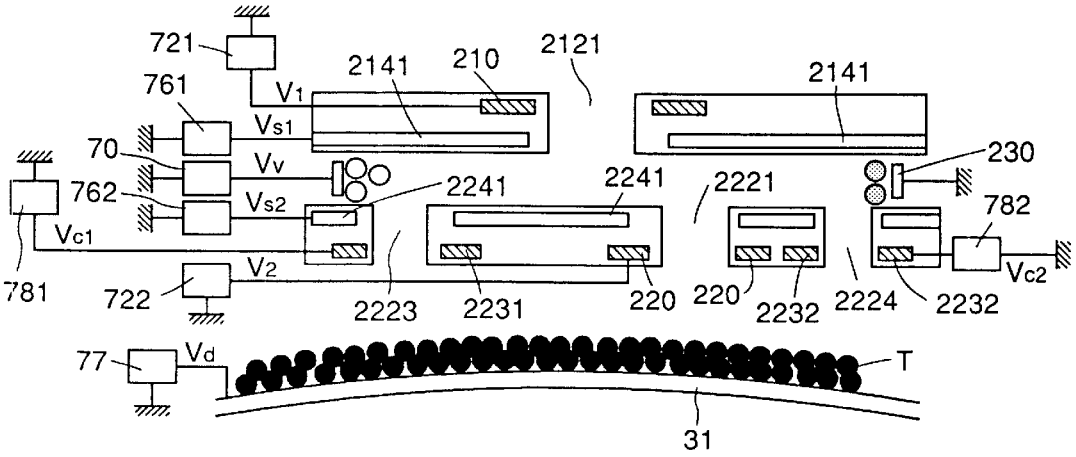
FIG. 74 is a view explaining the structure and operation of the flight control unit if the image forming device using the present invention is provided with first and second cleaning gates and first and second cleaning electrodes.

Recovery of the unused developing agent is conducted after conducting image forming on the recording medium by operation similar to that of the above-mentioned embodiment 14. On rare occasions, the developing agent having an polarity opposite to the desired charging polarity (hereinafter referred to as opposite polarity developing agent) may be mixed in the unused developing agent. When such an electric field which causes the developing agent having a desired polarity to be moved toward the first cleaning gates 2223 is formed between the oscillating electric field forming electrodes by applying a voltage as represented as state 5 in FIG. 72, the unused developing agent having a desired polarity is collected in the vicinity of the first cleaning gates 2223 while the opposite polarity developing agent is collected in the vicinity of the second cleaning gates 2224 as shown in FIG. 74. White circles represent the developing agent having a desired polarity and the halftone circles represent opposite polarity developing agent in FIG. 74.

Figure 72:
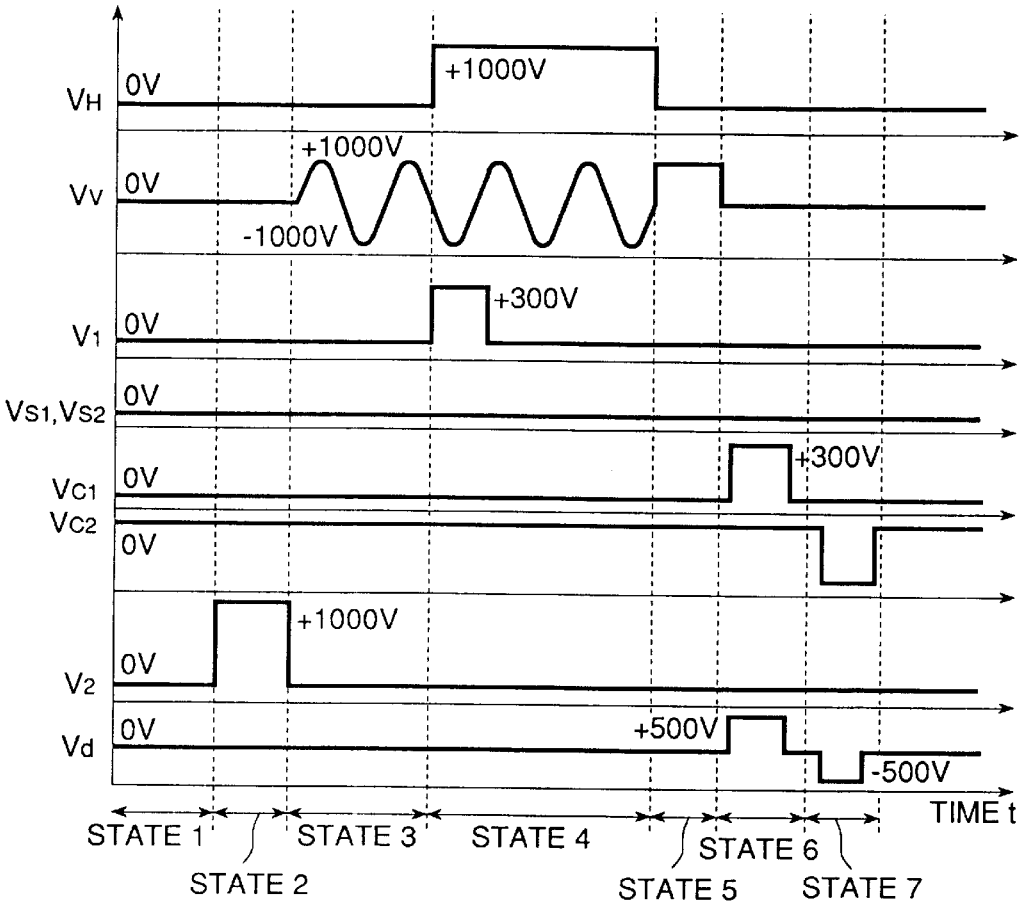
FIG. 72 is a view explaining the structure and operation of the flight control unit if the image forming device using the present invention is provided with first and second cleaning gates and first and second cleaning electrodes.
Figure 73:
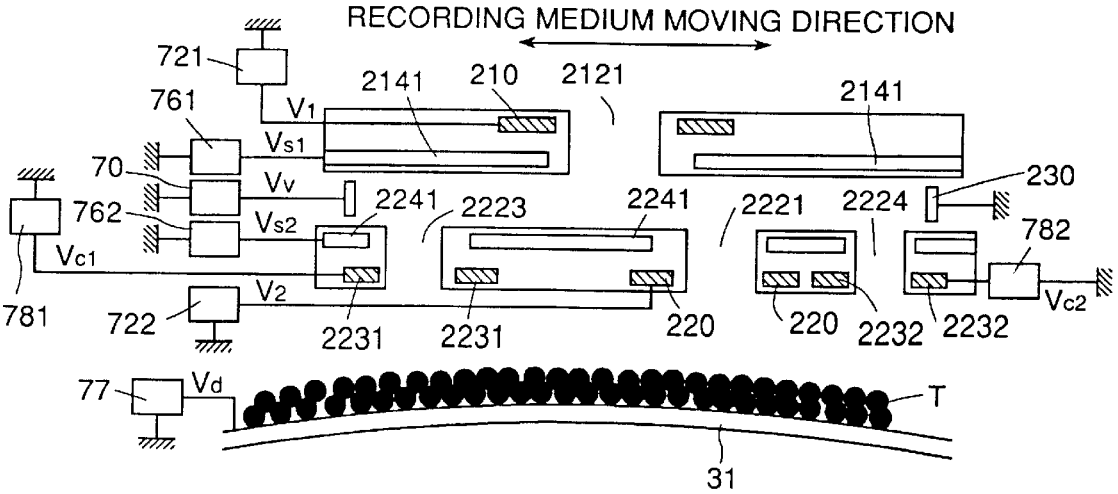
FIG. 73 is a view explaining the structure and operation of the flight control unit if the image forming device using the present invention is provided with first and second cleaning gates and first and second cleaning electrodes.
Figure 75:
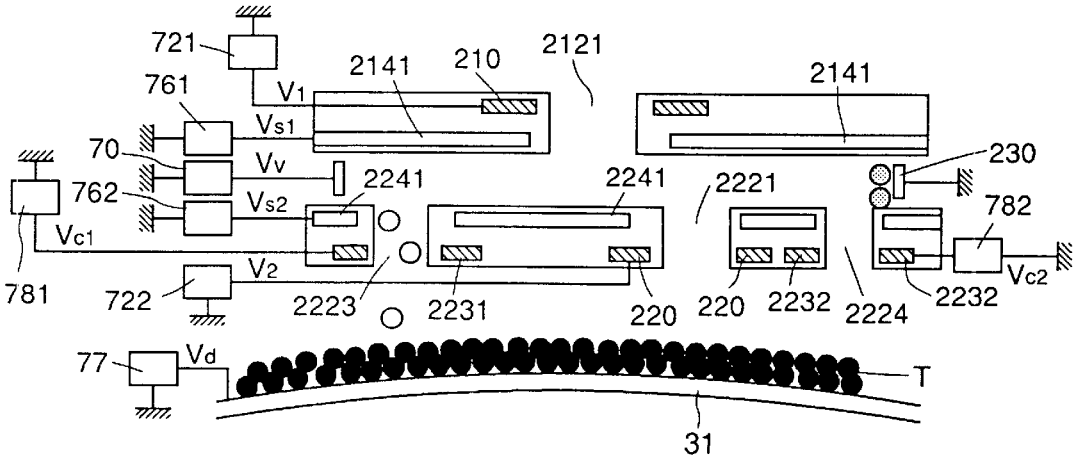
FIG. 75 is a view explaining the structure and operation of the flight control unit if the image forming device using the present invention is provided with first and second cleaning gates and first and second cleaning electrodes.

Subsequently, the potentials of +300 V and +500 V are applied to the first cleaning electrodes 2231 and the developing agent carrier 31, respectively as represented as a state 6 in FIG. 72. Such an operation forms an electric field for returning the developing agent having a desired polarity to the developing agent carrier 31 so that recovery process of the developing agent can be conducted as shown in FIG. 75.

Figure 76:
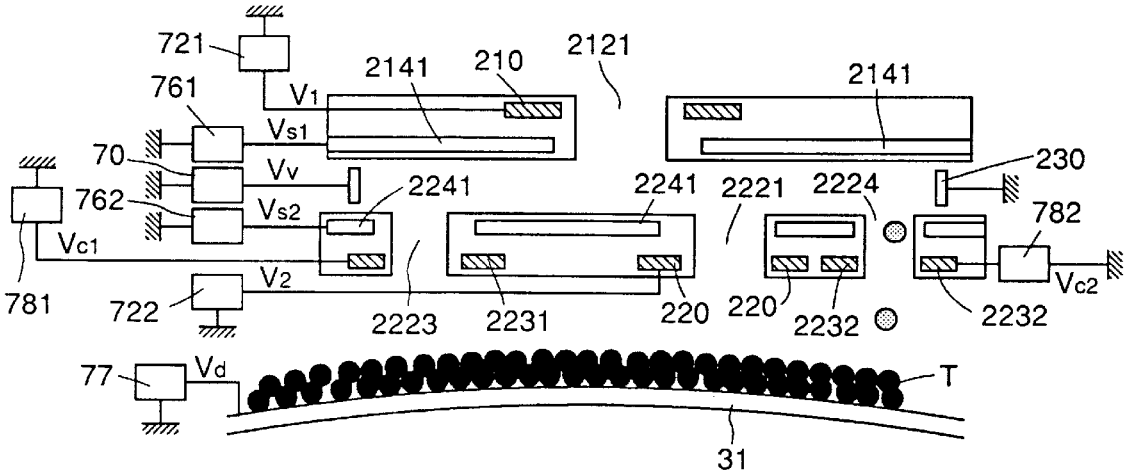
FIG. 76 is a view explaining the structure and operation of the flight control unit if the image forming device using the present invention is provided with first and second cleaning gates and first and second cleaning electrodes.

Subsequently, the potentials of −300 V and −500 V are applied to the second cleaning electrodes 2232 and the developing agent carrier 31, respectively as represented as a state 7 in FIG. 72. Such an operation forms an electric field for returning the developing agent having an opposite polarity to the developing agent carrier 31 so that recovery process of the opposite polarity developing agent can be conducted as shown in FIG. 76.

When there is the risk of the flight of the developing agent to the second gates 2221 due to the changes in the potential on the developing agent carrier during the process of recovering the developing agent, the potential on the second control electrodes 220 may be approximate to that on the developing agent carrier.

By adopting such an embodiment, the opposite polarity developing agent can be recovered from the developing agent in the form of cloud if it exists therein.

Figure 78:
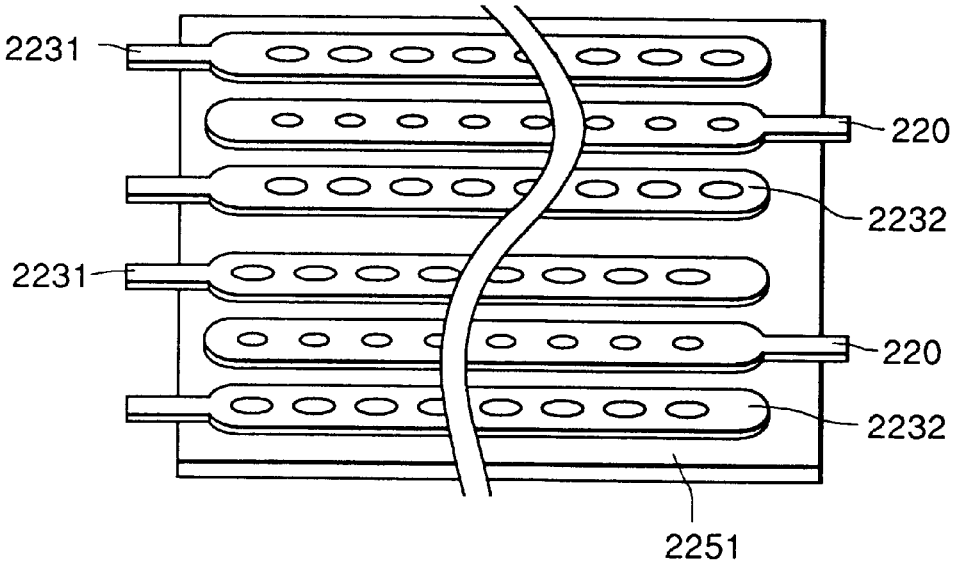
FIG. 78 is a view for explaining the structure of the first and second cleaning electrodes used for the present invention.

Alternatively, the apertures of the second cleaning electrodes 2232 may be in the form of hole which is elongated as shown in FIG. 78 in a longitudinal direction of the control electrode layer.

Figure 79:
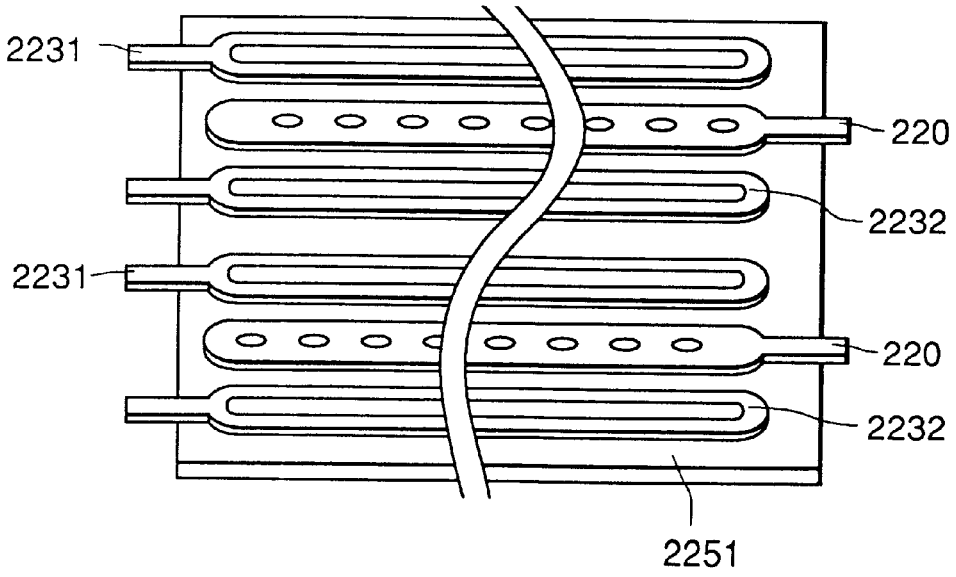
FIG. 79 is a view for explaining the structure of the first and second cleaning electrodes used for the present invention.

Furthermore, the apertures of the second cleaning electrodes 2232 may be in the form of slit apertures which is continuous as shown in FIG. 79 in a longitudinal direction of the control electrode layer.

It is apparent that the fourth shield electrodes 2242 may be disposed in lieu of the second shield electrodes 2241 and an opening may be provided in position corresponding to the second cleaning gate 2224 and the second and fourth shield electrodes 2241 and 2242 may be provided together.

The first cleaning electrodes 2231 may be omitted if necessary although it is provided in the present embodiment.

(Embodiment 16) As shown in FIGS. 80 through 90, the first control electrode layer 21 may be formed with more than one gate between paired oscillating electric field forming electrodes. By adopting the present embodiment, the number of oscillating electric field forming electrodes 230 and the second control electrodes 220 can be reduced, resulting in the simplification of the structure of the control electrodes.

Figure 91:
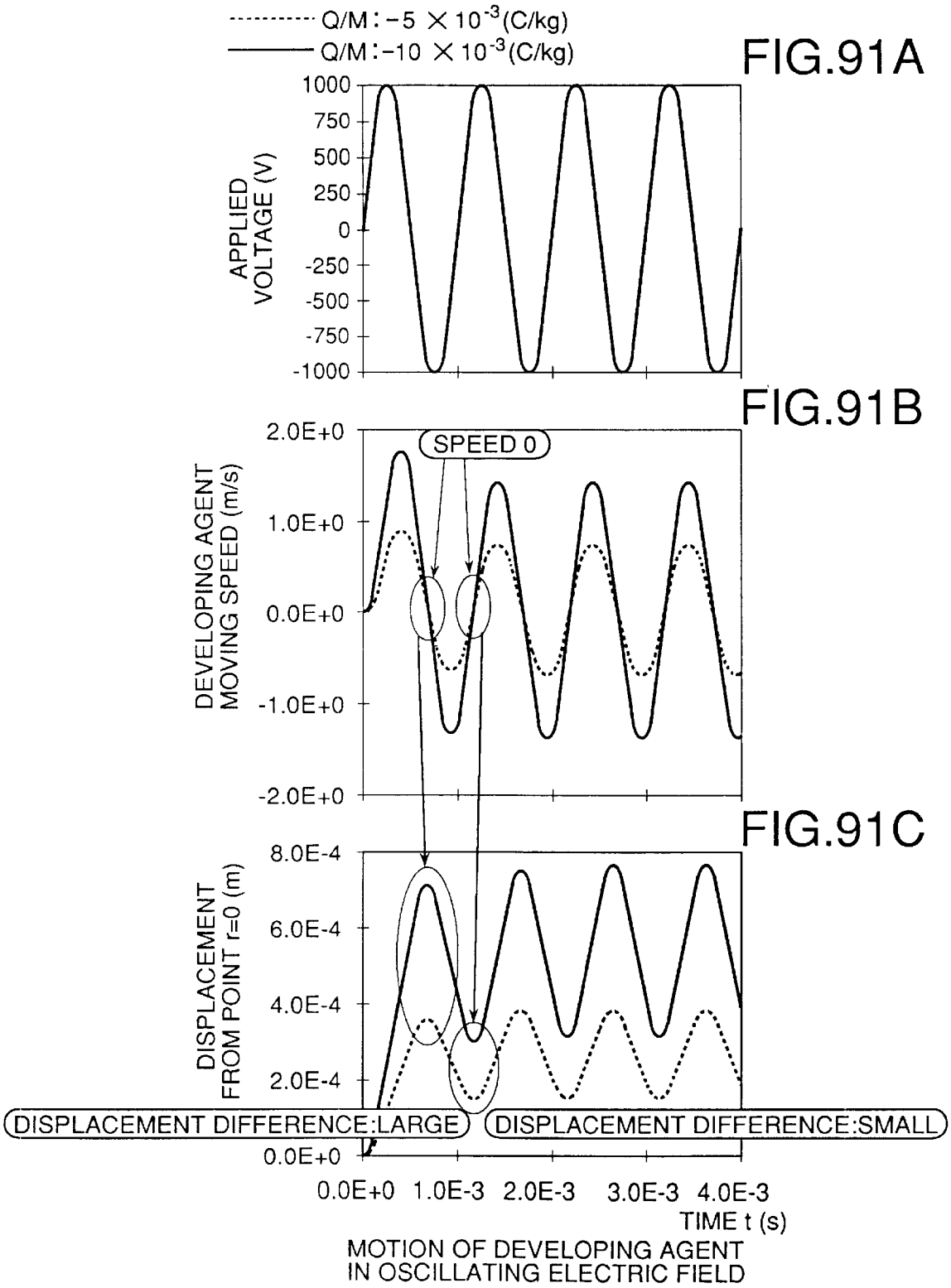
FIGS. 91A, 91B and 91C are views for explaining a further example of the motion condition of the developing agent in the flight control unit of the image forming device using the present invention.
Figure 92:
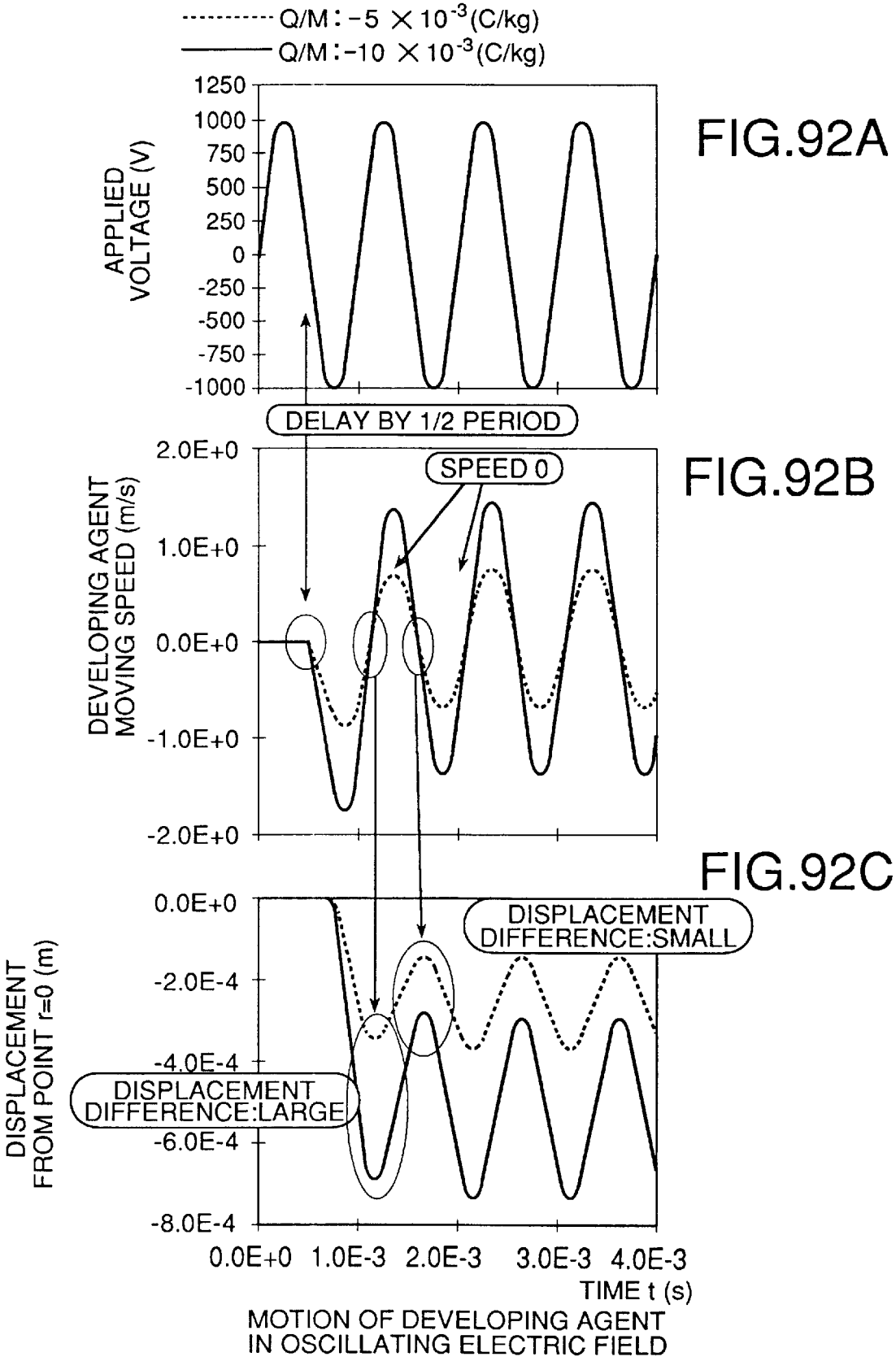
FIGS. 92A, 92B, and 92C are views for explaining a further example of the motion condition of the developing agent in the flight control unit of the image forming device using the present invention.

Prior to the description of the operation of the present embodiment, the movement of the developing agent in the oscillating electric field will be described. The changes in the moving condition of the developing agent in phase of the oscillating electric field have been studied when a sinusoidal oscillating electric field is formed by a method which has been described in the foregoing embodiments 10 and 11. FIGS. 91 and 92 show the calculated moving condition of the developing agent at t=0 (FIG. 91) and when the developing agent is placed in the oscillating electric field in phase which is delayed by a half of the period of the oscillating electric field (FIG. 92) under the same condition as those of embodiments 10 and 11, respectively. It has been found from this that the position and time in which a high density developing agent cloud occurs is different depending upon the changes in the mechanism for generating the oscillating voltage when the developing agent is placed in the oscillating electric field. It has also be found that the position in which the high density cloud occurs are symmetric about an origin position where the developing agent was initially placed and the cloud density is equal thereon when the developing agent is placed in the oscillating electric field in phase which is delayed by ½ or (½+n) (n denotes an integer) times of the period of the oscillating electric field. Such a phenomenon has been confirmed also by the observation of the flight of the developing agent by means of high speed camera.

By advantageously utilize this phenomenon, that is by delaying the time when the developing agent passes through the second gates 2221 by (½+n) (n denotes an integer) times of the period of oscillating electric field and by providing two or more first gates 2121 in position where the developing agent cloud becomes a high density, the flight of the developing agent is only required to control so that it passes through the first gates 2121 when the high density cloud is formed at each of the first gates. If the first control electrodes are arrayed in a plurality of rows in an oscillating electric field forming direction, the number of the pairs of the electrodes for forming the oscillating electric field can be made less than the number of rows of the first control electrodes.

Operation of the present embodiment based upon such principle will be described with reference to FIGS. 80 through 90.

Figure 80:
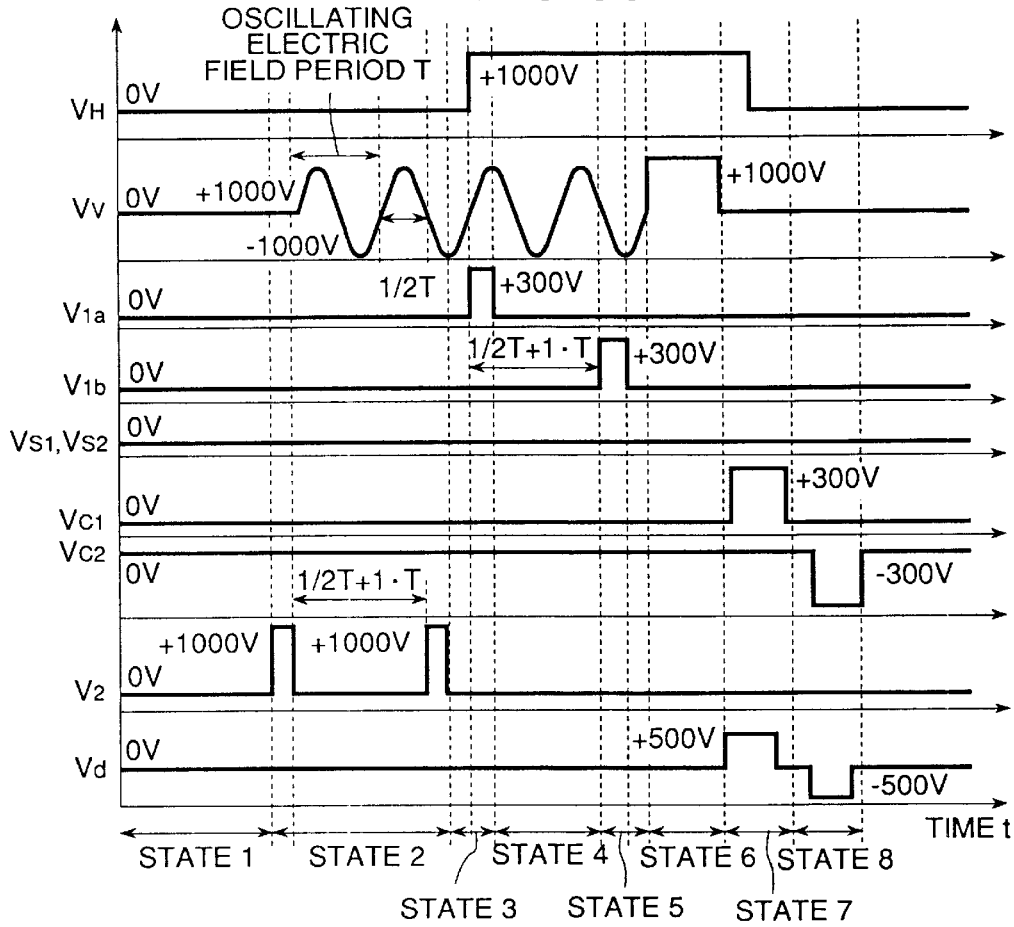
FIG. 80 is a view for explaining the structure and operation of the flight control unit of the image forming device using the present invention if two first gates are provided between a pair of oscillating electric field forming electrodes.
Figure 81:
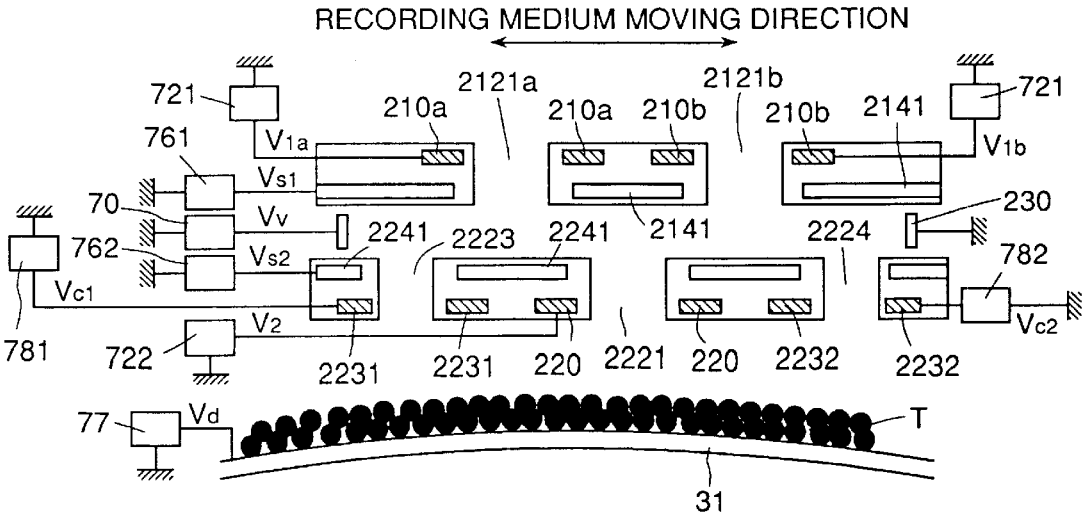
FIG. 81 is a view for explaining the structure and operation of the flight control unit of the image forming device using the present invention if two first gates are provided between a pair of oscillating electric field forming electrodes.

FIG. 80 is a timing chart showing the voltages applied to respective electrodes in the present embodiment shown in FIG. 81. The operation of the present embodiment is mainly divided into states 1 through 7.

Figure 82:
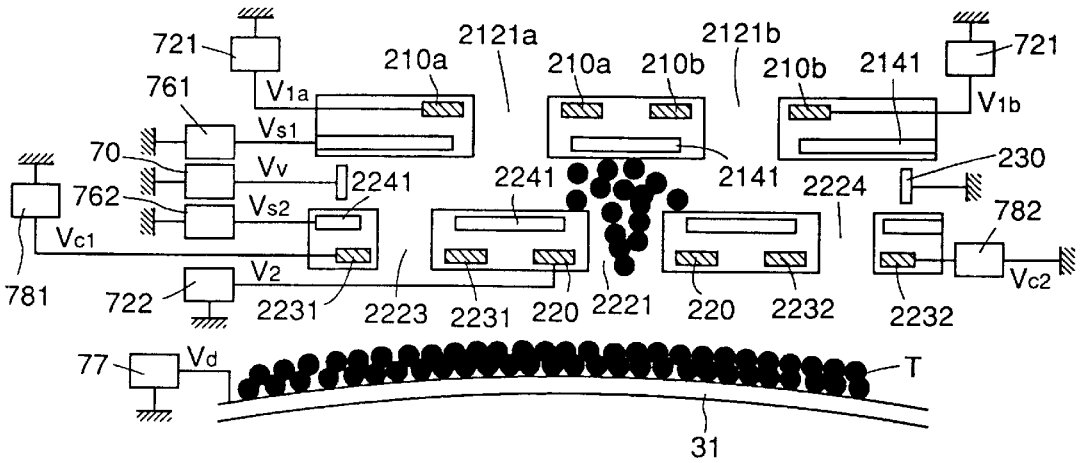
FIG. 82 is a view for explaining the structure and operation of the flight control unit of the image forming device using the present invention if two first gates are provided between a pair of oscillating electric field forming electrodes.

+1000 V is applied to the second control electrodes 220 state 2 shown in FIG. 82 so that the developing agent is passed through the second gates 2221 from the developing agent carrier to form a primary developing agent cloud between the first and second control electrode layers.

Figure 83:
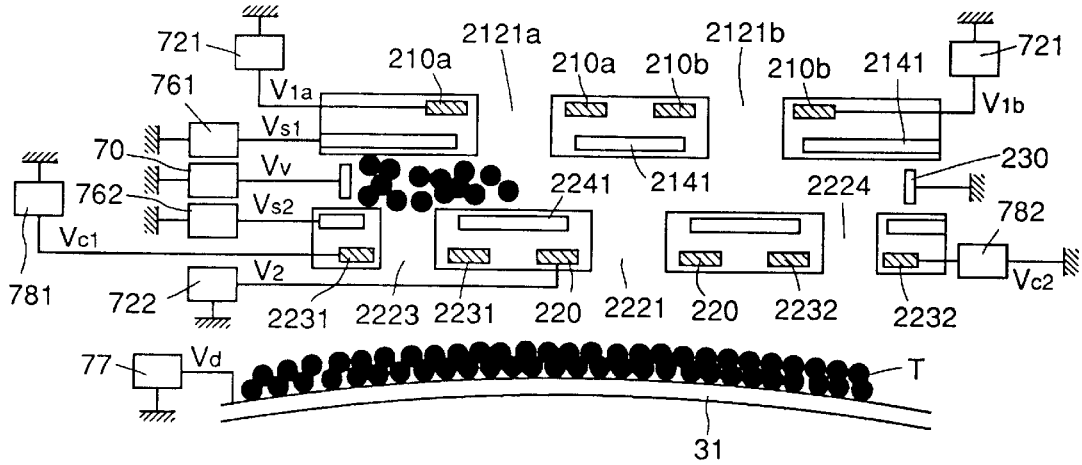
FIG. 83 is a view for explaining the structure and operation of the flight control unit of the image forming device using the present invention if two first gates are provided between a pair of oscillating electric field forming electrodes.
Figure 84:
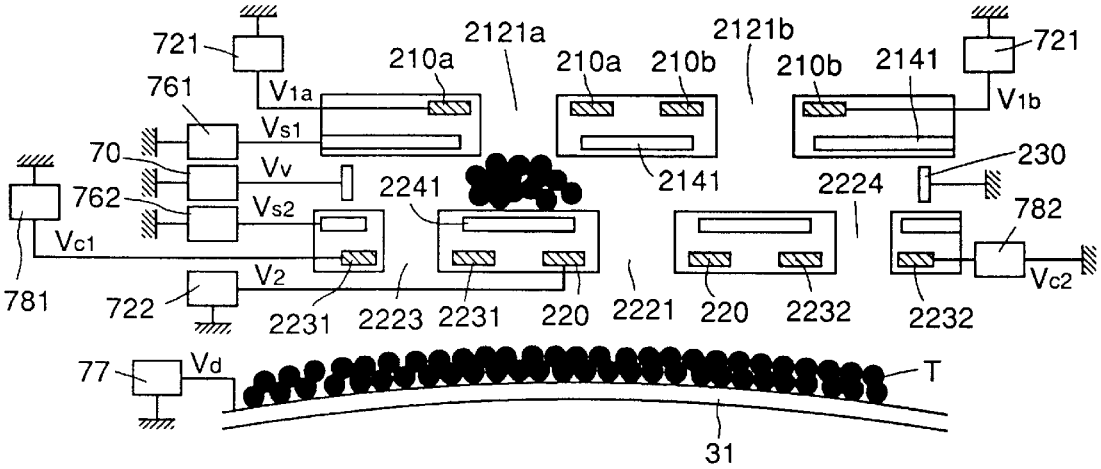
FIG. 84 is a view for explaining the structure and operation of the flight control unit of the image forming device using the present invention if two first gates are provided between a pair of oscillating electric field forming electrodes.

Then, a sinusoidal oscillating electric field is formed between the oscillating electric field forming electrodes 230, so that the above-mentioned primary developing agent cloud performs an oscillating movement therebetween. The low cloud density condition which is established at this time is shown in FIG. 83 and a high cloud density condition is shown in FIG. 84.

Figure 85:
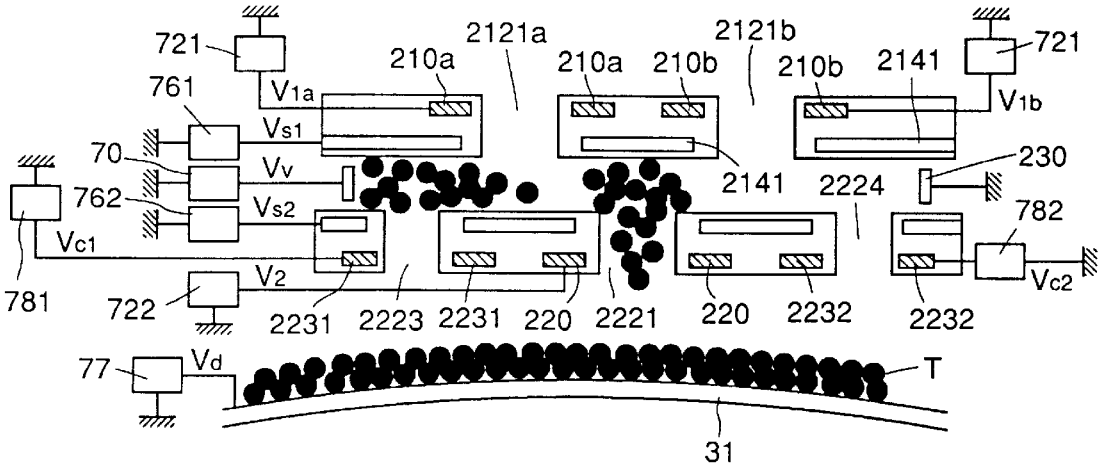
FIG. 85 is a view for explaining the structure and operation of the flight control unit of the image forming device using the present invention if two first gates are provided between a pair of oscillating electric field forming electrodes.

Then, the state is changed to the state 3. +1000 V is applied to the second control electrodes 220 after the passage of (½+1)T (T denotes the period of the oscillating electric field), so that a secondary developing agent cloud is formed between the first and second control electrode layers as shown in FIG. 85. At this time, the above-mentioned primary developing agent cloud is under a low density condition in position which is furthest from the second gates 2221. Thereafter, the secondary developing agent cloud is subjected to the action of the oscillating electric field which is delayed by (½+1) times of the period so that it performs the oscillating movement in the oscillating electric field.

Figure 86:
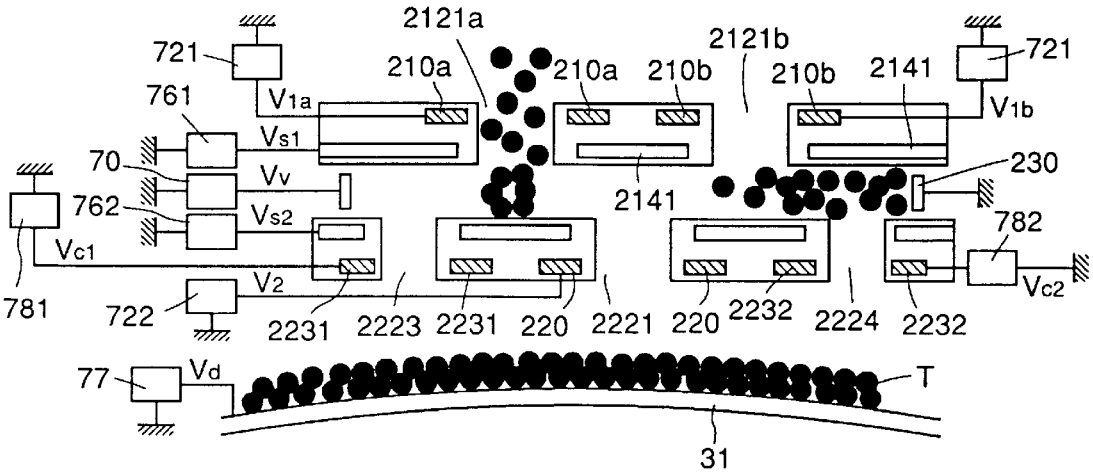
FIG. 86 is a view for explaining the structure and operation of the flight control unit of the image forming device using the present invention if two first gates are provided between a pair of oscillating electric field forming electrodes.

Then, the state is changed to the state 4. At this time, the primary developing agent cloud forms a high density cloud in the vicinity of the first gate 2121. The first ON potential of +300 V is applied to the first control electrodes 210*a* so that the developing agent is passed through the first gates as shown in FIG. 86. Although not shown, +1000 V is applied to the opposite electrode at this time so that the developing agent which has passed through the first gate 2121*a* flies upon to the recording medium on the opposite electrode to conduct image forming.

Figure 87:
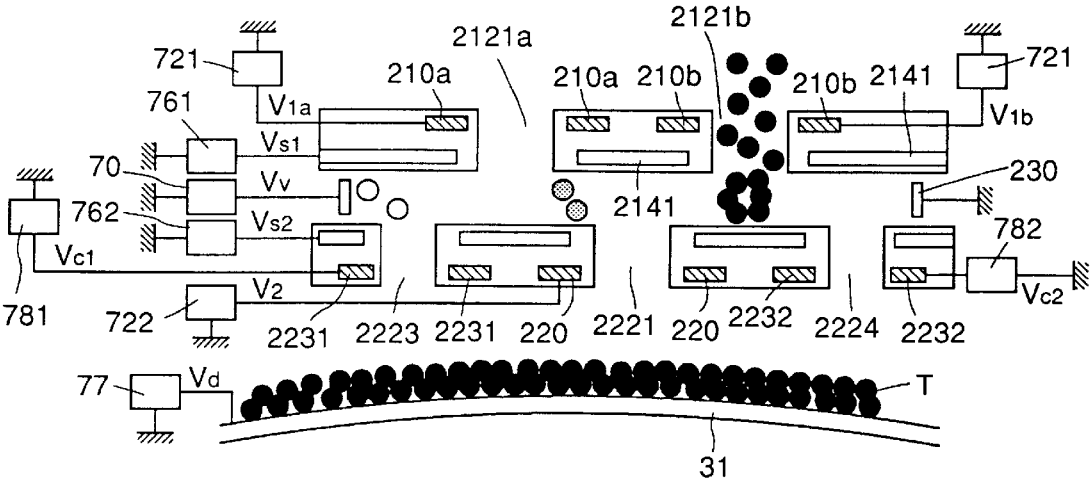
FIG. 87 is a view for explaining the structure and operation of the flight control unit of the image forming device using the present invention if two first gates are provided between a pair of oscillating electric field forming electrodes.

Then, the state is changed to the state 5. At this time, the secondary developing agent cloud forms a high density cloud in the vicinity of the first gate 2121*b*. The first ON potential of +300 V is applied to the first control electrodes 210*b* so that the developing agent is passed through the first gates 2121*b* as shown in FIG. 87. Although not shown, +1000 V is applied to the opposite electrode at this time so that the developing agent which has passed through the first gate 2121*b* flies upon to the recording medium on the opposite electrode to conduct image forming.

Figure 88:
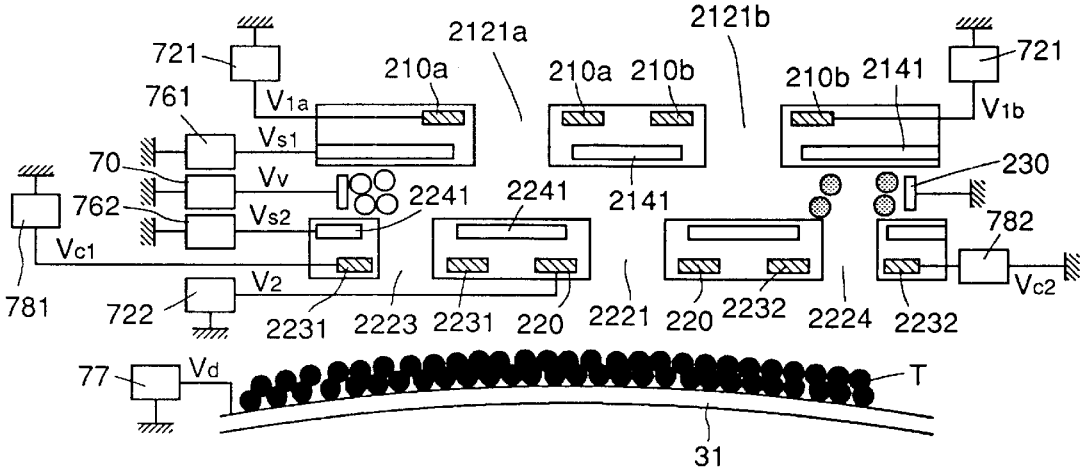
FIG. 88 is a view for explaining the structure and operation of the flight control unit of the image forming device using the present invention if two first gates are provided between a pair of oscillating electric field forming electrodes.
Figure 89:
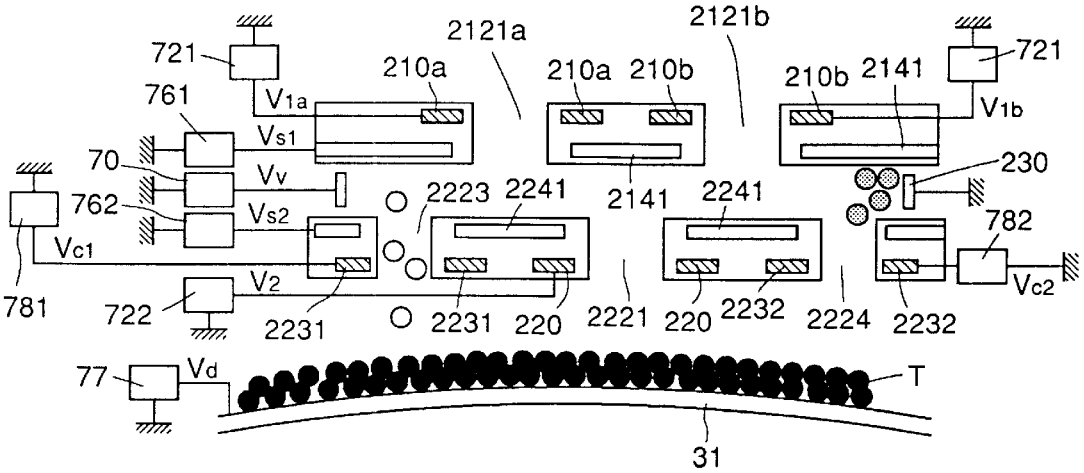
FIG. 89 is a view for explaining the structure and operation of the flight control unit of the image forming device using the present invention if two first gates are provided between a pair of oscillating electric field forming electrodes.
Figure 90:
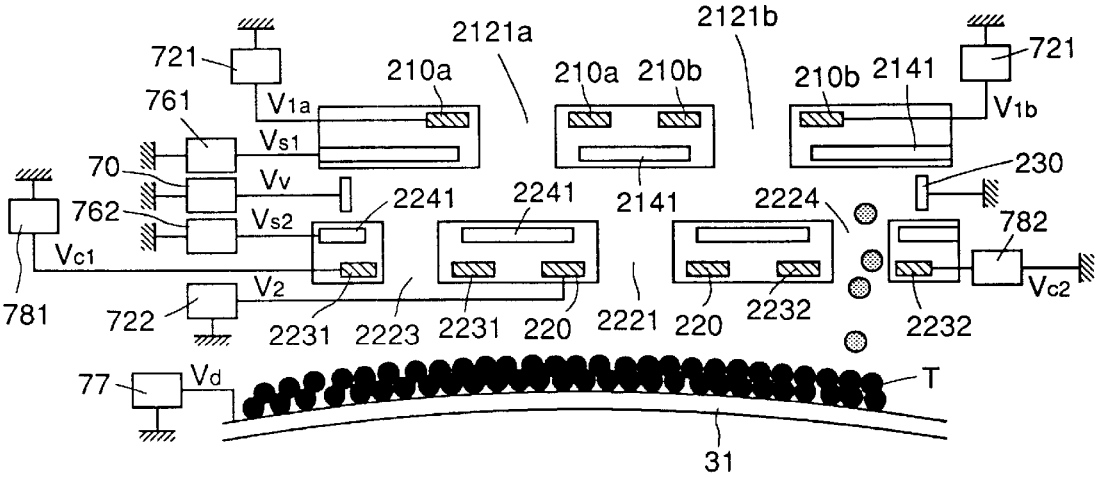
FIG. 90 is a view for explaining the structure and operation of the flight control unit of the image forming device using the present invention if two first gates are provided between a pair of oscillating electric field forming electrodes.

Thereafter, the recovery processing of the unused developing agent is conducted by the operation which has been described in the foregoing embodiment 15. The timing for the applications of the voltages to respective electrodes at this time is represented as states 6, 7, 8 in FIG. 80. The movement of the developing agent is shown in FIGS. 88 through 90.

Image forming is carried out by repeating a series of operation as mentioned above.

Since the density of the developing agent cloud in one of two first gates can be equal to that in the other first gate by shifting the time when the developing agent passes through the second gates 2221 by (½+n) times of the period of the oscillating electric field, the flight of the developing agent through each of the first gates can be made uniform, enabling a stable image forming. Although the time when the developing agent passes through the second gates is shifted by (½+n) times of the period of the oscillating electric field, the present invention is not limited to this value if the changes in the cloud density due to the variations in the distribution of the specific charge of the developing agent is not significant. It is possible to change this value as far as an enough effect can be obtained.

Since the flight of the developing agent from the second gates is conducted twice until the first ON potential is applied once to each of the first gate which is formed between paired oscillating electric field forming electrodes, the number of times of cleaning is reduced so that it is effective to enhance the speed of image forming. If the speed of image forming is insignificant, the space between the first and second control electrode layers is cleaned and then image forming may be conducted on one of two gates after image forming is conducted on the other first gates which is formed between a pair of oscillating electric field forming electrodes. In this case, the number of the oscillating electric field forming electrodes and the number of second control electrodes can be reduced so that it is effective to simplify the structure of the control electrodes.

(Embodiment 17)

Figure 93:
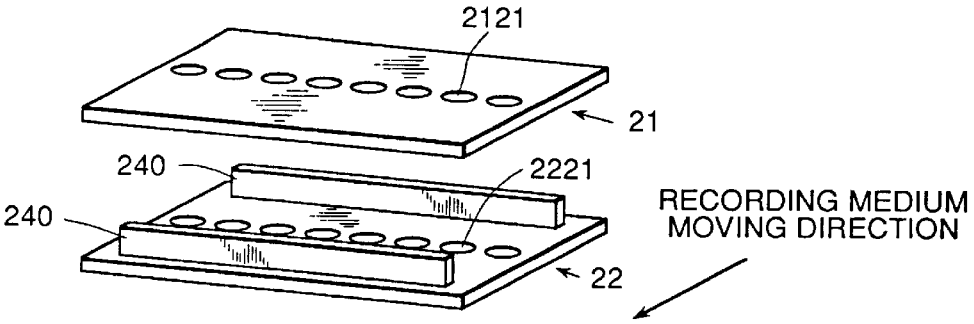
FIG. 93 is a view for explaining one example of the mechanism for keeping the space between the first and second control electrode layers in the image forming device using the present invention.
Figure 94:
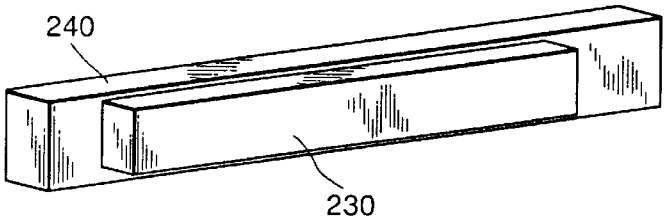
FIG. 94 is a view for explaining another example of the mechanism for keeping the space between the first and second control electrode layers in the image forming device using the present invention.
Figure 95:
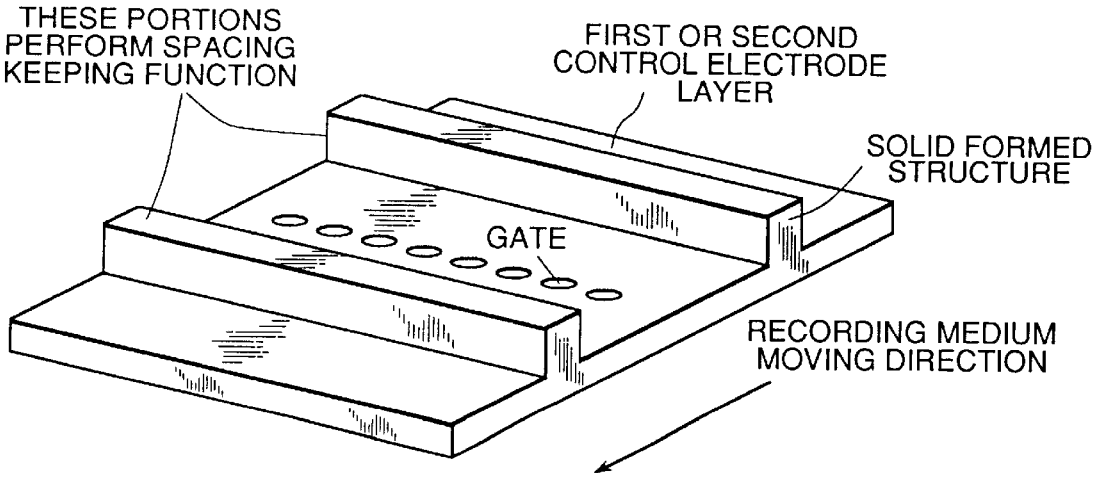
FIG. 95 is a view for explaining further example of the mechanism for keeping the space between the first and second control electrode layers in the image forming device using the present invention.

Spacing keeping members 240 which are in the various forms as shown in FIGS. 93 through 95 may be inserted between the control electrode layers in order to keep a constant distance between the first and second control electrode layers 21 and 22.

FIG. 93 shows an embodiment in which the longitudinal direction of the spacing keeping members 240 are aligned with that of the control electrode layers. The spacing between the first and control electrode layers 21 and 22 can be kept constant by using such spacing keeping members 240. The first and second control electrode layers 21 and 22 may be in such a form so that they extends in a recording medium moving direction at their opposite ends in a longitudinal direction thereof. In this case, the spacing between the control electrode layer in the mid position along the length of the control electrode layers may be narrowed due to slack of the electrode layers themselves. Accordingly, it is preferable to provide means for giving a tension to the control electrode layers at the opposite ends thereof to prevent this slack.

FIG. 94 shows an embodiment in which an oscillating electric field forming electrode 230 is formed on the spacing keeping member 240.

This enables to keep the distance between the first and second control electrodes as well as the distance between these control electrodes and the oscillating electric shield forming electrodes. The present embodiment is advantageous for the simplification of the device.

The above-mentioned spacing keeping members 240 may be made of an electrically conductive material. The material includes metals or electrically conducting resins. Use of such a material enables the spacing keeping members 240 to perform both functions such as spacing keeping function and the oscillating electric field forming function. The embodiment is advantageous to simplify the device and to reduce the number of components.

Alternatively, the first and control electrode layers may be in such a form that they have the space keeping function as shown in FIG. 95. In this case, this embodiment is advantageous to simplify the device and to reduce the number of components.

(Embodiment 18)

In the above-mentioned embodiment, the first control electrodes 210 of the first control electrode layer 21 may be in the form of double layered X-Y matrix.

Figure 96:
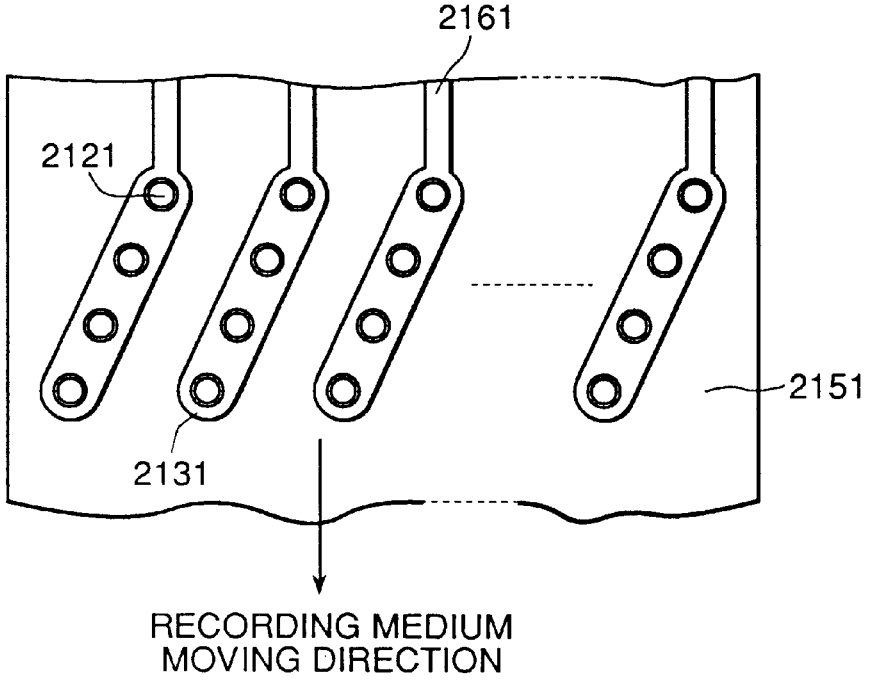
FIG. 96 is a view for explaining the structure if the first control electrode used for the present invention is in the form of x-y matrix.
Figure 97:
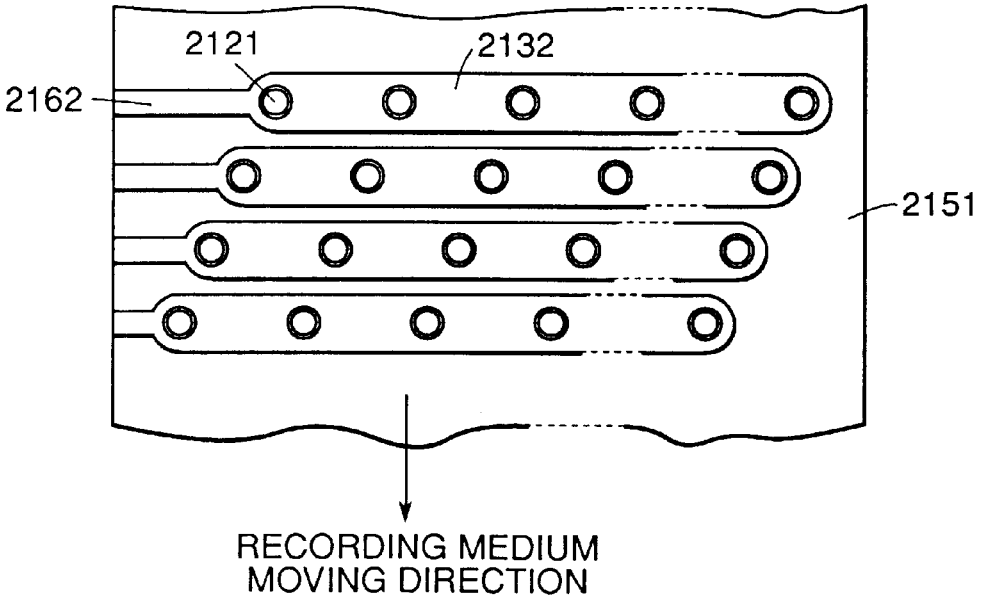
FIG. 97 is a view for explaining the structure if the first control electrode used for the present invention is in the form of x-y matrix.
Figure 98:
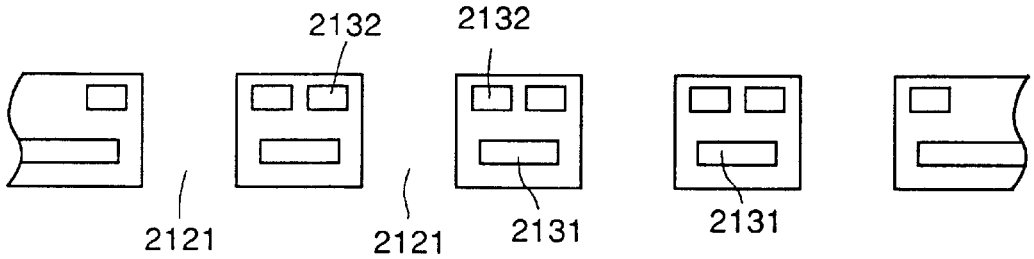
FIG. 98 is a view for explaining the structure if the first control electrode used for the present invention is in the form of x-y matrix.

The present embodiment comprises first column control electrodes 2131 and first row control electrodes 2132. The first column control electrodes 2131 comprises electrodes having opening in positions corresponding to the first gates 2121 of the first control electrode layer 21 as shown in FIG. 96, the electrodes being extended in a recording medium moving direction and being electrically connected to each other. The first row control electrode 2132 comprises electrodes having openings in positions corresponding the first gates 2121 of the first control electrode layer 21 as shown in FIG. 97, the electrodes being extended in a longitudinal direction of the first control electrode layer and being electrically connected to each other. A laminated control electrode structure is provided by sandwitching an insulating substrate layer 2151 between the first column and row control electrodes 2131 and 2132, which are electrically insulating.

The first column control electrode 2131 are electrically connected to a first column control electrode driver (not shown) through a first column control electrode power supply line 2161. The first row control electrodes 2132 are electrically connected to a first row control driver (not shown) through a first row control electrode power supply line 2162. An electric field for controlling the passage or non passage of the developing agent through desired gates is formed by combination of the voltages applied to the row and column electrodes.

Such a control electrode arrangement is generally called as matrix system. Various systems which are capable of reducing the number of high breakdown ICs which are required to control respective gates have been proposed. However, in these systems, it is required to pass the developing agent through the gates when both of the row and column electrodes are rendered ON state and to prohibit the passage of the developing agent through the gates when the electrodes in the alternative states (OFF/OFF, ON/OFF, OFF/ON) since a higher strength of flight electric field which is formed when the passage of the developing agent is allowed cannot be provided in comparison with the case of controlling one gate by means of one electrode if driver ICs of the same switching voltage are used, a problem may occur in that the flight length of the developing agent is insufficient. In contrast to this, the above-mentioned problem will not advantageously occur in such a configuration that the flight of the developing agent is enabled at a low strength electric field in accordance with the present invention.

An operation for conducting image forming by using such the first control electrode layer can be conducted in the same manner as the above-mentioned embodiment.

In the present embodiment, four row electrodes are disposed. The present invention is not limited to such number of electrodes.

(Embodiment 19)

The above-mentioned embodiment 18 may be modified in such a manner that there may be provided a control electrode having a structure including only the first column control electrode 2131 in which the control electrodes 21 of the first control electrode layer 21 extend in a recording medium moving direction in positions corresponding to the first gates 2121 and are electrically connected as shown in FIG. 96.

The second control electrodes 220 may perform the same function of the first row control electrode 2131 of the above-mentioned embodiment 18. In this case, the second ON potential is applied to the second control electrodes 220, so that control of the passage or non-passage of the developing agent is conducted in only the gate to which the potential for permitting the passage of the developing agent is applied, of the gates in which a developing agent cloud is formed between the first and second control electrode layers 21 and 22. Also in this case, an advantage in which the number of the high breakdown ICs which are required is reduced can be obtained similarly to the above-mentioned embodiment 13.

(Embodiment 20)

Figure 99:
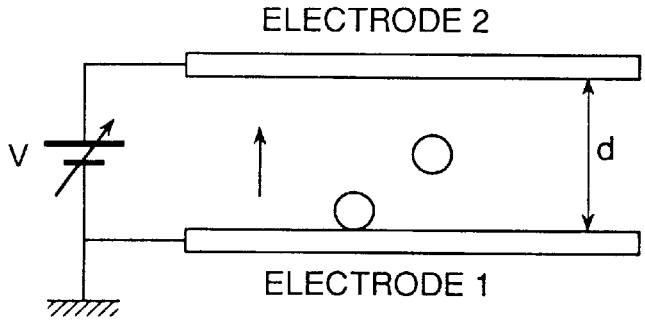
FIG. 99 is a view for explaining the motion condition of charged particles when a voltage which changes with time is applied in the image forming device using the present invention.
Figure 100:
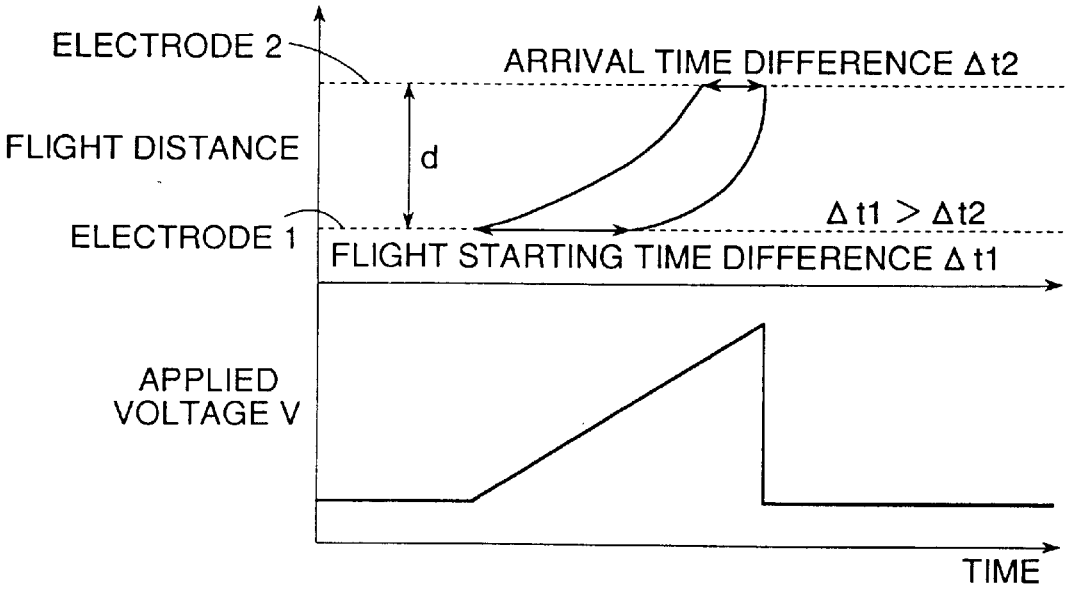
FIG. 100 is a view for explaining the motion condition of charged particles when a voltage which changes with time is applied in the image forming device using the present invention.

In the above-mentioned embodiment, the second ON potential which is applied to the first control electrodes 210 may be changed in such a manner that the electric field for moving the developing agent toward the first control electrode layer 21 is progressively increased. When some particles are moved on subject to the action of the electric field increasing with the lapse of time as shown in FIG. 99, the difference in time when they reach at the desired position is less than that when they initiate the movement as shown in FIG. 100.

Figure 101:
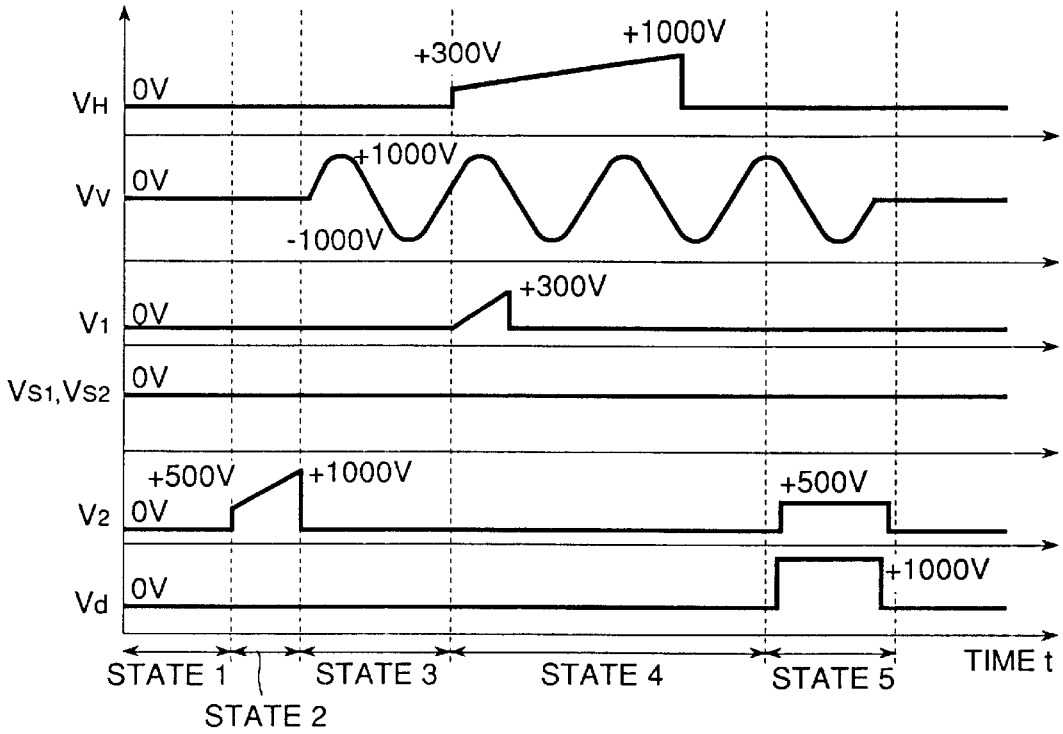
FIG. 101 is a view for explaining the operation when a voltage which changes with time is applied in the image forming device using the present invention.
Figure 102:
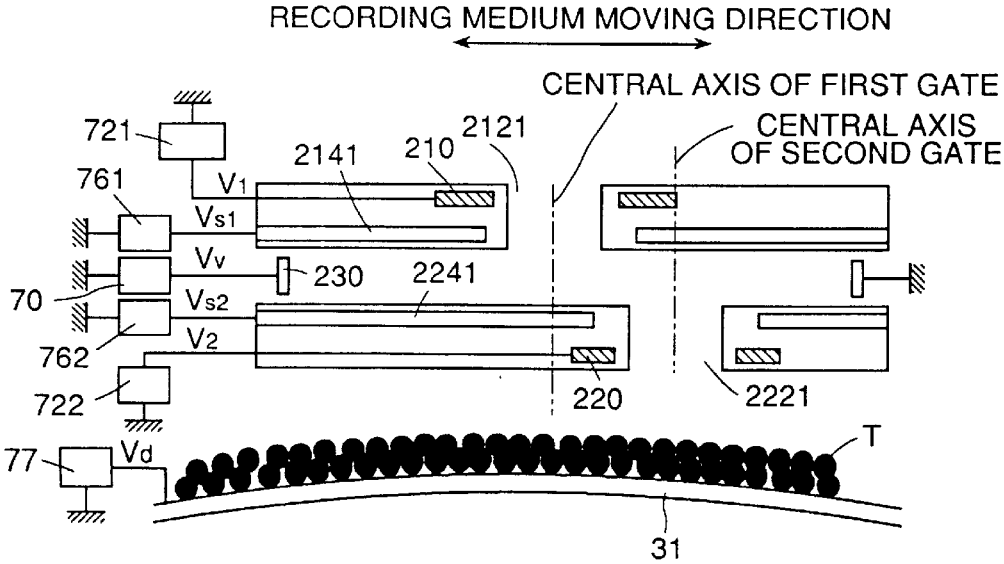
FIG. 102 is a view for explaining the operation when a voltage which changes with time is applied in the image forming device using the present invention.

A time chart of voltage application in the present embodiment and the configuration of a flight control unit to which the voltages are applied is shown in FIGS. 101 and 102, respectively.

The developing agent initiates its flight at different time to some an extent due to the difference in the adhering ability to the developing agent carrier 31. Accordingly, the time difference may occur to some extent for the desired amount of the developing agent to pass through the second gates 2221 to reach the space between the first control electrodes 210 and the second control electrode layer 22. Accordingly, if a voltage which is shown in FIG. 101 is applied as the second ON potential in the present embodiment, the time difference between the developing agent which is initially flown from the developing agent carrier and the last flown developing agent, reaching at the space between the first and second control electrode layers 21 and 22 could be shortened. This enables the difference in phase of the oscillating electric field to be reduced when the developing agent initiates its oscillating movement on subject to the oscillating electric field between the first and second control electrode layers 21 and 22. A high density developing agent cloud can be provided.

As shown in FIG. 101, the first ON potential which is applied to the first control electrode 210 or the opposing potential may be changed in such a manner that the electric field in such a direction to move the developing agent toward the recording medium is progressively increased.

If there is a large difference in time which is taken for the developing agent flown from the first gates 2121 to reach at the recording medium when the first time and first ON potential is applied, pixels would be spread in a direction of movement of the recording medium since the recording medium is moving. This time difference is caused by the time difference when the developing agent starts from the first gates 2121. Therefore, by changing the potential of the opposing electrodes in such a manner that the electric field for causing the developing agent to be moved toward the recording medium is progressively increased in accordance with the present invention, the difference in arrival time of the developing agent at the recording medium can be made smaller so that unwanted spread of pixels can be suppressed.

The departure time difference of the developing agent leaving from the first gates 2121 is the time difference when the developing agent which is flown by the application of the first time and first ON potential passes through the first gates 2121 from the space between the first and second control electrode layers. Accordingly, in order to decrease the difference in time which is taken for the developing agent to pass through the first gates 2121, the difference in arrival time of the developing agent at the recording medium can be decreased for suppressing the spreading of pixels by changing the first control electrode potential in such a manner that the electric field for causing the developing agent to pass through the first gates 2121 is progressively increased.

The advantage can be obtained by conducting these countermeasures independently. The countermeasures may be appropriately selected depending upon the other restrictions.

(Embodiment 21)

Although the developing agent carrier is in the form of cylinder in the foregoing embodiments, it may be of such a structure that it carries the developing agent in parallel with the second control electrode layer 22 at an area where the gate unit of the second control electrode layer 22 exists.

Figure 103:
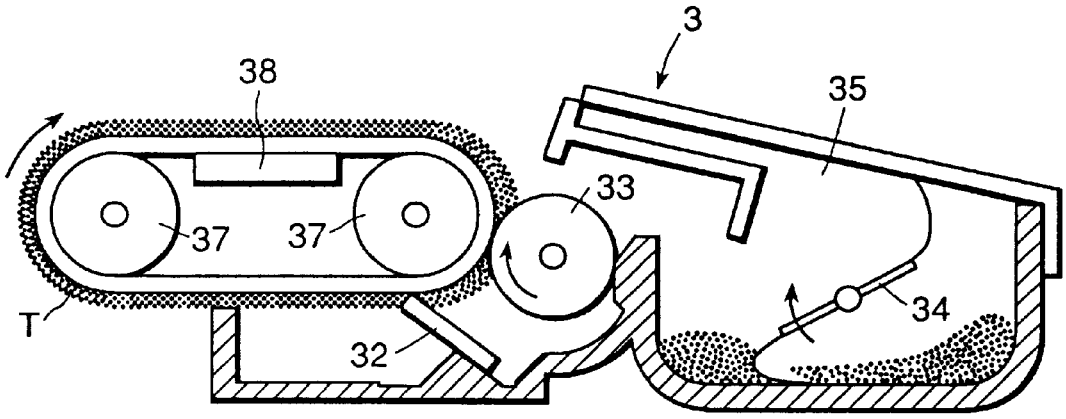
FIG. 103 is a view showing the structure of the developing agent supply unit of the image forming device using the present invention in which a belt-like developing agent carrier is provided.

The belt-like developing agent carrier which is shown in FIG. 103 is used in the present embodiment. The developing agent T is carried on and conveyed by the belt-like developing agent carrier 36 in FIG. 103. A given tension is imparted to the developing agent carrier 36 by a belt tension member 37. The developing agent carrier 36 is provided on its reverse side with a developing agent carrier potential applying member 38 for applying a desired potential to the carrier. The present embodiment is identical in the other members, mechanism and operation to that which has been described with reference to FIG. 3.

This eliminates the changes in distance between the second control electrode layer 22 and the developing agent carrier which is called by the curvature of the developing agent carrier so that the distance between the second control electrode layer 22 and the developing agent carrier is kept substantially constant at each gate unit in direction of the advancement of the developing agent carrier and the strength of the electric field for flying the developing agent from the developing agent carrier 36 is kept constant. Accordingly, the amount of the developing agent passing through the second gate 2221 becomes constant at each gate unit. This enables uniform images to be formed.

If a plurality of the first control electrodes 210 are disposed in a recording medium moving direction, the widths of the first and second gates 2121 and 2221 in a recording medium moving direction becomes larger. Accordingly, the structure of the present embodiment is particularly advantageous. Since the length of the control electrode layer in a direction of the advancement of the developing agent carrier becomes longer in an arrangement for forming the oscillating electric field in the above-mentioned embodiment, the present embodiment is also advantageous.

Although the present invention has been described with reference to embodiments 1 through 21, the present invention is not limited to the values which have been described in these embodiments.

For example, concerning to the conditions for forming the oscillating electric field, the wave form of the oscillating electric field may be triangular or rectangular, the frequency of the oscillating electric field may be several tens Hz to several tens kHz, or more depending upon the image forming speed. The amplitude of the voltages which are applied to the electrodes may be different depending upon the applications.

The mechanical restrictions such as aperture diameter of the electrode layer and the position of the electrode layer may be different depending upon the mode of applications.

The advantages of the present invention are as follows.

The developing agent is formed in the cloud state in which the action of a force in a direction to prevent the flight of the developing agent is very low when the developing agent is caused to fly from the first control electrode layer toward the recording medium. The strength of the electric field which is required for flying the developing agent is low in this state so that the drive voltage of the first control electrode for controlling the flight/non-flight for the developing agent can be made lower. The cloud of the developing agent which is formed between the first and second control electrode layers is formed when it is passed through the second control electrode layer. The amount, density and supply timing of the developing agent cloud can be controlled to desired conditions so that formation of a stable cloud is possible.

An oscillating electric field is formed between the oscillating electric field forming electrodes by application of an oscillating voltage thereto so that the developing agent which is the form of cloud conducts a reciprocal movement for separating the aggregate of the developing agent in the cloud and for enhancing the uniformity of the distribution of the developing agent. This enables the developing agent to be more effectively controlled.

The direction of movement of the developing agent can be changed by changing the direction of the oscillating electric field. The aggregated developing agent can be effectively dispersed.

Presetting of the voltage can be conveniently made by presetting the oscillating electric field so that the direction of the oscillating electric field is changed and the strength of the oscillating electric field is equal in both positive and negative directions. Reduction in cost can be achieved.

The distance between the oscillating electric field forming electrodes can be shorter by aligning an oscillating electric field forming direction with a recording medium advancing direction. The voltage which is required to provide a necessary oscillating electric field strength can be suppressed lower.

Smooth movement of the developing agent is stably conducted in the oscillating electric field even in a condition in which whatever potential is established on the opposing electrode.

Smooth movement of the developing agent is stably conducted in the oscillating electric field even in a condition in which whatever potential is established on the developing agent carrier.

Smooth movement of the developing agent is stably conducted in the oscillating electric field even in a condition in which whatever potential is established on the opposing electrode. The developing agent may be deposited to the first control electrode layer for the reason such as falling from the recording medium. In this case, an electric field for moving the deposited developing agent is formed between the first control electrode layer and the opposing electrode and the like by applying an oscillating or D.C. voltage from a third shield electrode power source which is electrically connected to the third shield electrode, so that cleaning of the developing agent which is deposited to the side of the first control electrode layer facing to the opposing electrode can be achieved by moving the deposited developing agent forward the opposing electrode.

Smooth movement of the developing agent is stably conducted in the oscillating electric field even in a condition in which whatever potential is established on the developing agent carrier. Wasteful consumption of the developing agent is prevented and desired image forming can be conducted downstream in a developing agent conveying direction.

A stable cloud condition can be formed by making the strength of electric field between the first and second control electrode layers in a developing agent flying direction substantially zero. Smooth movement of the developing agent is stably conducted in the oscillating electric field even in a condition in which whatever potential is established on the developing agent carrier and the opposing electrode.

Occurrence of defects on an image due to the fact that the developing agent which has accidentally passed through the first gate is deposited on the recording medium in a undesired position on the opposing electrode can be suppressed.

The effect of suppressing of the occurrence of defects on an image can be enhanced by adopting a structure in which the apertures of the first gate are not completely aligned with those of the second gate.

Necessity of provision of means for moving the developing agent cloud toward the first gate is eliminated by offsetting the positions of the first and second gates in an oscillating electric field forming direction. Simplification of the structure can be achieved.

The oscillating voltage which is required to provide a necessary oscillating electric field strength can be made lower by offsetting the positions of first and second gates in a recording medium advancing direction. Reduction in cost can be achieved.

The developing agent is caused to fly by applying the first ON voltage to the first control electrode in such a manner that the time of interval of application of the voltage includes the time when the moving speed of the developing agent becomes zero, that is, the developing agent changes the direction of its reciprocal movement. Spreading of the developing agent can be suppressed in the flying process and an adverse influence upon image forming can be reduced.

The necessary amount of flown developing agent can be obtained by causing the developing agent to pass through the first gate when the density of cloud of the developing agent becomes higher even if there are variations in the specific charge of the developing agent.

Most of the developing agent which is in the form of cloud when the reciprocal moving speed of the developing agent becomes substantially zero can pass through the first gate so that the developing agent can be efficiently used.

Control can be conducted without changing the shape of electrodes in such a manner that most of the developing agent in the form of cloud can pass through the first gate when the reciprocal moving speed of the developing agent becomes zero in a position other than the first gate under a condition in which the amount of charges on the developing agent changes. The developing agent can be efficiently used.

Reduction in cost can be achieved since an oscillating voltage power source having a convenient form can be used.

Necessary amount of flying developing agent can be stably obtained since the speed of the developing agent is low and image forming can be conducted under a high density cloud.

A problem such as clogging of the gates and interfering with the movement of the developing agent in the oscillating electric field due to the accumulation of the unused developing agent between the first and second control electrode layers does not occur so that stable image forming can be achieved.

The recovery efficiency of the developing agent can be enhanced since most of the unused developing agent can be collected in the vicinity of the cleaning gates.

Cleaning efficiency can be enhanced by increasing the passing ability of the gate for the unused developing agent.

Recovery of the developing agent can be conducted independently of the image forming between a plurality of pairs of oscillating electric field forming electrodes since the recovery of the unused developing agent can be conducted without interfering with the formation of cloud, even if the formation of the developing agent is conducted between a pair of oscillating electric field forming electrodes which are disposed in a recording medium advancing direction and the second shield electrode is used together. Stability and speed of image forming can be enhanced.

Simplification of the structure of control electrodes can be achieved since the number of the oscillating electric field forming electrodes and the second control electrodes can be reduced.

The number of cleaning steps is reduced, since flying of the developing agent from the second gate is conducted twice until the first ON voltage is once applied to each of the first gates formed between a pair of oscillating electric field forming electrodes. The image forming speed can be increased.

The density of developing agent cloud in two first gates can be made equal by shifting the time of the passage of the developing agent through the second gates by (½+n) times of the period of the oscillating electric field even if there are variations in specific charge of the developing agent. The flying condition of the developing agent in each of the first gates can be made uniform so that stable image forming can be achieved.

The space between the first and second control electrode layers can be kept constant in a longitudinal direction, so that simplification of the apparatus and reduction in the number of components can be achieved.

Reduction in cost can be achieved since the number of high voltage ICs can be reduced.

The difference in arrival time to the space between the first and second control electrode layers of the developing agent which flew first from the developing agent carrier and the developing agent which flew last can be shortened. This decreases the difference in phase of the oscillating electric field acting on each developing agent when the developing agent initiates the reciprocal movement on subject to the oscillating electric field between the first and second control electrode layers. High density developing agent cloud can be provided.

The difference in arrival time of the developing agent to the recording medium can be reduced by changing the potential on the opposing electrode in such a manner that the electric field in a direction for moving the developing agent toward the recording medium is progressively increased. Spreading of pixels can be suppressed.

The difference in arrival time of the developing agent to the recording medium can be reduced by changing the potential on the first control electrode in such a manner that the electric field in a direction for passing the developing agent through the first gate is progressively increased. Spreading of pixels can be suppressed.

Even if a plurality of the first control electrodes are disposed in a recording medium advancing direction and the width in a recording medium advancing direction where first and second gates are disposed is larger, the change in the distance between the first control electrode layer and the developing agent carrier due to the curvature of the developing agent carrier is eliminated. The distance between the second control electrode layer and the developing agent carrier in each gate unit in a developing agent carrier moving direction can be kept substantially constant and the strength of the electric field for causing the developing agent to fly from the developing agent carrier can be kept constant. Accordingly, the amount of the developing agent passing through each of the second gates can be made constant so that uniform image forming can be achieved. Although the length of the control electrode layer in a developing agent carrier advancing direction is large when the oscillating electric field is formed. Also in this case, uniform image forming can be achieved for the same reason as mentioned above.

What is claimed is:

1. An image forming device comprising:

a development agent carrier for carrying thereon a developing agent which is charged to a given polarity;

an opposing electrode which faces the developing agent carrier and to which a voltage for forming an electric field which causes developing agent carried on the developing agent carrier to fly from the developing agent carrier toward the opposing electrode can be applied;

a first insulating gate unit located between, and in spaced relation relative to, both the opposing electrode and the developing agent carrier, said first insulating gate unit defining a plurality of gates through which the developing agent can be passed;

a first control electrode unit to which a voltage for permitting or prohibiting the selective passage of developing agent through the gates of the first gate unit can be applied;

a second insulating gate unit located between, and in spaced relation relative to, both the first gate unit and the developing agent carrier, said second insulating gate unit defining a plurality of take up gates for taking up developing agent from the developing agent carrier;

a second control electrode unit to which a voltage for permitting or prohibiting the selective passage of developing agent through the taking up gates of the second gate unit can be applied; and at least one pair of oscillating electric field forming electrodes for forming an oscillating electric field in a direction normal to the flight direction of developing agent between the first and second insulating gate units caused when an electric field between the opposing electrode and the developing agent carrier is formed;

whereby images can be formed on a recording medium moved between, and relative to, both the opposing electrode and the first insulating gate unit by the effects upon developing agent flying from the carrier toward the opposing electrode in an electric field formed between them caused by voltages selectively applied to the first and/or second control electrode units.

2. An image forming device as defined in claim 1, wherein a direction of the oscillating electric field which is formed by the one pair of oscillating electric field forming electrodes is changed.

3. An image forming device as defined in claim 2, wherein a changing direction of the oscillating electric field is equal in both positive and negative directions.

4. An image forming device as defined in claim 1, wherein the one pair of oscillating electric field forming electrodes are disposed in such a manner that they are opposed to each other and their surfaces are normal to the recording medium moving direction.

5. An image forming device as defined in claim 1, wherein the device further includes a shield electrode layer extending two-dimensionally on the side of the first gate unit facing to the second gate unit, the shielding electrode layer having image forming gates of the first gate unit therethrough so that unwanted approaching of the developing agent to the first or second gate unit can be suppressed by the action of the shield electrode layer.

6. An image forming device as defined in claim 1, wherein the device further includes a shield electrode layer extending two-dimensionally on the side of the second gate unit facing to the first gate unit, the shield electrode layer having the taking up gates of the second gate unit therethrough so that unwanted approaching of the developing agent to the first and second gate units can be suppressed by the action of the shield electrode layer.

7. An image forming device as defined in claim 1, wherein the device further includes a shield electrode layer extending two-dimensionally on the side of the first gate unit facing to the opposing electrode, the shield electrode layer having image forming gates of the first gate unit therethrough so that unwanted approaching of the developing agent to the first and second gate units can be suppressed by the action of the shield electrode layer.

8. An image forming device as defined in claim 1, wherein the device further includes a shield electrode layer extending two-dimensionally on the side of the second gate unit facing to the developing agent carrier, the shield electrode layer having taking-up gates of the second gate unit therethrough so that unwanted approaching of the developing agent to the first and second gate units can be suppressed by the action of the shield electrode layer.

9. An image forming device as defined in claim 1, wherein the device further includes a shield electrode layer extending two-dimensionally in the first gate unit facing to the second gate unit, the shield electrode layer having the image forming gates of the first gate unit therethrough, and another shield electrode layer extending in the second gate unit facing to the first gate unit, the shield electrode layer having taking-up gates of the first gate unit therethrough, and in that same potential is applied both the shield electrode layer in the first gate unit, which is closest to the second gate unit and the shield electrode layer in the second gate unit, which is closest to the first gate unit when an oscillating electric field is formed between at least one pair of the oscillating electric field forming electrodes.

10. An image forming device as defined in claim 1, wherein apertures of the image forming gates of the first gate unit and apertures of the taking-up gates of the second gate unit are disposed in such a manner that the centers of the apertures are not aligned with each other.

11. An image forming device as defined in claim 10, wherein apertures of the image forming gates of the first gate unit and apertures of the taking-up gates of the second gate unit are disposed in such a manner that they do not overlap each other in a normal direction and a developing agent flying direction.

12. An image forming device as defined in claim 10, wherein the image forming gates of the first gate unit and the taking-up gates of the second gate unit are disposed in such a manner that they are offset to each other in an oscillating electric field forming direction.

13. An image forming device as defined in claim 10, wherein the image forming gates of the first gate unit and the taking-up gates of the second gate unit are disposed in such a manner that they are offset to each other in a recording medium moving direction.

14. An image forming device as defined in claim 1, wherein timing of application of a voltage for permitting the passage of the developing agent through the image forming gates of the first gate unit includes time when a moving speed of the developing agent becomes zero or the developing agent is reversed between the one pair of oscillating electric field forming electrodes.

15. An image forming device as define in claim 14, wherein timing of application of a voltage for permitting the passage of the developing agent through the image forming gates of the first gate unit selectively includes time when a spacial density of the developing agent becomes higher if the spacial density of the developing agent differs depending upon a plurality of positions in which a moving speed of the developing agent becomes zero between the one pair of oscillating electric field forming electrodes.

16. An image forming device as defined in claim 14, wherein each of image forming gates of the first gate unit is present in the vicinity of a position in which a moving speed of the developing agent between the one pair of oscillating electric field forming electrodes becomes zero.

17. An image forming device as defined in claim 16, wherein a voltage which is applied to the oscillating electric field forming electrodes is controlled in such a manner that a moving speed of the developing agent between the one pair of oscillating electric field forming electrodes becomes zero in the vicinity of the image forming gates of the first gate unit.

18. An image forming device as defined in claim 14, wherein a voltage which is applied to the oscillating electric field forming electrodes is controlled in such a manner that a spacial density of the developing agent becomes higher in the vicinity of the taking up gates of the second gate unit.

19. An image forming device as defined in claim 1, wherein timing of application of a voltage for permitting the passage of the developing agent through the taking-up gates of the second gate unit does not include time when the absolute value of the strength of the oscillating electric field which is formed between the one pair of oscillating electric field forming electrodes becomes maximum.

20. An image forming device as defined in claim 1, wherein the second gate unit includes at least one cleaning gate for cleaning excessive developing agent between the first gate unit and second gate unit by discharging the developing agent toward the developing agent carrier within the oscillating electric field established by the one pair of oscillating electric field forming electrodes in addition to the taking-up gates.

21. An image forming device as defined in claim 20, wherein the cleaning gate is disposed adjacent to the oscillating electric field forming electrodes.

22. An image forming device as defined in claim 20, wherein the apertures of the cleaning gates are in such a form that a direction of long axis of the apertures is aligned with the longitudinal direction of the second gate unit.

23. An image forming device as defined in claim 20, wherein the second gate unit includes an electrode layer for forming an electric field which controls passage/non-passage of the developing agent in each of the cleaning gates.

24. An image forming device as defined in claim 1, wherein the first gate unit includes the more than one image forming gate within the oscillating electric field established by the one pair of oscillating electric field forming electrodes.

25. An image forming device as defined in claim 24, wherein a voltage for permitting the passage of the developing agent through the taking-up gates is applied at least twice to the taking-up gates within the oscillating electric field established by the oscillating electric field forming electrodes during a voltage for permitting the passage of the developing agent through two or more image forming gates is applied at least once to the two or more image forming gates within the oscillating electric field established by the same one pair of oscillating electric field forming electrodes.

26. An image forming device as defined in claim 25, wherein timing of application of the voltage for permitting the passage of the developing agent through the taking-up gates of the second gate unit satisfies the relation (½)T+nT wherein n denotes an integer and T denotes a period of the oscillating electric field.

27. An image forming device as defined in claim 1, wherein means for keeping a space between the first and second gate units is provided therebetween.

28. An image forming device as defined in claim 27, wherein the oscillating electric field forming electrodes are disposed on the means for keeping a space.

29. An image forming device as defined in claim 27, wherein the means for keeping a space is made of an electrically conductive material, to which a voltage can be applied and is arranged to function as the oscillating electric field forming electrodes.

30. An image forming device as defined in claim 27, wherein shape of each of the gate units is preset so that part of the first gate unit and/or part of the second gate unit functions as the means for keeping a space.

31. An image forming device as defined in claim 1, wherein the device includes a plurality of the image forming gates, the first control electrode has the image forming gates extending therethrough and a matrix is formed by the electrodes of a plurality of layers which enables application of a voltage to each of the plurality of image forming gates, so that the voltage can be selectively applied to each of the image forming gates.

32. An image forming device as defined in claim 1, wherein the device includes a plurality of the image forming gates, the first control electrode is arranged in such a manner that a voltage can be applied to each of the plurality of image forming gates and the passage/non-passage of the developing agent through the image forming gates of the first gate unit is controlled by a combination of voltages applied to the first and second gate units.

33. An image forming device as defined in claim 1, wherein the voltage for permitting the passage of the developing agent through the taking-up gates of the second gate unit is such that the electric field in a direction of the passage of the developing agent progressively increases with lapse of time.

34. An image forming device as defined in claim 1, wherein the voltage for permitting the passage of the developing agent through the image forming gates of the first gate unit is such that the electric field in a direction of the passage of the developing agent progressively increases with lapse of time.

35. An image forming device as defined in claim 1, wherein the voltage which is applied to the opposing electrode when the voltage for permitting the passage of the developing agent is applied to the image forming gates of the first gate unit is such that the electric field for directing the developing agent toward the opposing electrode progressively increases with lapse of time.

36. An image forming device as defined in claim 1, wherein the developing agent carrier is arranged in such a manner that the developing agent is conveyed in parallel with the second gate unit in an area opposing to an area in which at least the taking-up gates of the second gate unit is present.

* * * * *